US006341639B1

(12) United States Patent
Mullet et al.

(10) Patent No.: US 6,341,639 B1
(45) **Date of Patent: *Jan. 29, 2002**

(54) APPARATUS AND METHOD FOR WINDLOCKING A BUILDING OPENING

(75) Inventors: Willis Jay Mullet, Gulf Breeze; Donald Bruce Kyle; Kelly Ray Green, both of Pace; Harry Edward Asbury, Gulf Breeze, all of FL (US)

(73) Assignee: Wayne-Dalton Corporation, Mt. Hope, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/644,924

(22) Filed: Aug. 23, 2000

Related U.S. Application Data

(63) Continuation-in-part of application No. 09/520,845, filed on Mar. 8, 2000.

(51) Int. Cl.[7] ..... E06B 9/56

(52) U.S. Cl. ..... 160/267.1; 160/310; 160/264; 160/273.1

(58) Field of Search ..... 160/273.1, 264, 160/310, 267.1, 270, 271, 269, 309, 312

(56) References Cited

U.S. PATENT DOCUMENTS

| | | | |
|---|---|---|---|
| 516,018 | A | 3/1894 | Lauer |
| 1,692,206 | A | 11/1928 | Griffiths |
| 2,803,297 | A | 8/1957 | Wenke |
| 3,292,685 | A | 12/1966 | Clark |
| 3,516,469 | A | 6/1970 | McDonald |
| 4,065,900 | A | 1/1978 | Eggert |
| 4,069,641 | A | 1/1978 | DeZutter |
| 4,126,174 | A | 11/1978 | Moriarty et al. |
| 4,173,247 | A | 11/1979 | Piana |
| 4,294,302 | A | 10/1981 | Ricke, Sr. |

(List continued on next page.)

FOREIGN PATENT DOCUMENTS

| | | | | |
|---|---|---|---|---|
| AU | 4599 | | 11/1927 | |
| CH | 445088 | | 2/1968 | |
| FR | 1467892 | | 12/1967 | |
| FR | 2418860 | | 9/1979 | |
| SE | 201032 | * | 1/1966 | ..... 160/267.1 |

*Primary Examiner*—Blair M. Johnson
(74) *Attorney, Agent, or Firm*—Woodling, Krost, and Rust

(57) ABSTRACT

An apparatus and method for windlocking a curtain over an opening in a building is disclosed and claimed. The windlocking curtain can reside to the exterior or to the interior of the window, door or other opening and protects it from the intrusion of air, water or debris. In its upper position the windlocking curtain permits normal use of the opening and in its lower position it secures the opening. A flexible corrugated curtain has tension rods therethrough and the tension rods run in tracks on each side of the curtain and necessarily on each side of the opening. Interengagement of the tension rods with the tracks is accomplished by deformations in the rods that are referred to as interrupts. In one embodiment the rods are successively longer from top to bottom of the curtain and their interrupts matingly wedge with angled tracks to secure the curtain. In another embodiment the interrupts matingly engage parallel tracks upon the application of force due to wind, fluid (usually water or sea water) or debris. In another embodiment tension rods and interrupts are not used or necessary and a flap on the edges of a flexible curtain engage the side tracks absorbing shocking and sealing the opening. A method for securing the opening utilizing the apparatus is also claimed which provides top, bottom and side securement.

6 Claims, 48 Drawing Sheets

U.S. PATENT DOCUMENTS

| | | | |
|---|---|---|---|
| 4,478,268 | A | 10/1984 | Palmer |
| 4,601,320 | A | 7/1986 | Taylor |
| 4,649,981 | A | 3/1987 | Bibeau |
| 4,723,588 | A | 2/1988 | Ruppel |
| 5,048,739 | A | 9/1991 | Unuma et al. |
| 5,123,474 | A | 6/1992 | Smith |
| 5,131,450 | A | 7/1992 | Lichy |
| 5,163,495 | A | 11/1992 | Lichy |
| 5,232,408 | A | 8/1993 | Brown |
| 5,351,742 | A | 10/1994 | Lichy |
| 5,355,927 | A | 10/1994 | McKeon |
| 5,443,563 | A | 8/1995 | Hindel et al. |
| 5,445,209 | A | 8/1995 | Lichy |
| 5,482,104 | A | 1/1996 | Lichy |
| 5,586,592 | A | 12/1996 | McGregor |
| 5,651,406 | A | 7/1997 | Schaap |
| 5,657,805 | A | 8/1997 | Magro |
| 5,682,937 | A | 11/1997 | Decrane et al. |
| 5,839,493 | A | 11/1998 | Quasius |
| 5,848,631 | A | 12/1998 | DeGiovanni et al. |
| 5,915,448 | A | 6/1999 | Schulte |
| 6,065,525 | A | 5/2000 | Wells |
| 6,112,799 | A | 9/2000 | Mullet et al. |
| 6,296,039 | B1 * | 10/2001 | Mullet et al. |

* cited by examiner

APPARATUS AND METHOD FOR WINDLOCKING A BUILDING OPENING

This application is a continuation-in-part of application Ser. No. 09/520,845, filed Mar. 8, 2000. The invention is in the field of windlocking a building opening to prevent the intrusion of unwanted air, fluid (typically water or sea water) and debris. During hurricanes and other high wind velocity storms, the breach of a building opening can cause great damage to the structure. If the building structure is not breached, then substantial damage can be prevented.

FIELD OF THE INVENTION

BACKGROUND OF THE INVENTION

Many building codes are now requiring or will soon require hurricane shutters on all new homes built in coastal areas. Similar requirements for buildings other than homes are anticipated as well. The South Florida Building Code, 1994 Edition, requires that storm shutters shall be designed and constructed to insure a minimum of a one inch separation at maximum deflection with components and frames of components they are to protect unless the components and frame are designed to receive the load of storm shutters.

The determination of actual wind loading on building surfaces is complex and varies with wind direction, time, height above ground, building shape, terrain, surrounding structures, and other factors. The American Society For Testing And Materials (ASTM) has promulgated a Standard Test Method For Structural Performance of Exterior Windows, Curtain Walls, And Doors By Uniform Static Air Pressure Difference and its designation is E330-97 and was published April 1998. The test method requires that the person specifying the test translate anticipated wind velocities and durations into uniform static air pressure differences and durations. Durations are considered because most materials have strength or deflection characteristics which are time dependent. Testing under this method is performed in a test chamber which measures the pressure difference across the test specimen.

Similarly, ASTM has declared a Standard Test Method For Water Penetration Of Exterior Windows, Curtain Walls, And Doors By Uniform Static Air Pressure Difference which includes a water spraying apparatus within the test chamber. See, ASTM designation E331-96. Leakage rate testing can be done under the ASTM Standard Test Method For Determining The Rate Of Air Leakage Through Exterior Windows, Curtain Walls And Doors Under Specified Pressure Differences Across The Specimen. See, ASTM designation E283-91.

When a building envelope is breached devastating pressure differentials cause large amounts of damage. Kinetic energy due to the velocity of the fluid is proportional to the square of the velocity. Energy from the wind, therefore, pressurizes the interior of a home or other structure which in combination with the profile of the roof makes the roof, in effect, act like an airplane wing causing it to blow off the remaining structure. Windload and impact resistance requirements depend on the particular community promulgating the requirements.

The American Society of Civil Engineers' Standard 7 is being increasingly used by public regulators in formulating requirements. In some areas of high probability for high wind occurrences, such as hurricanes, existing homes are required to upgrade windows and doors or add shutters and other protective devices to building openings to protect them.

Conventional storm window protection as shown in U.S. Pat. No. 4,065,900 to Eggert, U.S. Pat. No. 4,069,641 to De Zutter and U.S. Pat. No. 4,478,268 to Palmer are methods of attaching outer coverings to window or door openings. U.S. Pat. No. 4,065,900 to Eggert discloses an apparatus for framing and fastening a secondary glazing pane which utilizes a hinge. U.S. Pat. No. 4,069,641 to De Zutter discloses a storm window frame which utilizes double-faced tape to mount the storm window frame and, hence, the storm window. U.S. Pat. No. 4,478,268 to Palmer discloses a hard flexible curtain door, a tensioned storage or wind-up drum, and channels in which the door resides. The door moves out of the channels under impact and is wound up to open for vehicle passage.

U.S. Pat. No. 4,126,174 to Moriarty, et al. discloses a tensioned flexible sheet storage roller, a guide roller and side seal guides. These coverings are normally clear flexible materials that must be installed and removed as needed or can be rolled and stored in a storage area above the window. These materials can be tinted to provide a reduction in sunlight transmission, but tinting would also reduce vision at night. These storm window coverings offer good thermal insulation, but offer minimal protection from high wind velocity pressures and wind borne debris. Further, these coverings are usually made of flexible polyvinyl chloride and will functionally deteriorate with time and must be replaced. The coverings that are of rolling construction must have adequate clearance between the guide rails and the sheet to prevent jamming of the sheet in the guide rails during opening and closing.

U.S. Pat. No. 4,294,302 to Ricke, Sr. discloses a security shutter and awning device for covering windows and doors. The device includes slats made from aluminum or other extrudable material of sufficient strength to protect against storms and/or vandalism. The shutter of Ricke, Sr. may be slidably mounted and pivoted so as to act as an awning.

U.S. Pat. No. 4,601,320 to Taylor discloses a pressure differential compensating flexible curtain with side edge sections which are sealingly engaged with channels. The first upper end of the curtain is attached to a curtain winding mechanism which includes a spring barrel. Taylor discloses an elastomeric curtain having plastic supports with rubber covers banded thereto. Alternatively the plastic supports may be high molecular weight plastic strips. The purpose behind the design of the supports is to minimize the friction of these supports enabling operation of the door/curtain with a high differential pressure across it.

U.S. Pat. No. 4,723,588 to Ruppel discloses a roller shutter slat which interlocks with the adjacent roller sheet slat. U.S. Pat. No. 5,657,805 to Magro discloses a wind-resistant overhead closure with windlocks on the lateral edge portions of the intermediate and bottommost slats of the closure. First means to limit the lateral movement of the lateral edge of the intermediate potions and second means to limit the lateral movement of the endmost door portion are disclosed. Intermediate slats and endmost slats are provided. The '805 patent indicates in col. 2, lines 12 et seq. that it conforms with the South Florida Building Code, 1994 Edition, previously referred to hereinabove. Further, the '805 patent states that its teachings are applicable to both doors and windows.

Windlocks can be added at the end of slats which will improve the resistance of multileaf shutters or doors to wind velocity pressures by transmitting the stresses on the continuous hinge area to the ends of the slat, to the guide system and finally to the jambs or building structure. In order for the windlocks to engage the guide track the slat must deflect a considerable amount. Normally clearance is allowed between the guide track and the windlock to keep the door from jamming during operation and the more clearance allowed the more deflection of the slats before the windlocks contact the guide track. Typically, these windlocks are larger in cross section than the slat profile and when the shutter or door deflects from high wind velocity pressures, the windlocks are designed to engage the same space in which the slats are guided. When storing a rolling multileaf shutter or door equipped with windlocks, additional room is needed because the depth of the windlock is larger than the slat profile, the diameter of the storage area increases dramatically. In these designs, clearance between the windlock and the track must be allowed to prevent the windlocks from jamming and care must be taken when operating shutters or doors in a wind because the windlocks will sometimes jam as the product deflects.

U.S. Pat. No. 5,445,902 to Lichy discloses a damage minimizing closure door somewhat similar to U.S. Pat. No. 4,478,268 to Palmer. The Lichy '209 patent discloses a flexible curtain and a guide for receiving and guiding the side edges of the flexible door during vertical movement. A counterbalancing power spring is associated with the door to assist in raising and lowering the curtain. Side edges of the curtain separate from the guide assembly upon being impacted by an externally applied force such as a vehicle.

U.S. Pat. No. 5,482,104 to Lichy discloses in FIG. 17 thereof, a flexible curtain and double windlocks which breakaway from the channel upon the application of excessive force to the curtain. See, col. 7, lines 33 et seq. U.S. Pat. No. 5,131,450 to Lichy discloses in FIG. 6 thereof a double edged guide and a curtain edge with two loose portions sewn to the transverse curtain. See, col. 6, lines 21, et seq. U.S. Pat. No. 5,232,408 to Brown discloses a flexible tape drive system wherein the tape is relatively rigid and it is driven by a toothed cog to provide both push and pull capabilities. U.S. Pat. No. 5,048,739 to Unoma, et al. illustrates a conical toothed drive paper feeder.

Conventional storm curtains without windlocks to engage into guides will pull out of the guides. This is especially true of wider curtains where they might be partially lowered for shading purposes without attaching storm bars required for storm protection. If, while lowering, or subsequent to lowering, wind forces exist that are significant but in no way threatening, the storm curtains typically escape from the guides due to excessive deflection of the slats. When this occurs, the slats become damaged as well as the facade surrounding the guide area becomes damaged as the ends of the slats typically rake the surrounding area in the process of escaping. The majority of applications for conventional storm curtains do not use windlocks. Rather than using windlocks, the problem of excessive curtain deflection which causes the curtain to escape from the guides is addressed with the use of storm bars. Storm bars, however, have disadvantages.

Storm bars create a passive system i.e. in the event of a severe storm they need to be taken out of storage and attached in predetermined locations across the span of the curtain. A wide curtain may require as many as three sets of storm bars. Sets consist of two bars in close proximity to each other in such a way as the curtain passes between the two bars. This addresses deflection that occurs in both positive and negative directions. Positive deflection is in the direction of the building and negative deflection is away from the building. At each storm bar location, brackets must first be attached to the floor, soffit and sills. Depending on the surrounding construction materials, secure locations are often difficult to find. After the brackets are attached to the building, the next step is to attach the storm bars to the brackets. Care must be taken to number and code the brackets to the matching storm bar, otherwise the pre-drilled holes for the bolts will not line up with the holes in the storm bars. Also, care must be taken to match and code the storm bars to their various locations since even a slight variation in the bar length causes the holes in the storm bar to misalign with the pre-drilled holes in the building facade. Also, these pre-drilled holes in the facade are permanent and cause problems aesthetically when the storm bar brackets are removed. Given the problems associated with escaping storm curtains, the building owner faces a dilemma when moderate storms are predicted such as severe summertime thunder storms. The daunting task of attaching the storm bars cannot be justified for every storm. Because the risk of damaging the storm curtains without attaching the storm bars is so great, the curtains are not utilized in moderate storms. Therefore, the building owner has a protection system that is either "on or off," "on" meaning storm bars and curtains and "off" meaning nothing at all.

Conventional storm curtains do not have windlocks to prevent the slats from escaping the guides because windlocks have a larger cross section than that of the slat and using windlocks increases storage coil diameter which is a major limiting factor. With windlocks of the related art, storm curtains have a tendency to bind in the guides/tracks when being lowered because of the deflection of the curtain in moderate wind conditions. Enough friction is created, windlock to the inside edge of the guide, to cause the curtain to become obstructed and create unwanted accumulation of slats in the coil storage area. Additionally, adding windlocks to the ends of slats is very labor intensive and creates many more parts to drill and attach.

The instant invention addresses these three issues. The first issue with conventional storm curtains, that being an increase in coil storage requirement, is addressed by utilizing an interrupt formed on the ends of the tension rods of the instant invention which does not increase the requirement for coil storage when the curtain is stored.

The second issue regarding binding of the curtain is addressed by the instant invention since the tracks are mounted at a divergent angle with respect to each other and contact with the interrupts in the rod and the "J-shaped" channel does not occur until the guide is in a fully closed position minimizing friction. Further, in the instant invention, unwanted accumulation in the coil storage area does not occur and the drive system is able to generate downward closing forces that overcome minimal friction that may occur between the interrupt and the "J-shaped" channel.

Finally, regarding the issue of windlocks being labor intensive, the interrupts formed near the ends of the rods in the instant invention are made with a single stroke of a press after the rods are inserted into the curtain and, as such, do not make the windlock system labor intensive.

SUMMARY OF THE INVENTION

The instant invention uses light weight materials that have stiffness in the direction of the opening and closing but will bend around a radius as small as 0.5 inches. This strengthens the curtain by uniformly spreading the stresses developed by wind velocity pressure or impact over the width of the curtain and transferring the stresses to the track and to the structure of the building.

The invention adds tension to the elements of the curtain in the direction along its width or perpendicular to the force that is created by wind velocity pressure or impact from debris. The tension is directly proportional to the wind velocity pressure or impact from debris. Angled guide tracks may be used that tension the curtain when the curtain is closed without jamming the curtain in the guide tracks. Metallic, non-metallic materials (or a combination of both) may be used and they may be and can be opaque or transparent.

The windlock feature of the instant invention is incorporated into the curtain without affecting the thickness of the curtain and therefore does not affect the size of the storage area. The mass of the curtain is low allowing precise control of raising and lowering the curtain with a small power source and can be battery powered. Materials such as aramid fibers may be used thus making the curtain bullet proof An apparatus and method for windlocking a curtain covering and protecting an opening in a building is disclosed and claimed. The windlocking curtain resides to the exterior of the window, door or other opening and protects it from the intrusion of air, water or debris. In its upper position the windlocking curtain permits normal use of the opening and in its lower position it secures the opening. A flexible corrugated curtain has tension rods therethrough and the tension rods run in tracks on each side of the curtain and necessarily on each side of the opening. Interengagement of the tension rods with the tracks is accomplished by deformations in the rods that are referred to as interrupts. In one embodiment the rods are successively longer from top to bottom of the curtain and their interrupts matingly wedge with angled tracks to secure the curtain. In another embodiment the interrupts matingly engage parallel tracks upon the application of force due to wind, fluid (usually water or sea water) or debris. In another embodiment tension rods and interrupts are not used or necessary and a flap on the edges of a three-ply flexible curtain engage the interior of the side tracks absorbing shocking and sealing the opening. A method for securing the opening utilizing the apparatus is also claimed which provides top, bottom and side securement.

The flexible curtain comprises part of a curtain system for covering an opening in a building. A frame is affixed to an opening in a building. A flexible, corrugated curtain has a plurality of rods extending through some of the corrugations of the curtain. Preferably the rods, sometimes referred to as the tension rods, are rectangular in cross-section so as to provide maximum strength of the rod. Other cross-sectional sizes may be used. Angled tracks are provided in one embodiment which mate and wedge with angled interrupts when the curtain is in its second, closed position. When the curtain is open, it is in its first position and resides primarily on a counterbalanced windup reel. Each successive tension rod is longer than the prior rod so as to engagingly wedge with the angled tracks. The tracks are angled away from each other when the top point of the tracks are taken as the reference points. In other words, the tracks are at a divergent angle and get farther apart at the bottom.

The tension rods include a deformed portion sometimes referred to as an interrupt. The purpose of the interrupt is to matingly engage the tracks. In the embodiment which employs tracks which diverge from the top to bottom, the preferred divergent angle is one-half of one degree. Specifically, each track is diverging with respect to an imaginary vertical line at an angle of one-half degree making the total divergence for two tracks equal to one degree. One-half to one degree divergence from vertical per track (one to two degree divergence for both tracks) has been found to work well. Larger divergence angles require necessarily deeper tracks and larger interrupts particularly if a long building opening is to be protected. Those skilled in the art will readily realize from reading this disclosure that other angles may be used depending on the size of the opening to be covered.

Corrugated flexible curtain is used in one embodiment as stated above and slits therein may be employed in the face of the curtain to improve the flexibility for storing on the counterbalanced wind-up reel. In regard to storage of the curtain and tensioning rods, the deformations of the tensioning rods (interrupts) do not increase the space required for storage because the thickness of the tension rod is not increased in the direction of the radii of the wind-up reel.

Operation of the flexible curtain is enhanced by using divergently separating track as the occurrence of jamming is minimized. All of the tension rods are designed to engage the angled tracks at approximately the same time creating a wedge effect since the interrupts are deformed at a mating angle which matches the angle of the track.

Another embodiment of the invention employs parallel tracks and the tension rods do not engage the tracks except during times when they are loaded. In this embodiment the tension rods are all the same length and when the curtain is closed in its second position the lips of the interrupt do not engage the track. When the wind velocity becomes sufficiently high, the curtain deflects and pulls the mating surfaces of the interrupts into engagement with the track.

Another embodiment of the invention employs tension rods having a ninety degree radius at the ends thereof and eliminates the need for interrupts. It is the ninety degree radius which engages the angled/parallel tracks.

Rectangular apertures exist in the flexible corrugated curtain for engagement with teeth of a driving gear or gears. The gears, under resistance of a counterbalance spring affixed to the wind-up rod, drive the curtain from a first, open position to a second, closed position. All embodiments disclose rectangular curtains. Standard window dimensions are 30 to 36 inches wide and 30, 38 or 54 inches long. However, longer and wider openings can be secured with the embodiments of the invention disclosed herein. Corrugated curtains can be driven with a single gear or with dual gears. Openings in buildings of all sizes may be protected using the principles of the invention.

Alternatively, a driven adapter rack and/or an adapter rack and a gear may be simultaneously used to drive the tension rods.

Another embodiment employs a flexible curtain comprising three-plies laminated together. The plies may be laminated together under the influence of heat and pressure. Additionally adhesive may be used to secure the plies together. Two outer plies or sheets are polymeric and the inner ply is woven. A living seal is formed on the edges of the curtain by folding the edges of the curtain back on the curtain itself. The folded portion is secured by stitching with thread, or by adhesive, or by heat fusing, or by ultrasonic welding. Only a portion of the folded flap is secured. Preferably two-thirds (⅔) of the folded flap is secured to itself and one-third (⅓) remains free. When the three-ply curtain is tensioned under the influence of wind or debris loading, for instance, the folded portion engages the interior of the track which houses the folded portion preventing its escape therefrom. Further, the folded flap provides a total seal which is sometimes referred to herein as a living seal. The free portion of the flap provides a shock absorber which cushions the frame against time variant forces which may be applied due to fluctuating wind and/or debris. The three ply curtain may also be used with angled track by slitting the outer face of the three ply curtain. The slitting provides a loose flap which engages the track.

Cylindrical apertures reside in the folded portion of said three-ply curtain and the drive cog interengages the apertures for raising and lowering the curtain against the force of the counterbalance spring. Preferably, there is a folded portion on each side of the curtain residing in its respective track and being driven by its respective drive cog. Conically shaped cogs fit the apertures well and, additionally, the apertures may be fitted with eyelets. A bowed bottom bar is secured within a folded portion of the curtain and guides the curtain into a slot. In other words, the curtain is slightly longer at its edges than in the middle such that as the curtain is coming down for securement in the second, closed position the sides enter the retaining slot first. If the curtain is being closed during a strong wind event, the middle of the curtain may be deflected slightly inwardly but the side portions are not because they are within the tracks which are directly aligned with (above) the retaining slot. This enables the bottom bar to begin seating in the retaining slot at the side edges and guide the bottom bar into place. Additionally, the weight of the bar assists in positioning it in place in the retaining slot. Additionally, a living seal formed by a flap extending from the stitched or heat sealed bottom bar may be employed in a modified retaining slot sometimes referred to herein as a storage slot.

Another embodiment of the bottom bar interengages a sill or bottom member having a seal therein. The bottom bar may be affixed to the bottom of the curtain by any one of several known fastening devices such as rivets, bolts and threads, and the like. The curtain system covers a window, door or other opening a building. The curtain system may reside to the exterior of the window, door or other opening or it may reside to the interior of the window, door or other opening.

Accordingly, it is an object of the present invention to provide a low cost and light weight flexible curtain which develops transverse (side to side when viewed from the front) tension each time the curtain closes.

It is a further object of the present invention to provide a curtain system which uses a light weight counterbalance because of the lightweight construction of the curtain.

It is a further object to provide a curtain having windload and impact resistance which is always active when the curtain is closed and requires no other action by the user in the event of a high velocity wind occurrence.

It is a further object to provide a curtain which will not jam and cause damage to the curtain during operation even if operated during high wind occurrences.

It is further object to provide a storm curtain which stores within standard wall thickness found in the United States. It can be incorporated into the window frame in such a way that the storm curtain does not require additional framework or cover for protuberances created by the larger storage coil diameters typical of conventional storm curtains.

It is a further object of the present invention to provide a curtain system which resides to the exterior or the interior of the window, door or other opening in a building.

It is a further object to provide a low maintenance storm curtain. Conventional storm curtains require periodic high pressure washing especially along coastal areas where they are exposed to salt spray and blowing sand. Conventional storm curtains are designed so that the longitudinal edges of the slats telescope into each other approximately three-eighths inch (⅜") to one-half inch (½") as shown in U.S. Pat. No. 4,173,247 to Prana and U.S. Pat. No. 5,322,108 to Hoffman. The telescoping portion of the slat is exposed when the storm curtain is partially closed, typically for sun control, and because of the weight of the slat suspended below, the slats will be extended from each other. When salt spray and sand accumulate on this portion of the surface of the slat, abrasion and friction will interfere with slat to slat telescoping. If the slats are not cleaned and pressure washed periodically, the lower slats usually start to malfunction first since they have the least gravitational force to cause separation. If this separation or telescoping does not occur and the slats enter the coil storage area they will be put into a severe bind and as a consequence, become damaged. Telescoping slats develop more beam strength when the longitudinal edges of the slats are telescoped into each other when fully closed. However, the maximum allowable radius requirement for the curtain to coil within the allocated storage area cannot be met unless the slat edges are fully extended from each other as they begin to articulate into the coil storage position. In the instant invention, the outside surface consists of a smooth polymeric material with no requirement to telescope. As such, there is no opportunity for salt spray and sand to accumulate in irregular surfaces. It is a further object of this invention to provide a smaller storage area.

Another advantage of the instant invention, unlike conventional storm curtains, is that the instant invention becomes taut from top to bottom when in a closed position. For this reason there is no chatter, banging or rattling that exists with conventional storm curtains in buffeting winds. Further, when the embodiment of the living seal is employed, the loose or free portion of the folded flap or strip absorbs shock and therefore does not transmit it to the surrounding frame. This will make a quieter system with low or no maintenance.

Still another advantage of the instant invention is that the storm curtain is directly linked to drive gears and a drive shaft which are engaged into perforations pierced into the curtain and essentially (but not actually) place the gear teeth in contact with the metal tension rods lodged in the corrugated curtain which, when activated, cause the curtain to be raised and lowered. The tension rods are completely sealed with respect to contamination by the corrugated material. In the embodiment of the three ply curtain, it completely seals against the intrusion of wind borne salt and debris. Another advantage of the instant invention is that the storm curtain can be pre-installed into the window frame at the factory as a single unit. The sub-contractor normally involved in the installation of storm curtains is no longer required. Another problem frequently encountered and avoided with the instant invention is related to the typically varied conditions prevalent on job sites. With a wide range of window configurations depending on the manufacturer and varied contractor preferred framing methods and sill details, these variations often complicate the installation of storm curtains. This can greatly increase the cost of installation where additional re-framing may be required or where other modifications need to be made so the storm curtain can be installed correctly. In the instant invention, the storm curtain is pre-installed into the window framework and these problems do not exist.

Another advantage of the instant invention is that since the interrupts pressed (deformed) into the metal rods embedded in the curtain are engaged into the "J-shaped" track, the curtain cannot escape or "blow out".

BRIEF DESCRIPTION OF THE DRAWINGS

FIG. 11 illustrates a cross-sectional view of the top of the track which has a one degree (1°) runout. The runout, however, is not illustrated in this drawing.

FIG. 9A illustrates a cross-sectional view of the top of the track which has a one-half degree (½°) runout. The runout, however, is not illustrated in this drawing.

FIG. 12 illustrates a cross-sectional view of the top of the track which has a one degree (1°) runout. The runout, however, is not illustrated in this drawing.

FIG. 12B illustrates a cross-sectional view of the top of the track which has a one-half degree (½°) runout. The runout, however, is not illustrated in this drawing.

Figure 1:
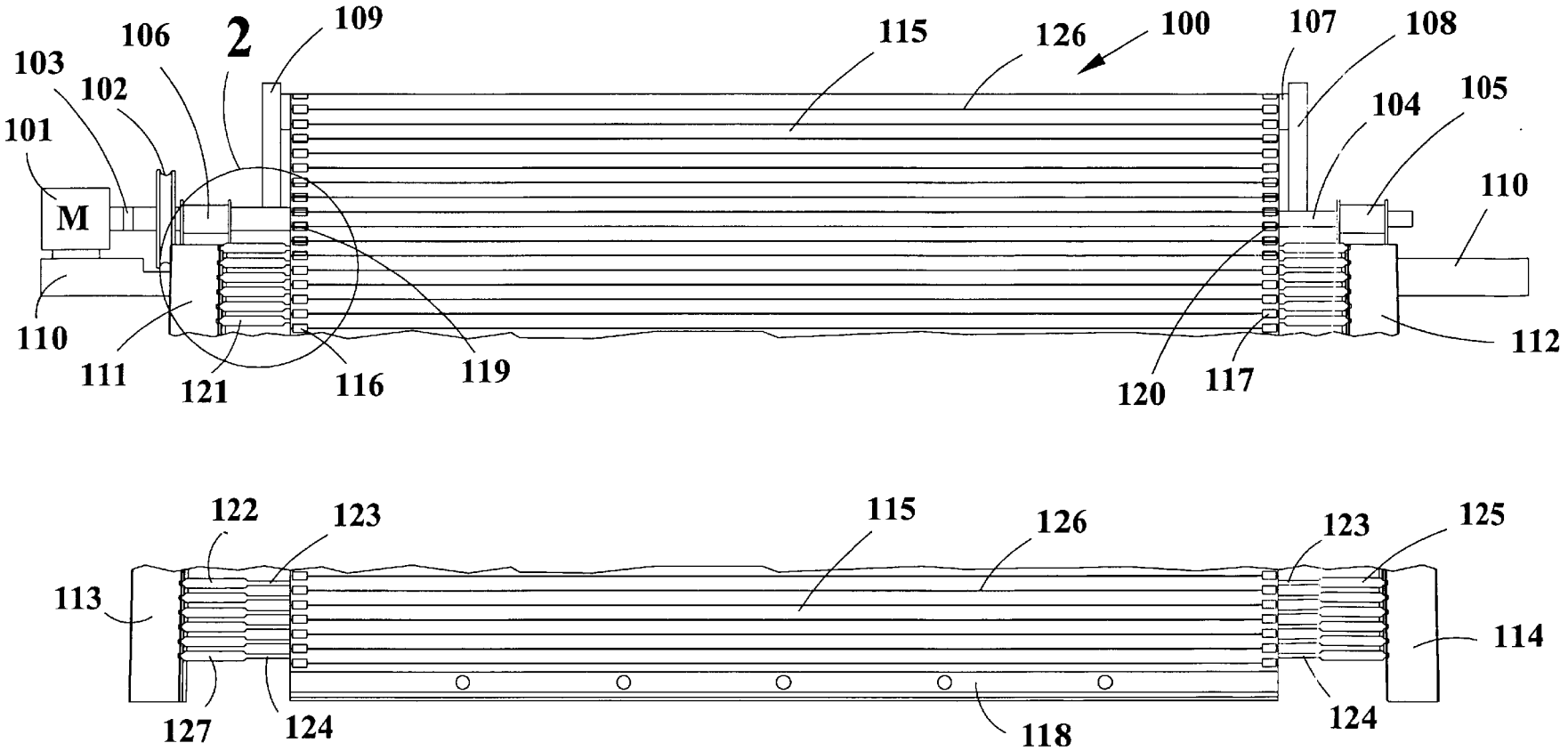
FIG. 1 is a front plan view of a seventy-two inch flexible curtain having a track at one degree (1°) from vertical.

A better understanding of the drawings will be had when taken together with the description of the invention and the claims which follow hereinbelow.

DESCRIPTION OF THE INVENTION

The first embodiment is the combination of a curtain composed of corrugated nonmetallic material with metallic rods embedded in the corrugations. Inward from the ends of the metallic rods, also known as the tension rods, interrupts are formed which maintain the cross-sectional area of the rod. This provides for uniform tensile strength of the rod. The rod lengths uniformly increase from rod to rod from the top of the curtain toward the bottom of the curtain. The ends of the rods form an angle with respect to the corrugated nonmetallic material of the curtain. The interrupts in the rods have a matching or corresponding angle to the angle of the tracks. This angle allows the curtain assembly to wedge when the curtain is closed. The tracks have a "J-shaped" portion with one leg angled back from the mouth of the "J" to form a mating interrupt with the interrupt on the rod such that as tension is developed in the rod due to wind velocity pressure or windborne debris, the "J" will close on the rod with a clamping action transferring the stress load to the tracks and then to the opening frame and onto the building structure. The curtain is additionally supported by a counterbalance drive tube that will assist in returning the curtain to a rolled up stored position.

The nonmetallic portion of the curtain can also be made from sheets of material laminated together capturing and positioning the metallic rod. These sheets can be fused, glued, stitched, or attached by other fastening means to prevent the rotation of the rod in relationship to the curtain. The metallic rods preferred in this curtain can be round or polygonal in shape. The more polygonal, the more retention needed to hold the rod in position. Conversely, the less polygonal or the fewer number of sides in the polygon, then less retention is required.

A version of this embodiment can be used on conventional rolling door systems where the slats are cut in uniformly, progressively longer lengths from the top of the door to the bottom of the door with standard windlocks alternately attached to the slat ends and the guide track deepened to the longest slat and set at a matching angle where the slats are uniformly placed in tension when the door is closed.

The second embodiment ("parallel" embodiment) is a combination of a curtain composed of corrugated nonmetallic material with metallic rods embedded in the corrugations. Inward from the ends of the metallic rods, interrupts are formed in the tension rods which maintain the cross-sectional area for uniform tensile strength of the rod. Rod length is uniform from rod to rod, from the top of the curtain toward the bottom of the curtain, so that the ends of the rods are aligned parallel to the corrugated nonmetallic material of the curtain. A guide track system is employed that has vertical guide tracks that are parallel to the edge of the curtain. The guide tracks have a "J-shaped" end portion with one leg angled back from the mouth of the "J" to form a mating interrupt with the tension rods such that as tension is developed in the rod, the "J" will close on the rod with a clamping action. The curtain is supported by a counterbalanced drive tube that will assist in returning the curtain to a rolled up position. Further, the curtain is taut between the drive tube and the wind-up reel. The profile of the corrugated nonmetallic material is such that the front and back faces are in continuous contact allowing the curtain to be driven down without jamming or binding. The stored portion of the curtain has a tensioning device (i.e., a counterbalanced spring) to prevent the curtain from resisting movement as the diameter of the stored curtain reduces.

A third embodiment employs a flexible curtain comprising three plies laminated together. These plies can be fused, glued, stitched or attached by other fastening methods. Two outer plies or sheets are polymeric. The inner ply is woven. A living seal is formed on the edges of the curtain by folding the edges of the curtain back on the curtain itself. The folded portion is secured by stitching with thread, by adhesive, or by heat fusing or by ultrasonic welding. Only a portion of the folded flap is secured, preferably two-thirds (⅔) of the folded flap is secured to itself and one-third (⅓) remains free. Under tension, this free portion of the folded flap seals and cushions the shock caused by the wind or airborne debris. Under the tension the free portion of the flap engages the guide track. The three ply flexible curtain is driven by a cog wheel having conically shaped cogs which drive apertures located along the edges of the flexible curtain of this embodiment.

Another version of this invention is a curtain employing a flat sheet of flexible material. It has grooves cut into one face that serve as an interrupt to a mating edge of the "J-shaped" track or of a track having another shape. Inward from the edges of the sheet, grooves at the same angle as track are cut into the curtain such that the grooves at the top of the curtain are closer together than they are at the bottom of the curtain. The guide tracks are then placed at the same angle to place the curtain in tension when the curtain is in the closed position. The grooves create a loose flap which engages the track when the curtain is all the way down in its second position.

FIG. 1 is a front plan view of a 72" flexible curtain having tracks which are 1° from vertical. The entire curtain is not depicted in FIG. 1 because resolution would decrease. Put another way, the tracks are at a 1° angle from the edges of the corrugated curtain. Reference numeral 100 indicates generally the 72" flexible curtain. The curtain may be driven by motor 101 or by a pulley 102 as determined by a coupling 103 which may engage either the motor or the pulley as a source of energy for raising and lowering curtain 115. Curtain 115 is a rectangular corrugated nonmetallic curtain. Apertures 116 reside in the left-hand portion of the corrugated curtain and apertures 117 reside in the right-side portion of the corrugated curtain 115.

Left-side track 111 is affixed to the frame or building structure as is right-side track 112. Reference numeral 113 is spaced leftwardly of track 111 and reference numeral 113 denotes the bottom portion of the left-side track 111. Reference numeral 114 illustrates the bottom portion of the right-side track 112 and it too indicates a runout rightwardly with respect to the right side track 112.

It will be noticed that FIG. 1 depicts the first several tension rods and interrupts and the last several tension rods and interrupts. Interrupt 121 is near the top of the curtain. Interrupts 122 and 127 are near the bottom left side of the curtain. Tension rods 123 and 124 are shown entering the left side of the curtain traversing through the curtain in corrugated sections thereof and extending rightwardly through the curtain. It will be observed that tension rod 123 has a left side interrupt 122 and a right side interrupt 125. A plurality of slits 126 are indicated in FIG. 1 to enhance the flexibility of the curtain. Gears 119 and 120 are viewed in FIG. 1 for driving apertures 116 and 117 in the flexible curtain 115. A front view of bottom bar 118 which engages a sill/receptacle not shown in FIG. 1 is illustrated therein.

Referring still to FIG. 1, shaft 104 is supported by bearings 105 and 106. Curtain 115 extends onto windup reel 107 which is a counterbalanced windup reel. Supports 108 and 109 support the windup reel 107. Platform 110 which is interconnected to the opening in the building supports the structure generally.

Figure 2:
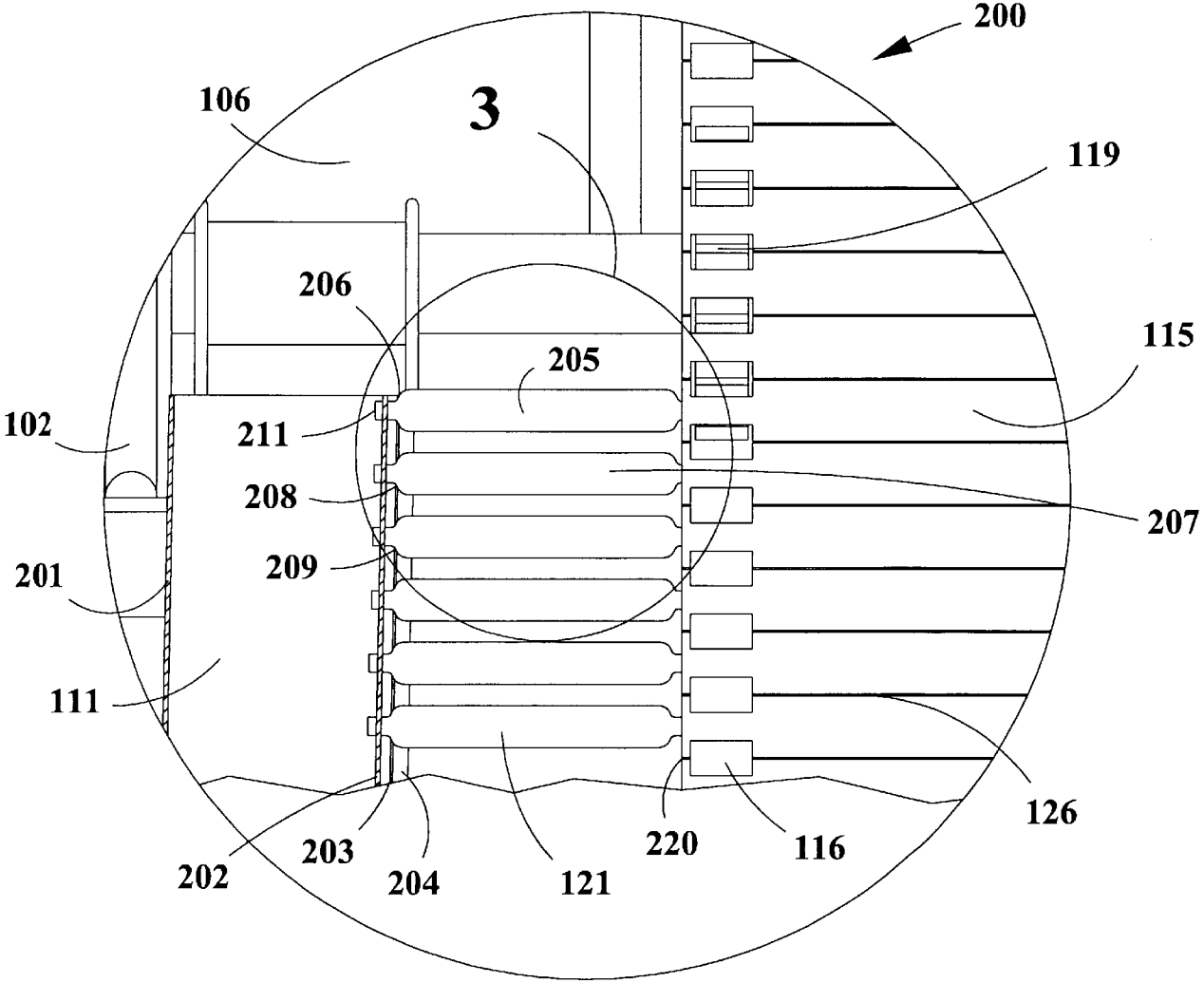
FIG. 2 is an exploded view of a portion of FIG. 1.
Figure 3:
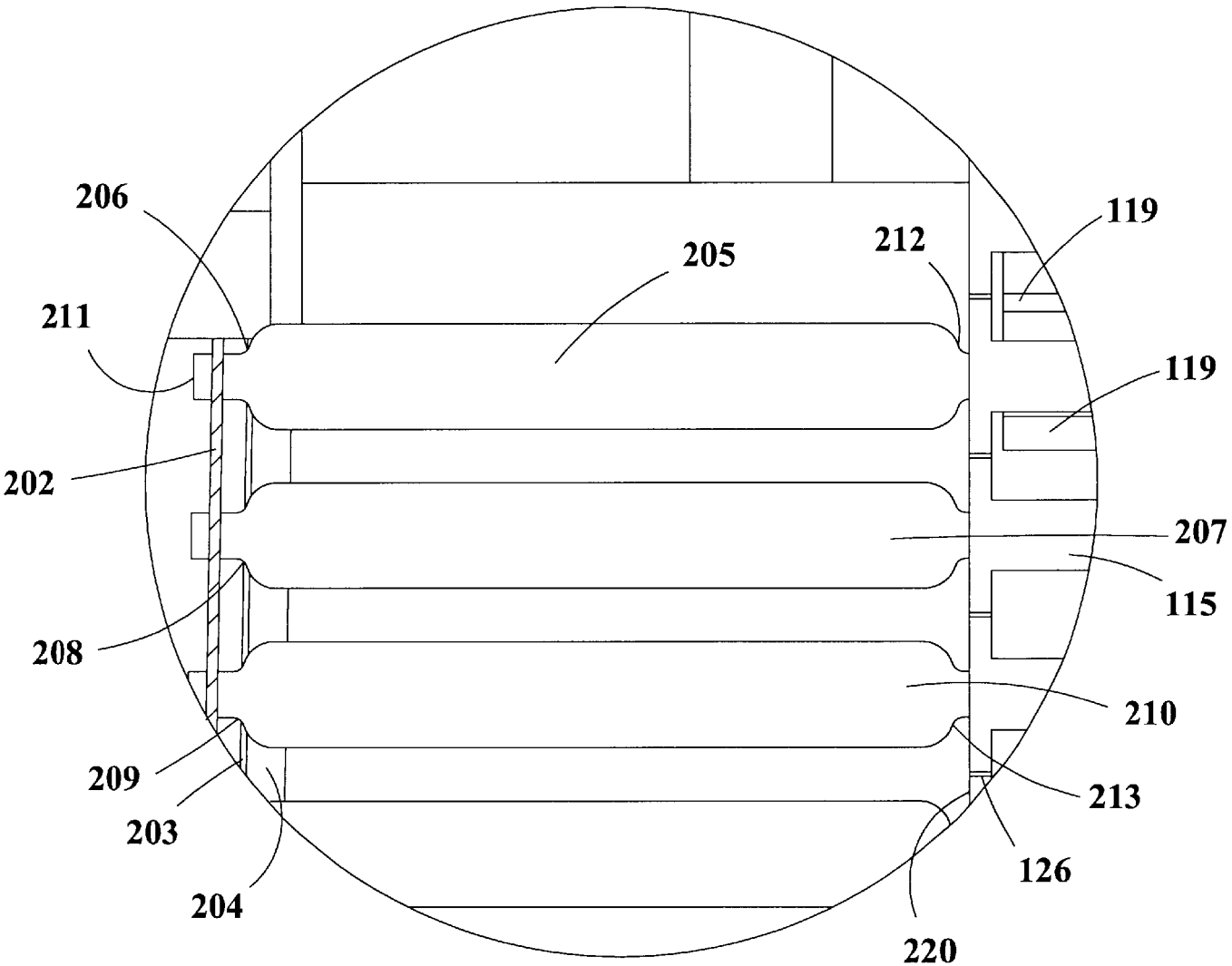
FIG. 3 is an exploded view of a portion of FIG. 2.

FIG. 2 is an exploded view of a portion of FIG. 1. Referring to FIG. 2, reference numeral 200 generally represents the enlarged portion of FIG. 1. Track 111 is shown in a cross-sectional view. The outer edge 201 and the intermediate support 202 of track 111 are shown. Mating surface 203 of the "J-shaped" portion 204 of track 111 are also shown. Mating surface 203 on the "J-shaped" portion 204 of track 111 are shown in better detail in FIG. 3. FIG. 3 is an exploded view of a portion of FIG. 2.

Figure 5:
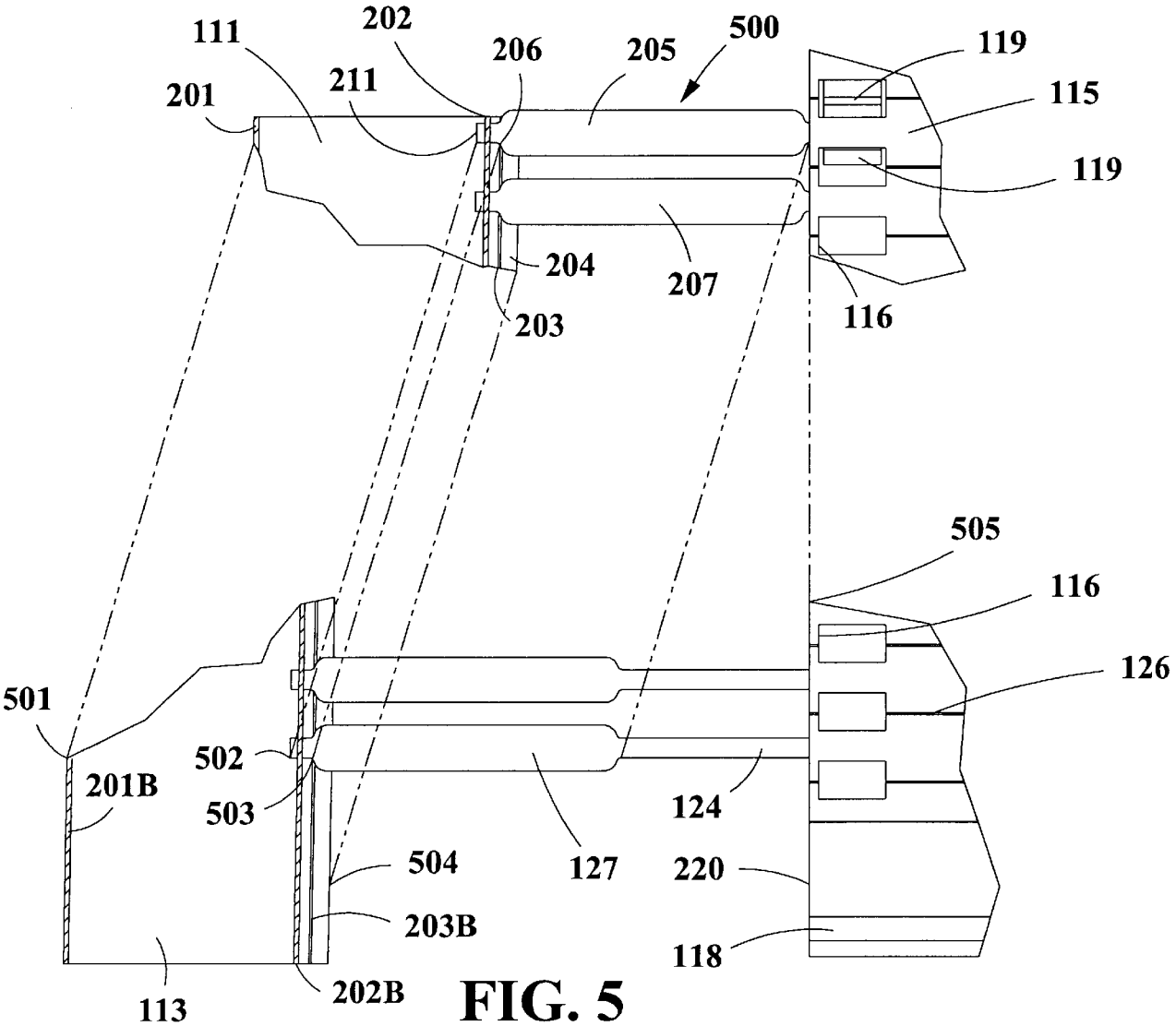
FIG. 5 is a schematic view of the seventy-two (72") inch curtain illustrating a one degree (1°) runout of the tracks and tension rods.

First interrupt 205 is illustrated in FIGS. 2 and 3 and mating point 206 is also illustrated in both figures. Referring to FIG. 3, interrupt 205 includes a surface which engages the mating surface 203 of track 111. It must be kept in mind that track 111 is angling downwardly and leftward when viewing FIGS. 2 and 3 such that the track and the interrupts are angled at a 1° angle with respect to the left side portion of the left side 220 of the curtain 115. The second interrupt 207 is illustrated with mating surface 208 which engages mating surface 203 on the "J-shaped" portion 204 of track 111. Similarly mating surface 209 of interrupt 210 engages mating surface 203 of track 111. Reference numeral 211 indicates the end of interrupt 205. Referring to FIG. 3, reference numeral 212 indicates the beginning of the interrupt of the first tension rod near curtain 115. Similarly the runout of the rods and interrupts can be viewed when reference is made to reference numeral 213 which is the beginning of the interrupt of the third tension rod of the curtain. Reference numeral 213 "points" to a place further leftwardly. The 1° runout of the track, interrupts and the ends of the rods are illustrated in FIG. 5.

Figure 4:
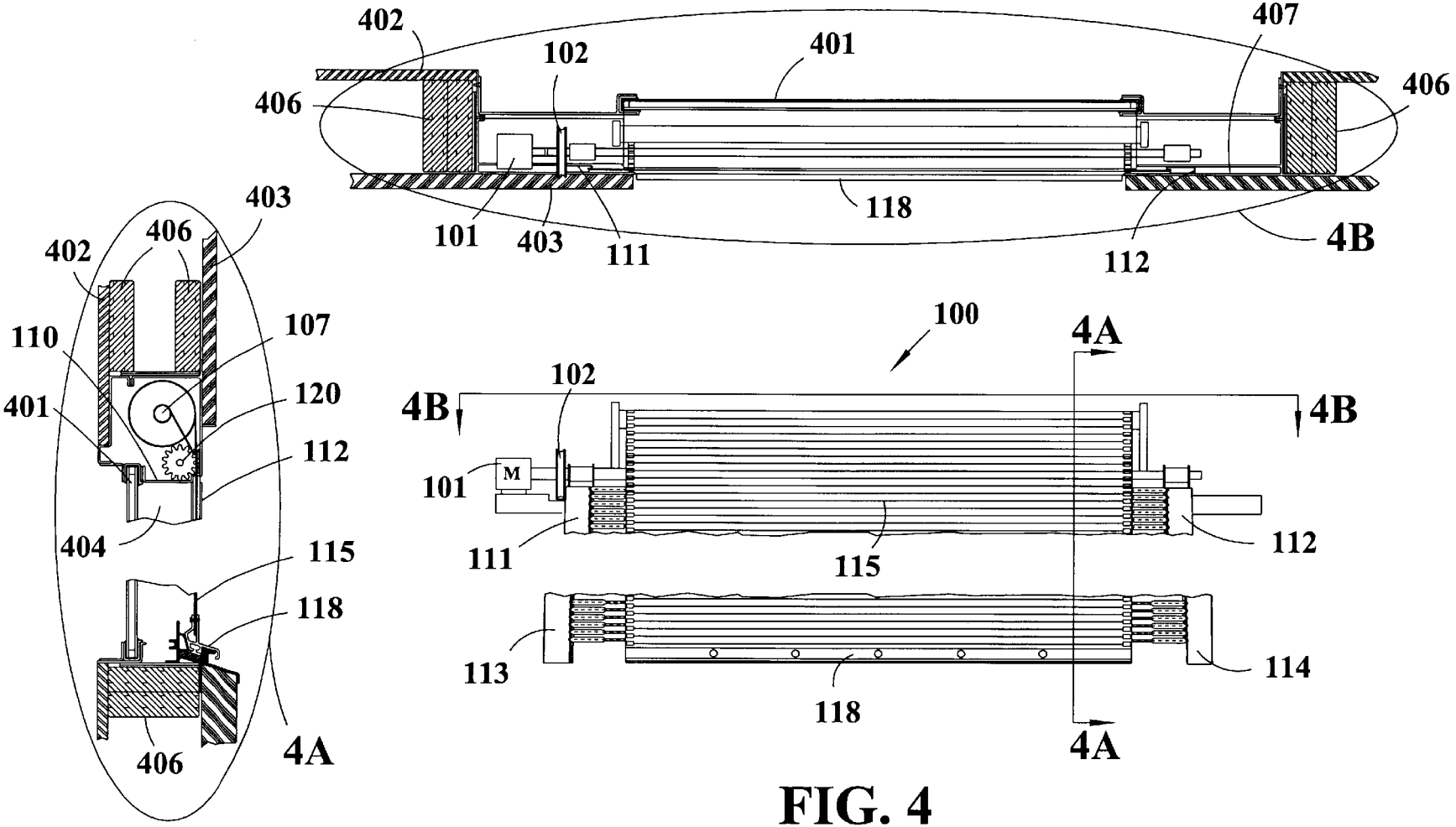
FIG. 4 is a composite view illustrating a reduced scale view of FIG. 1 together with reduced scale views of FIGS. 4A and 4B.
Figure 4A:
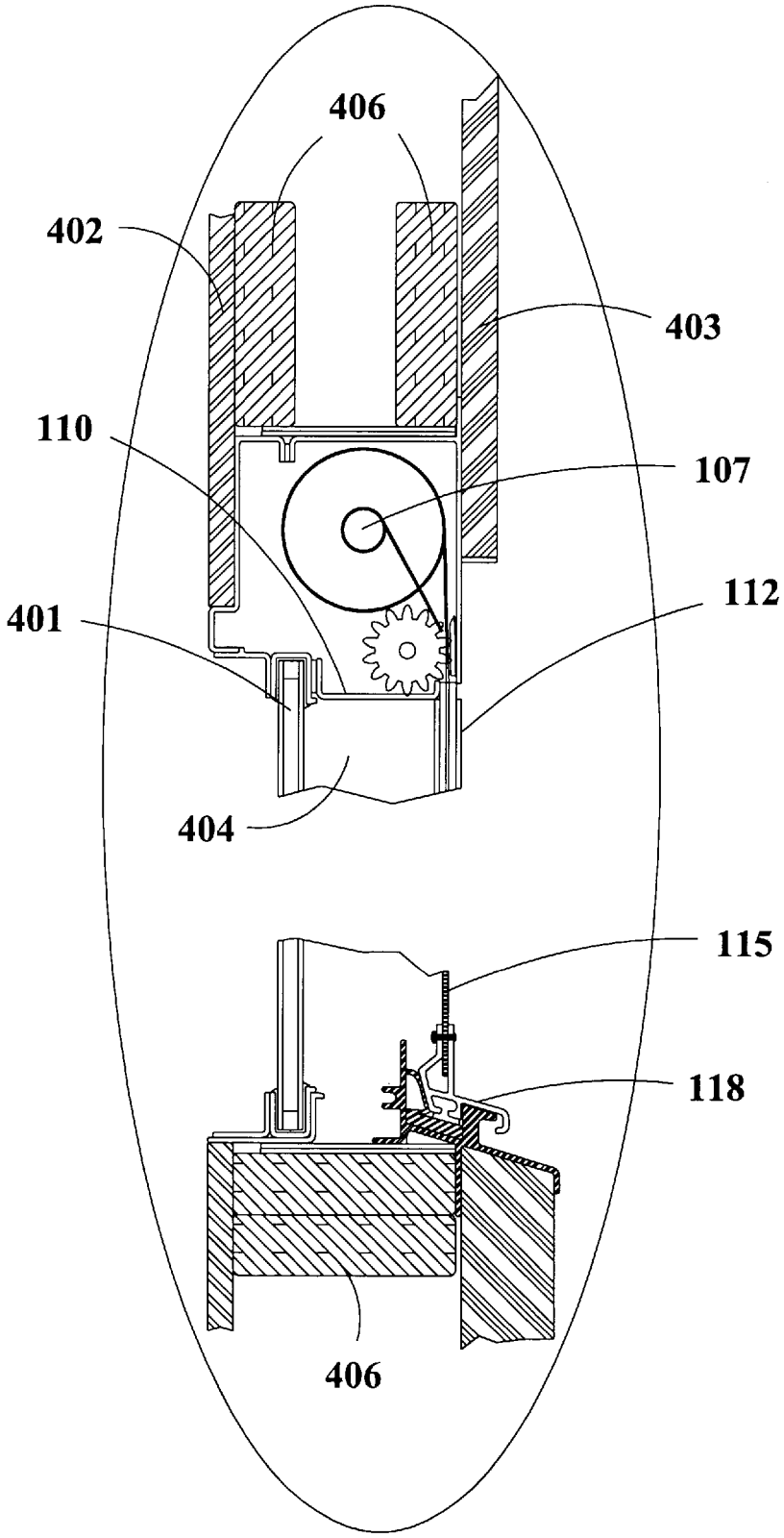
FIG. 4A is a cross-sectional view of the flexible curtain illustrated in FIG. 1 taken along the lines 4A—4A.
Figure 4B:
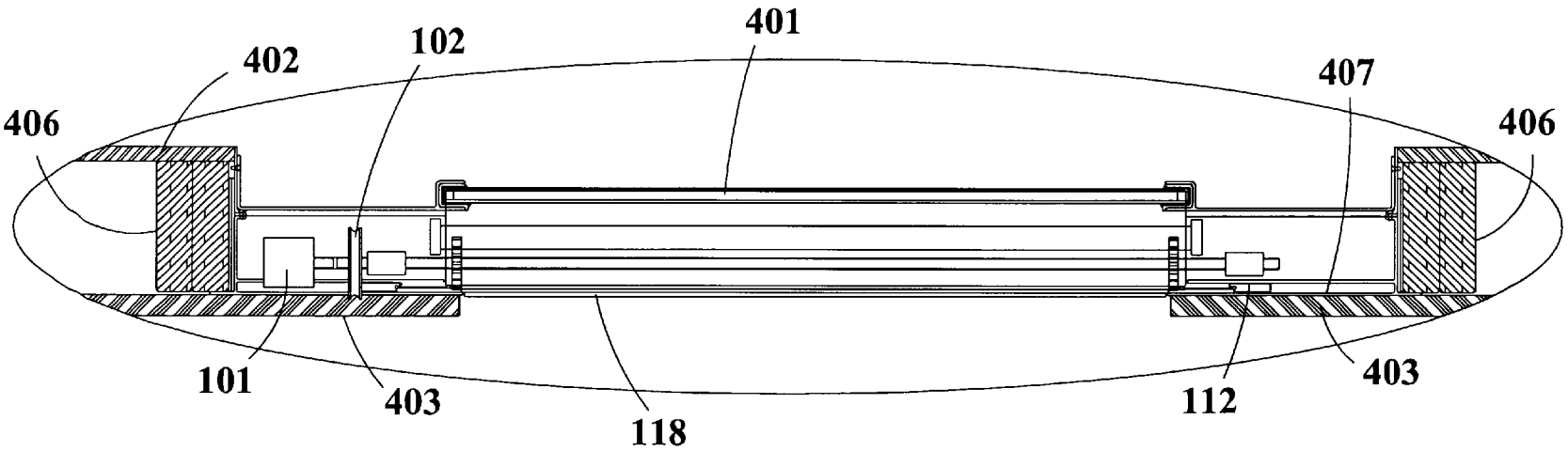
FIG. 4B is a cross-sectional view of the flexible curtain and window illustrated in FIG. 1 taken along the lines 4B—4B.
Figure 4C:
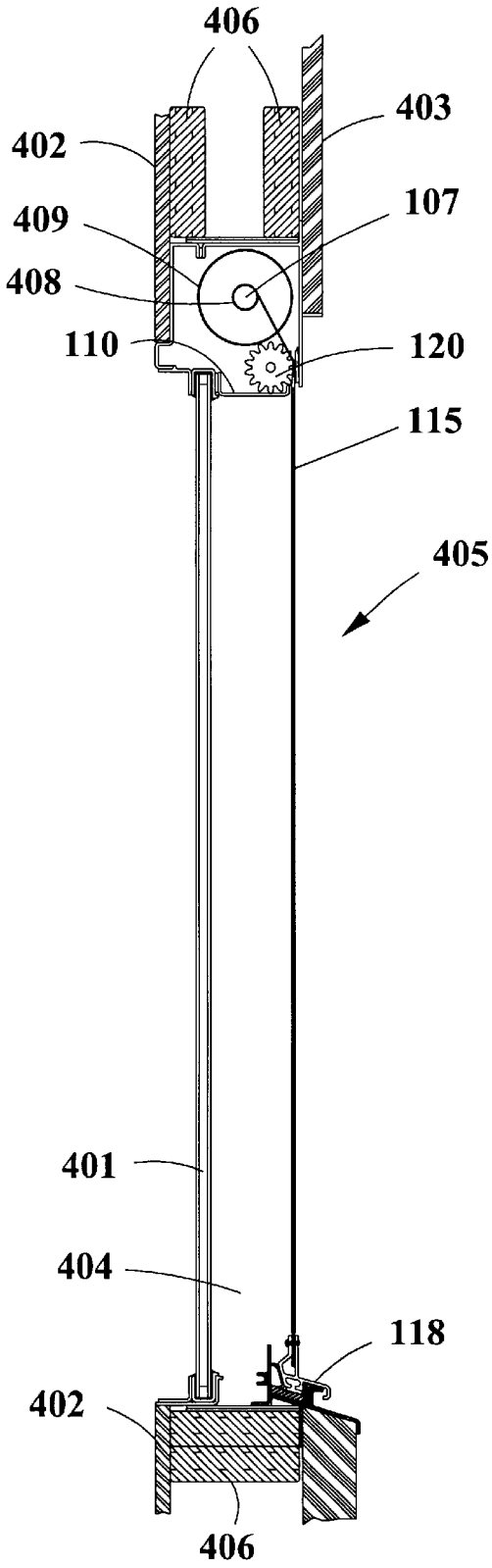
FIG. 4C is an enlarged cross-sectional view of FIG. 4A illustrating the application of the invention to protect a window opening.

FIG. 4 is a composite view illustrating a reduced scale view of FIG. 1 together with reduced scale views of FIGS. 4A and 4B. FIG. 4A is a cross-sectional view of the flexible curtain illustrated in FIG. 1 taken along the lines 4A—4A. FIG. 4B is a cross-sectional view of the flexible curtain illustrated in FIG. 1 taken along the lines 4B—4B. Support frame 407 is interconnected to the frame of the building opening. FIG. 4 illustrates the environment of the invention. FIG. 4A illustrates window 401 along with interior wall 402 and an exterior sheathing 403 such as plywood. A space 404 between the window 401 and curtain 115 is illustrated. FIG. 4C is a full cross-sectional view of FIG. 4A illustrating the application of the invention to protect a window opening. Referring to FIG. 4C, reference numeral 405 represents a full sized 38" window taken along the lines 4A—4A without track 112 shown. Reference numeral 406 generally indicates wood framing. Still referring to FIG. 4C, windup reel 107 is indicated and the curtain is shown in both a minimum position indicated by reference numeral 408 (i.e., the curtain in its down, second position) and a maximum position as represented by reference numeral 409 (i.e., the curtain in its up, first position). Reference numeral 404 indicates the space between the curtain 115 and the window to be protected 401. The curtain may be a flexible three ply curtain or it may be corrugated. Some regulatory authorities have promulgated a standard such that the curtain may not deflect within 1" of the glass 401 under hurricane strength winds.

Figure 34:
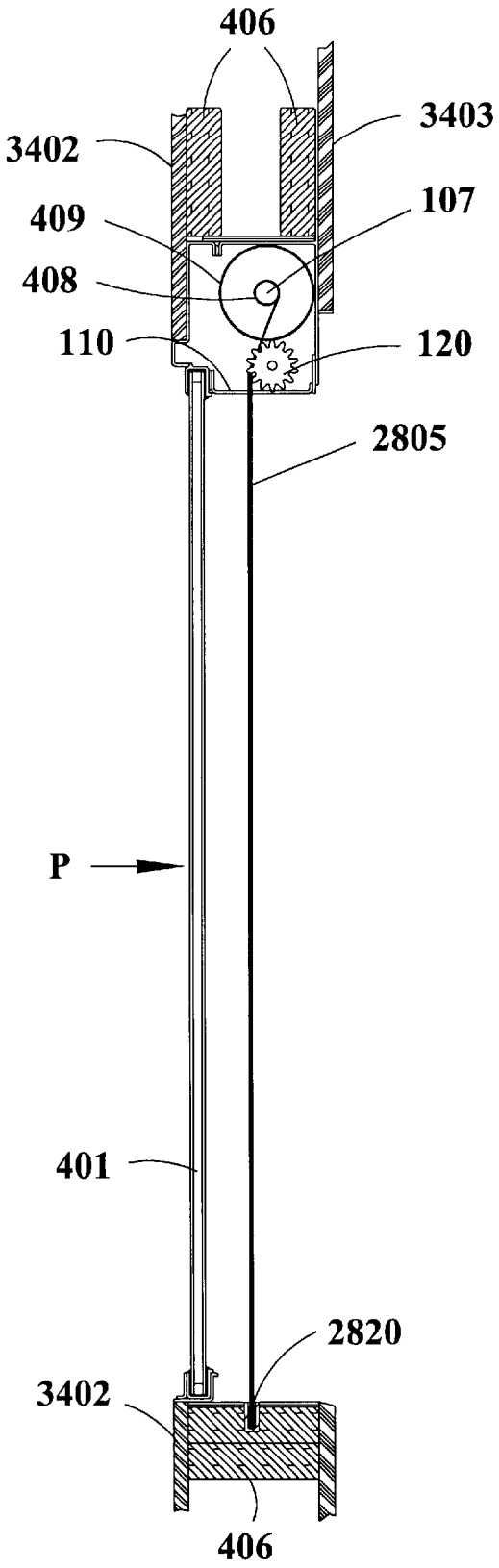
FIG. 34 is another embodiment of the invention illustrating pressure from the wind applied to the glass window which resides exteriorly to the flexible curtain.

In FIG. 4C, the wind pressure and/or debris is coming from the rightward side of the drawing figure and is headed leftwardly. In FIG. 4C, the curtain resides exteriorly of the window, door or other building opening. In FIG. 34, the wind, debris and pressure "P" is illustrated as coming from the leftward side of the drawing figure and is headed rightwardly. In FIG. 34, a flexible three ply curtain 2805 is depicted. A single ply or double ply curtain may also be used. In FIG. 34, the curtain 2805 resides interiorly to the window, door or other building opening. In the embodiment of FIG. 34, the window 401 would be smashed by debris in a hurricane, but the building would still be protected. Reference numeral 3402 represents the exterior wall and reference numeral 3403 represents the interior wall in FIG. 34. Slot 2820 restrains the curtain 2805 at the bottom.

Figure 4D:
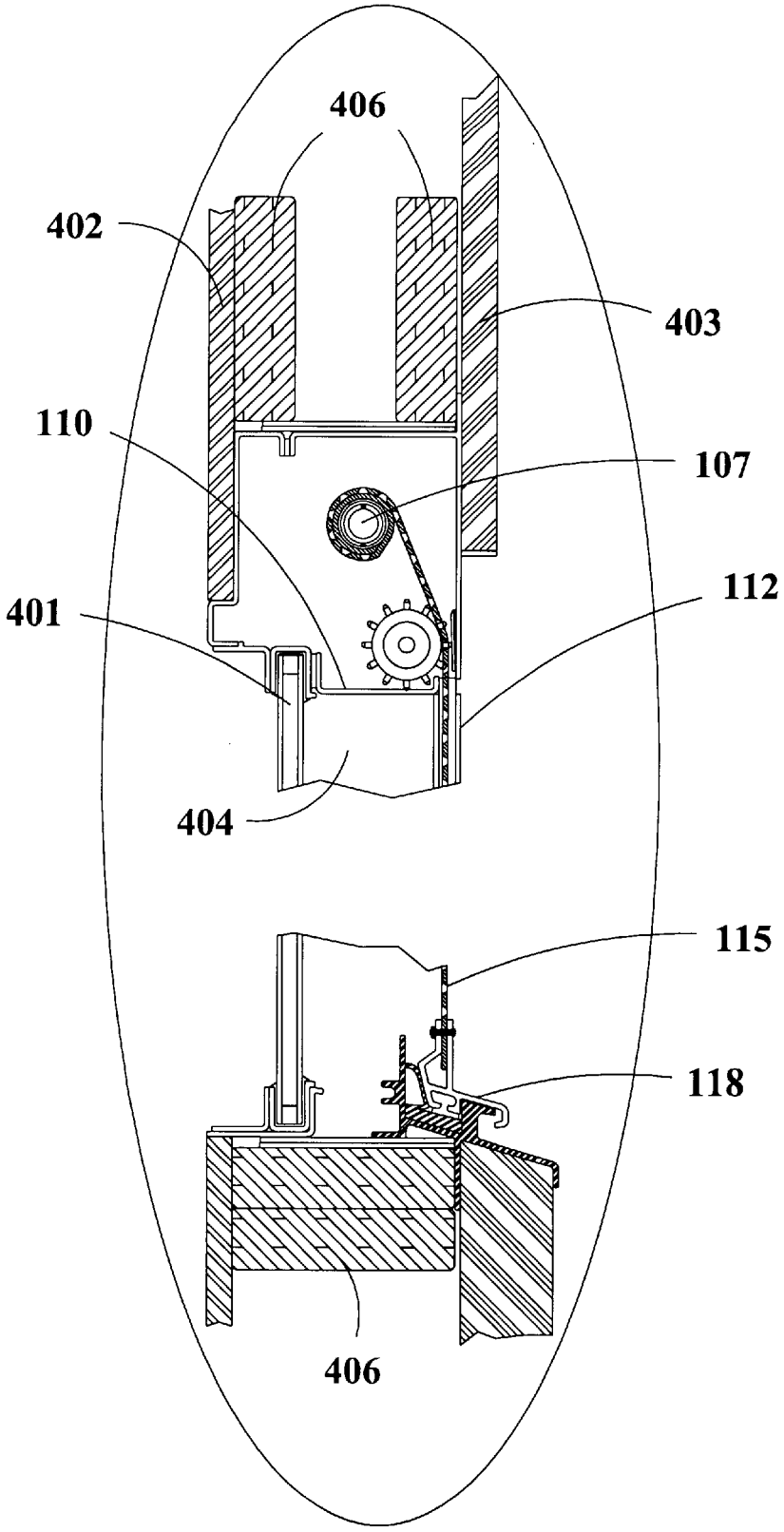
FIG. 4D is a cross-sectional view similar to that of FIG. 4A illustrating the wind-up reel in greater detail for use in connection with the three-ply flexible curtain and the cog drive.

FIG. 4D is a cross-sectional view similar to that of FIG. 4A illustrating the wind-up reel 107 (sometimes referred to herein as the storage reel) in greater detail adapted for use in connection with the three-ply flexible curtain and the cog drive.

Figure 11:
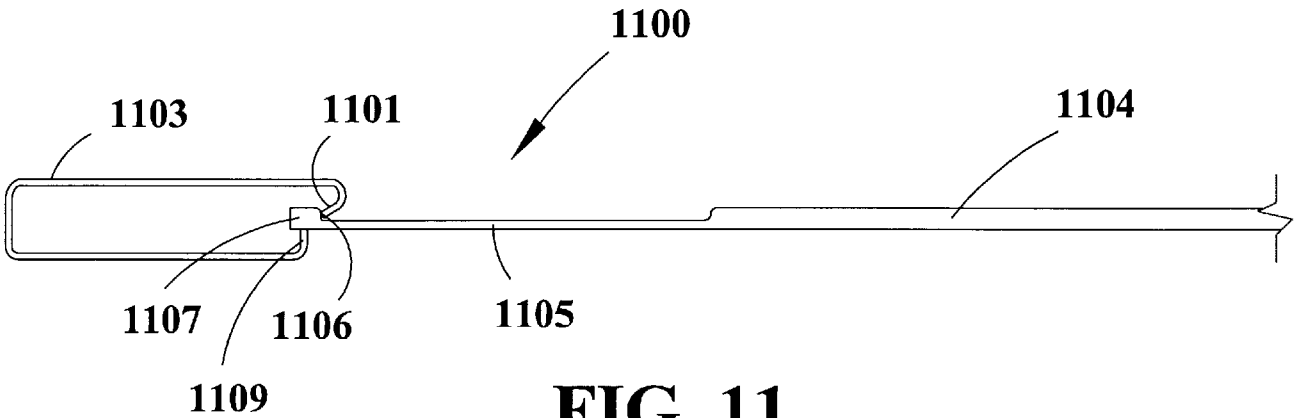
FIG. 11 is a top view of a left side track like that of FIG. 1 illustrating the top rod in its fully down position engaging the track.

FIG. 5 is a schematic view of the 72" curtain illustrating a 1° runout of the leftside track, tension rods, and interrupts. Reference numeral 500 generally indicates a schematic representation of a 1° runout for a 72" long window. The interrupts are actually at a 1° angle which matches the angle of mating surface 203 on the "J-shaped" portion of the track. FIG. 11 illustrates the top of a 72", 1° track in cross section.

The "J-shaped" portion of the track in FIG. 11 is indicated by reference numeral 1101. Referring again to FIG. 5, the dashed unnumbered lines are at 1° angle with respect to the side 220 of curtain 115. The outer edge 201B of the track at the bottom is approximately 1.25"leftwardly of the point marked by reference numeral 201 in the preferred embodiment of the 72", 1° curtain. The intermediate support 202 at the bottom has a runout of the same magnitude as indicated by reference numeral 202B. All of the runouts, of the rods, the interrupts, and the tracks are the same. When all of the rods progress to their closed, second position as illustrated in FIGS. 1 and 5, the interrupts engage the mating surface 203 of the track and wedge into place. This secures the curtain in its closed position. Reference numeral 203B illustrates the runout of the mating surface at the bottom of the 1°, 72" long building opening. Reference numeral 501 illustrates the runout of the outside of the track. Reference numeral 502 illustrates runout of the tension rods. It will be noted that the tension rod 124 illustrates a runout of approximately 1.25" from the side of the curtain 220. Reference numeral 503 illustrates a runout of the interrupt engaging surfaces with the mating surface 203 of track 111. Reference numeral 504 illustrates the runout of the inside portion of track 111. Curtain 115 has no runout as illustrated by reference numeral 505.

Track 111, at a 1° angle, must have a relatively wide mouth, or opening, for use in protecting a 72" long building opening. Given that reference numeral 502 defines the runout of the rods and, indeed, the end of tension rod 124, it must fit within the track as it enters from its stored, open, first position. FIG. 5 illustrates that point 502 will fit within the mouth of track 111 as defined by its outer edge 201.

Figure 6:
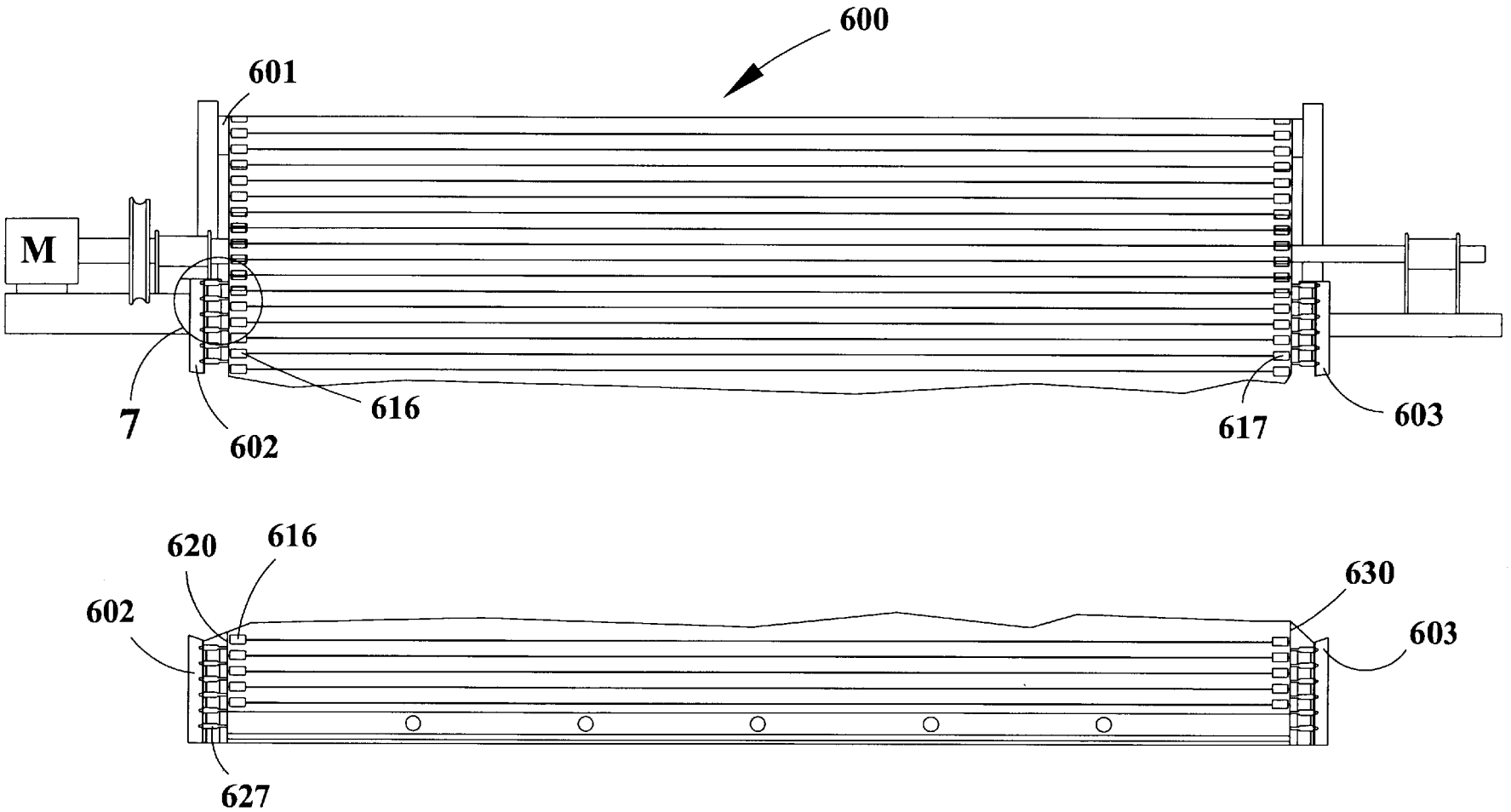
FIG. 6 is a front view of a seventy-two inch (72") curtain similar to that illustrated in FIG. 1 except that the left side and right side tracks are parallel to each other and, additionally, illustrates that the tension rods do not have any runout.
Figure 7:
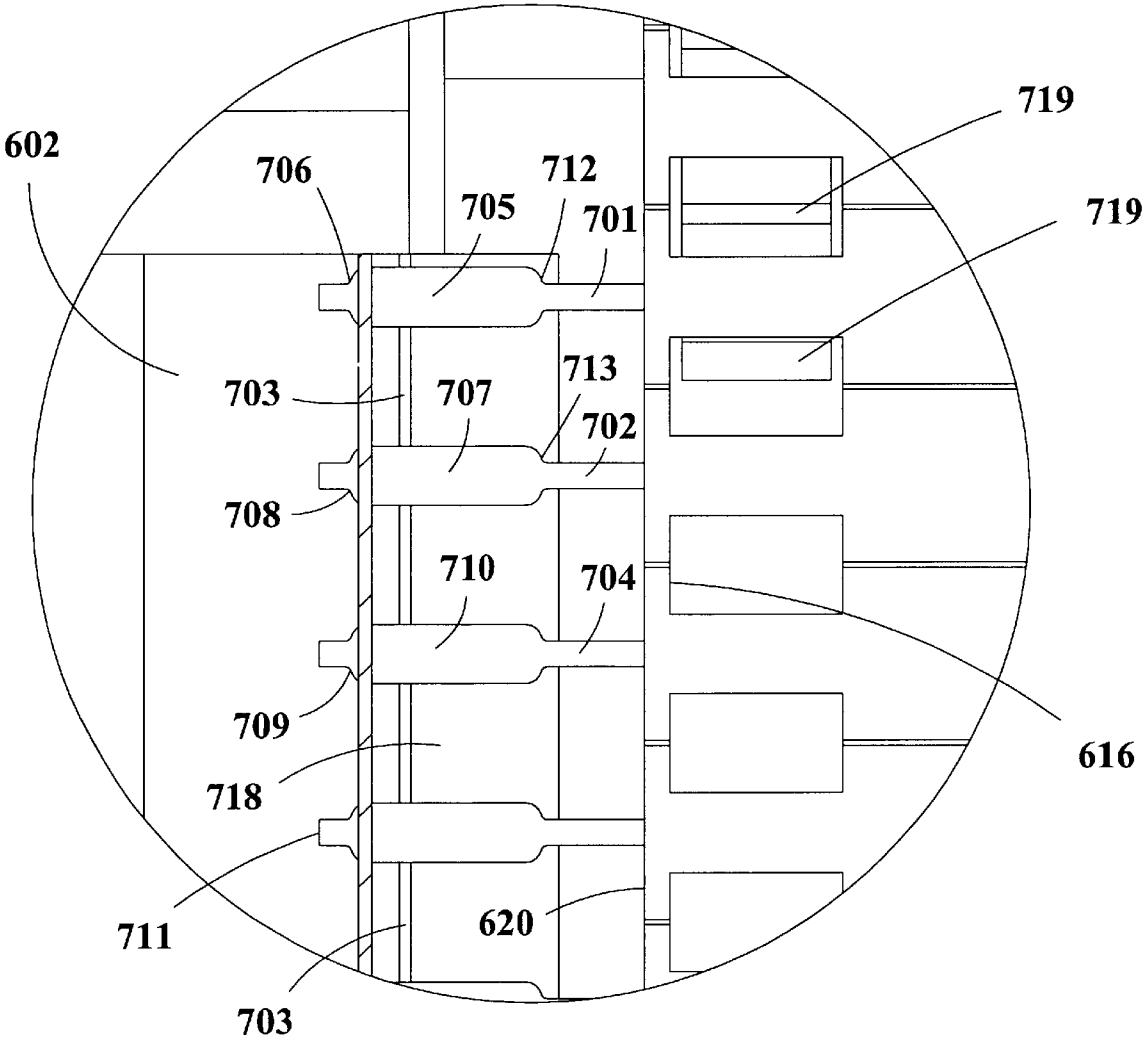
FIG. 7 is an enlarged portion of FIG. 6.

FIG. 6 is a front view of the 72 inch curtain similar to that illustrated in FIG. 1 except that the left side and right side tracks are parallel to each other and additionally the tension rods do not have any runout. FIG. 6 is one of the illustrations of the second (parallel) embodiment. Reference numeral 600 generally refers to the parallel embodiment. Left side track 602 and right side track 603 are illustrated as being parallel to each other. Drive apertures 616 and 617 are driven by gears as was indicated in connection with the gears 119 and 120 of FIG. 1. The left side 620 of the curtain is parallel to the right side 630 of the curtain and the interrupt of the first rod 705 (FIG. 7) is in the same position relative to the track 602 as is the last rod 627 (FIG. 6). FIG. 7 is an enlarged portion of FIG. 6. FIG. 7 illustrates first tension rod 701, second tension rod 702, and third tension rod 704. Interrupts 705, 707 and 710 include respective mating surfaces 706, 708, 709. Those mating surfaces are spaced apart from the conjugate mating surface 703 on the "J-shaped" portion 718 of the track 602. FIG. 6 illustrates the curtain in its second, fully down position. In this second embodiment the interrupts do not wedge and engage with the mating surface 703 on the guide 602 unless pressure due to wind or debris is applied to the curtain. Rather, at rest, there is a distance of approximately ⅛" in the preferred embodiment between the mating surface 703 and the mating surfaces 706, 708, 709, etc. on the interrupts of the tension rods. Therefore, for engagement to occur between the mating surfaces on the interrupts and the mating surface on the J-shaped channel, the flexible corrugated curtain must be deflected and the rods must bow inwardly to move the mating surfaces (703, 706, 708, 709) into contact with each other. The interrupts for the parallel arrangement are approximately 0.50 inches in length and the end portions are spaced an additional 0.150 inches away from the mating interrupt surfaces. Reference numeral 711 indicates an end of a tension rod. Reference numerals 712 and 713 indicate the beginnings of the interrupts 705 and 707 in tension rods 701 and 702. The tension rods extend about 0.250 inches leftwardly and rightwardly of the corrugated curtain before the interrupts begin. The parallel arrangement is driven similarly to the wedging arrangement illustrated in the previous drawing figures and FIG. 7 illustrates teeth 719 on the gear driving the corrugated curtain.

The preferred material of the corrugated curtain is polycarbonate and the preferred material of the tension rod is aluminum. As the cross-sectional areas of the tension rods increase, so does the shear strength of the rods. The "J-shaped" portion of the track is at an angle of approximately thirty degrees and the gap between the mating edge 703 of the J-shaped portion 718 and the support 702 is approximately 0.07 inches.

Figure 8:
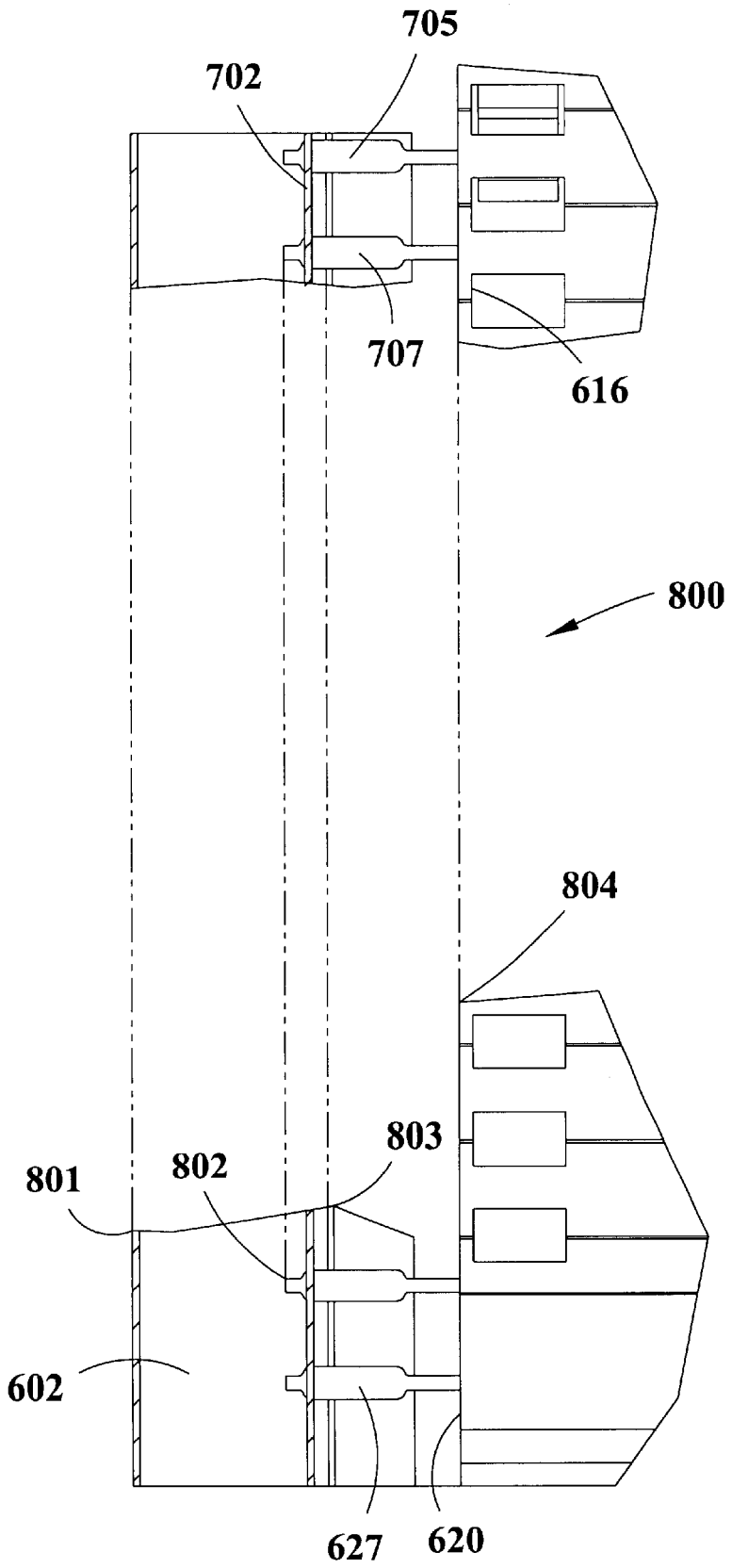
FIG. 8 is a schematic representation of the flexible curtain, track and tension rods of the embodiment of FIG. 6.

FIG. 8 is a schematic representation of the flexible curtain, track and tension rods of the embodiment of FIG. 6. Reference numeral 800 generally indicates the parallel arrangement. Referring to FIG. 8, reference numeral 801 illustrates no runout of the track 602, reference numeral 802 indicates no runout of the ends of the tension rods, reference numeral 803 indicates no runout of the mating surface of track 602, and reference numeral 804 indicates no runout of the curtain. All embodiments employ a curtain having a zero runout. It should be noted in connection with the parallel embodiment that the interrupts are pressed (formed) such that they are parallel to the curtain and/or perpendicular to the longitudinal axes of the tension rods.

Figure 9:
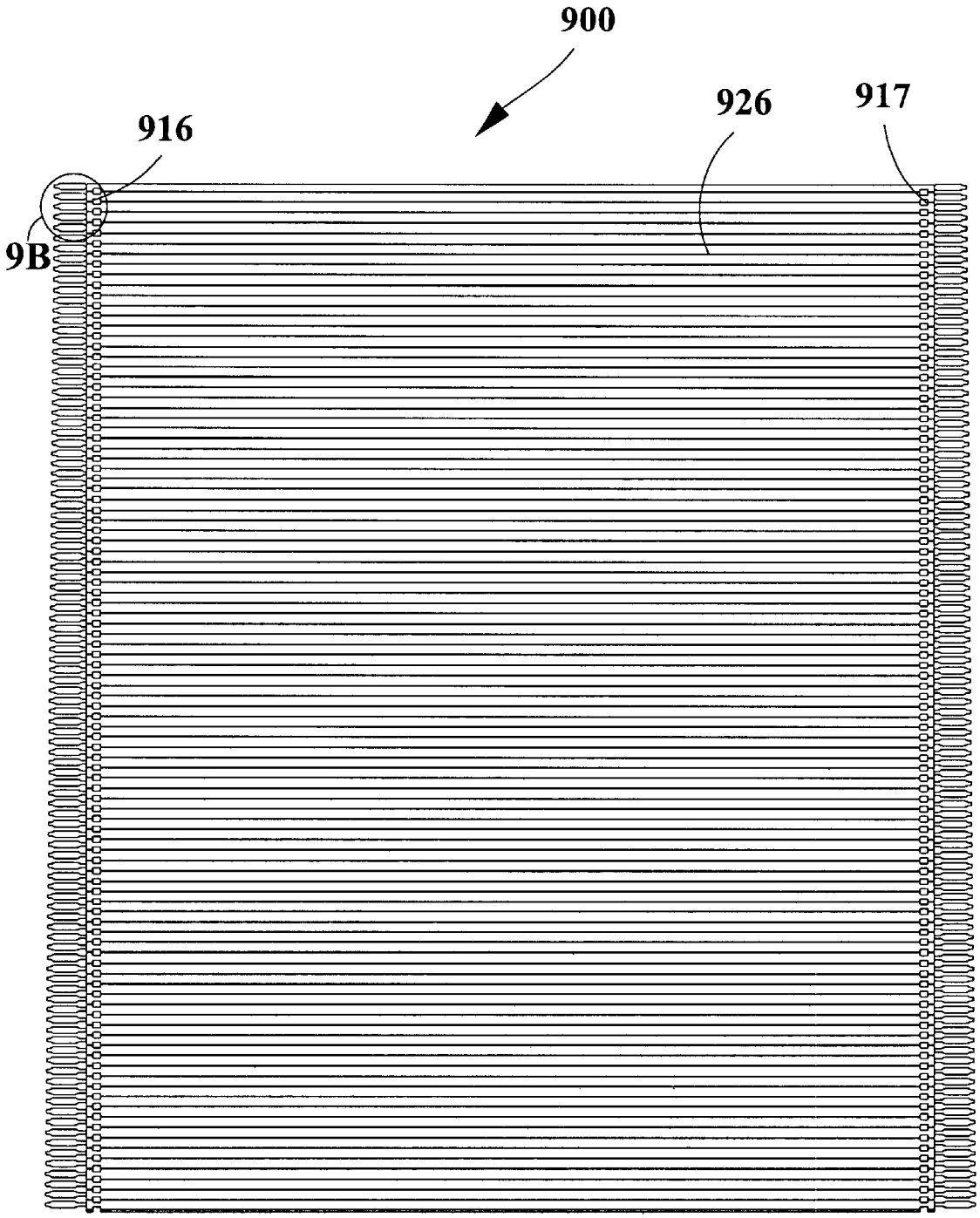
FIG. 9 is a front view of a thirty-eight inch (38") curtain illustrating a one-half degree (½°) runout of the tension rods.

FIG. 9 is a front view of a 38" curtain illustrating a ½° runout of the tension rods. Reference numeral 900 indicates the curtain generally, slits 926 add flexibility to the curtain and drive apertures 916 and 917 are indicated as well.

Figure 9A:
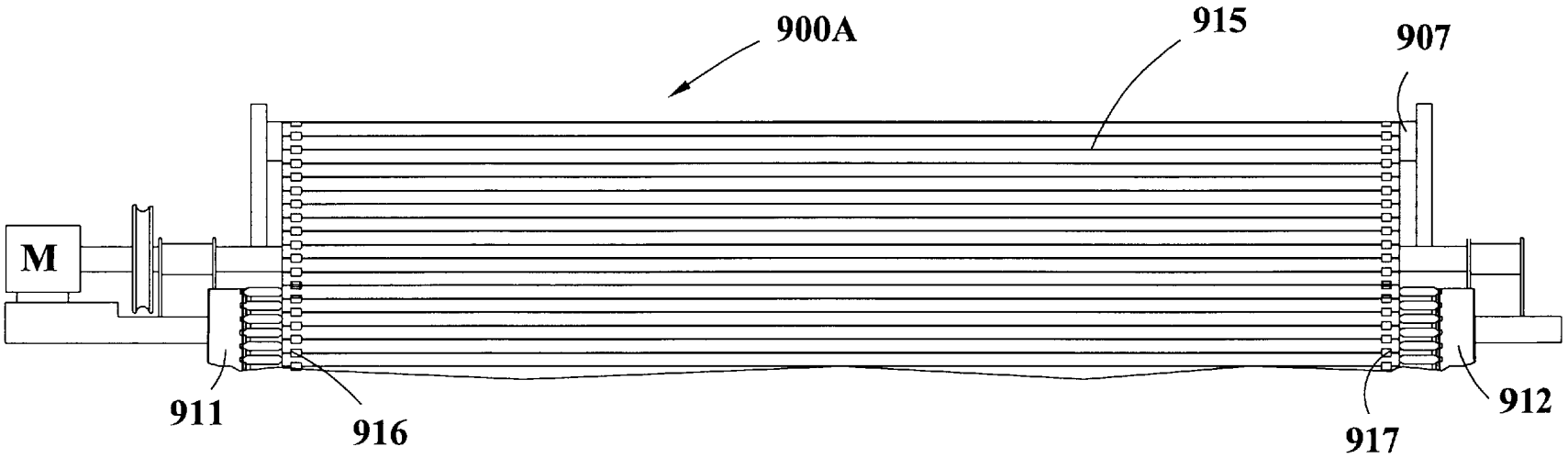
FIG. 9A is a view similar to that of FIG. 1 illustrating a one-half degree (½°) runout of the tracks, interrupts and tension rods.
Figure 9A:
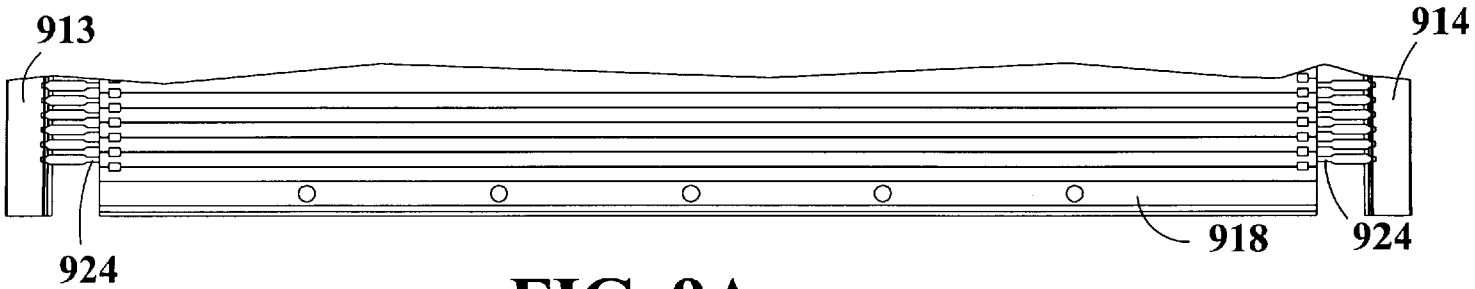

FIG. 9A is similar to that of FIG. 1 illustrating a ½° runout of the tracks, interrupts, and tension rods. Reference numeral 900A illustrates the 38" long curtain having a ½° runout in its fully extended down or second position. Left side track 911 runs out as indicated by reference numeral 913 which is the lower portion of the left side track. Similarly, reference numeral 914 indicates a small, ½° runout of the right side track 912. The last tension rod 924 illustrates a relatively small space between the curtain 915 and the interrupts on that last tension rod 924. A counterbalanced wind-up reel 907 is employed as illustrated in FIG. 9A. Bottom bar 918 is illustrated in FIG. 9A.

Figure 9B:
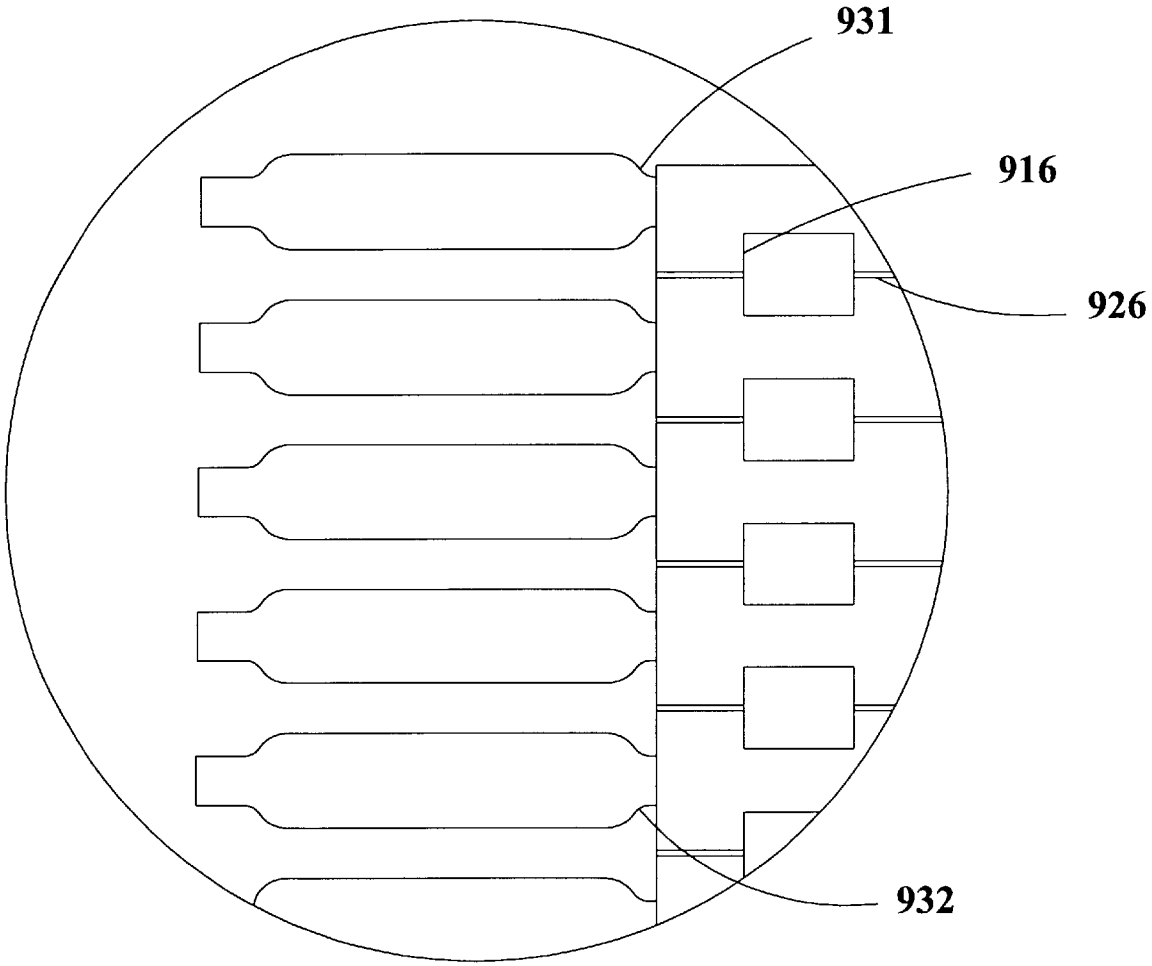
FIG. 9B is an enlarged portion of FIG. 9 illustrating the tension rods, flexible curtain and the drive apertures in the curtain.

FIG. 9B illustrates an enlarged portion of FIG. 9. A relatively small runout between the near side interrupts 931 and 932 (first and fifth rods of the curtain) is indicated. In other words, interrupt 932 of the fifth rod down is not much leftwardly relative to the interrupt 931 of the first rod.

Figure 9C:
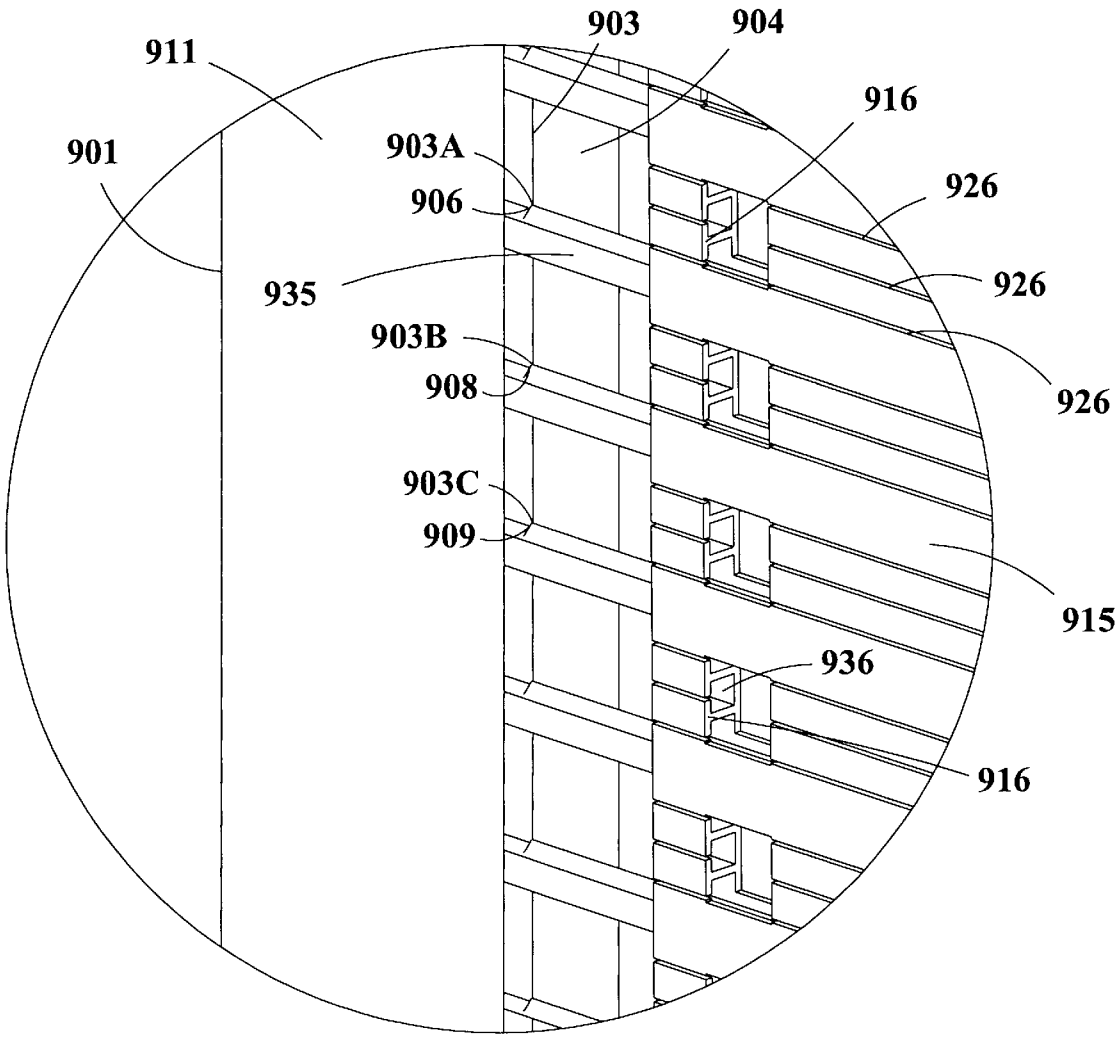
FIG. 9C is a perspective view of a portion of the curtain having a one-half degree runout further illustrating the corrugated flexible curtain and the interrupts mating with the track restraining movement of the flexible curtain toward the window.

FIG. 9C is a perspective view of a portion of a curtain having a ½° runout further illustrating the corrugated flexible curtain 915 and interrupts 906, 908 and 909 mating with the corresponding mating surface 903 at points 903A, 903B and 903C on the "J-shaped" portion 904 of track 911 when the curtain is in its fully down or second position.

In this position movement of the flexible curtain toward the window is restrained and the curtain has been wedged into place. FIG. 9C illustrates the "J-shaped" portion 904 angled back (with respect to the side of the curtain). Mating surface 903 is at the same angle as the mating surfaces on interrupts 906, 908 and 909. Reference numerals 903A, 903B and 903C signify a flush contact between the "J-shaped" portion 904 of the track 911 and the respective interrupts. FIG. 9C also illustrates the outside edge 901 of the track and this figure does a particularly good job in representing the corrugated curtain 915. Corrugations 936 can be viewed in apertures 916 are indicated as are face slits 926. Reference numeral 935 illustrates the rectangular in cross-section rod extending through the curtain 915. It will be noticed that where the rods extend through the curtain that there is no slit at a corresponding point in the face. The rods are sealed within the curtain so that contaminants such as sea salt cannot reach them enabling a low maintenance curtain.

Figure 10:
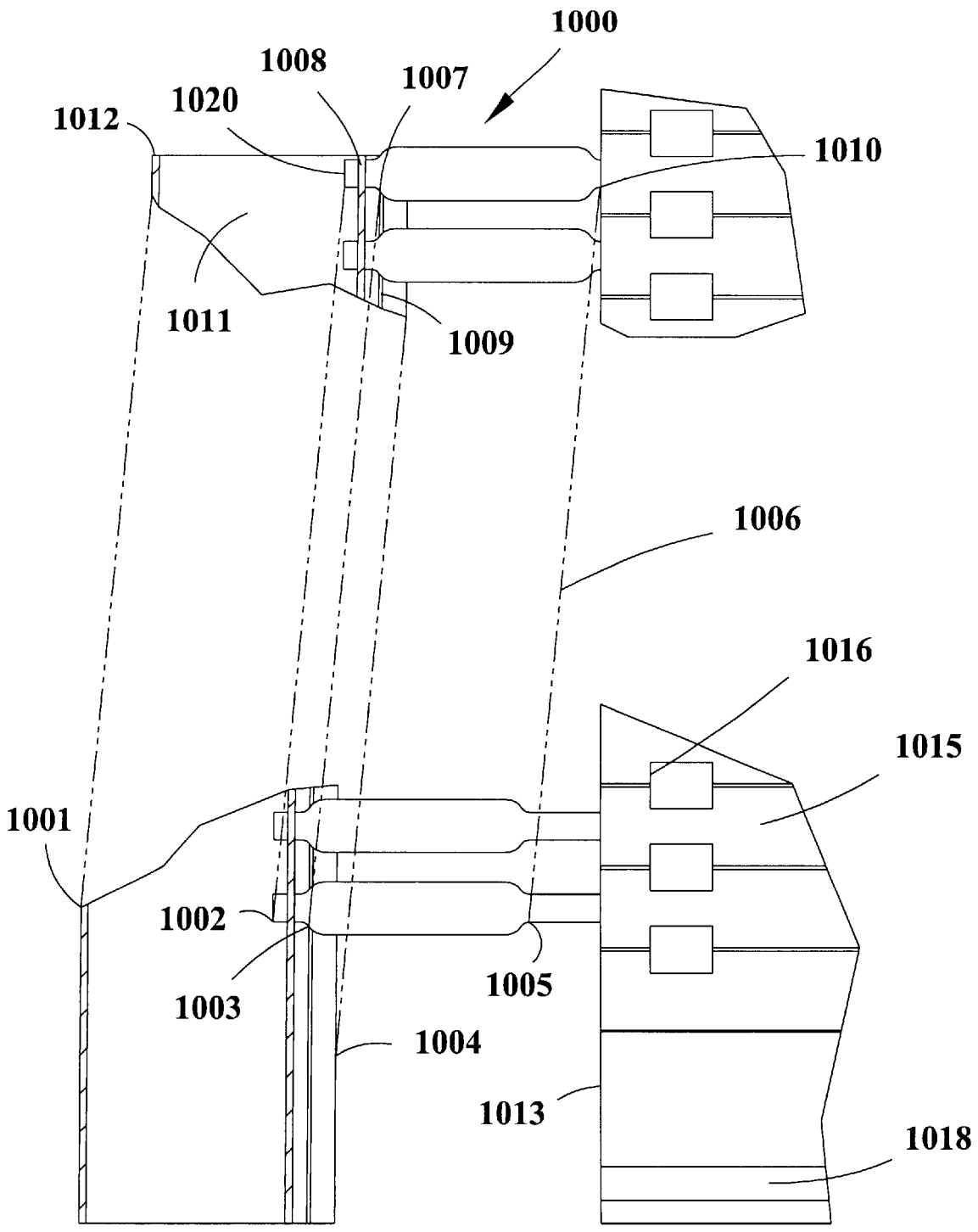
FIG. 10 is a schematic of the thirty-eight inch (38 ") curtain illustrating a one-half degree (½°) runout of the track, interrupts, and tension rods.

FIG. 10 is a schematic representation similar to that of FIG. 5 only it will be noticed that the angle is ½° illustrated over a 38" length as compared to 1° angle illustrated over a 72" length in FIG. 1. It will be apparent when viewing FIG. 10 that a smaller mouth or area is needed to receive the bottom rod of a ½°, 38" curtain system because the runout is much less. Reference numeral 1000 generally indicates this schematic representation. The side of curtain 1013 does not have any runout. Curtain 1015 includes apertures 1016 and the bottom bar is denoted by reference numeral 1018. Track 1011 has an outer edge 1012 whose runout is indicated with reference numeral 1001. Similarly the first tension rod has an end 1020 whose runout is indicated with reference numeral 1002. The first mating interrupt of the first rod is indicated by reference numeral 1007 and its runout is indicated by reference numeral 1003. Finally, the inner portion of the guide also has a runout as indicated by reference numeral 1004. Reference numeral 1009 illustrates the surface of the "J-shaped" portion of the track 1011 which mates with the interrupts. In this ½, 38" embodiment, the interrupts are also at a ½° angle mating arrangement. The track support 1008 performs the same function that the track support performs in the first embodiment in that it supports and restrains the rods during tensioning. During tensioning, the rods will pivot slightly on mating surface 1009 and the end portions thereof, for example end portion 1020, will engage support 1008.

The track supports (i.e., 1008) are necessarily close to the mating surface (i.e., 1009) of the "J-shaped" portion of the track in the embodiments employing an angled track as well. Bending moments are thus minimized because the gap is preferably small, on the order of 0.007 inches.

The distance between the mating surface 1009 and the track support 1008 is important. If this distance is too large then the rods tend to shear as the bending moment caused by the structure of the curtain with the rods therethrough is too large. It has been found that a preferred distance between the track support 1008 and the mating surface 1009 of the track is approximately 0.07 inches. This distance can, however, be changed as those skilled in the art will appreciate.

FIG. 11 is a top view of the leftside track like that of FIG. 1 illustrating the top rod in its fully down position engaging the track. FIG. 11 illustrates a cross-sectional view of the top of the track which has 1° runout. The runout, however, is not illustrated in this drawing. Reference numeral 1100 generally illustrates the rod and the relative spacing arrangements for a 72" long opening having a 1° runout. Rod 1104 includes a relatively long interrupt 1105. "J-shaped" portion 1101 of track 1103 is shown engaging the mating surface 1106 of the interrupt 1005 of the rod 1104. In viewing FIG. 1 it is obvious that there are many rods employed in the curtain and each of those rods will seat against the "J-shaped" portion 1101 of the track 1103.

Figure 11A:
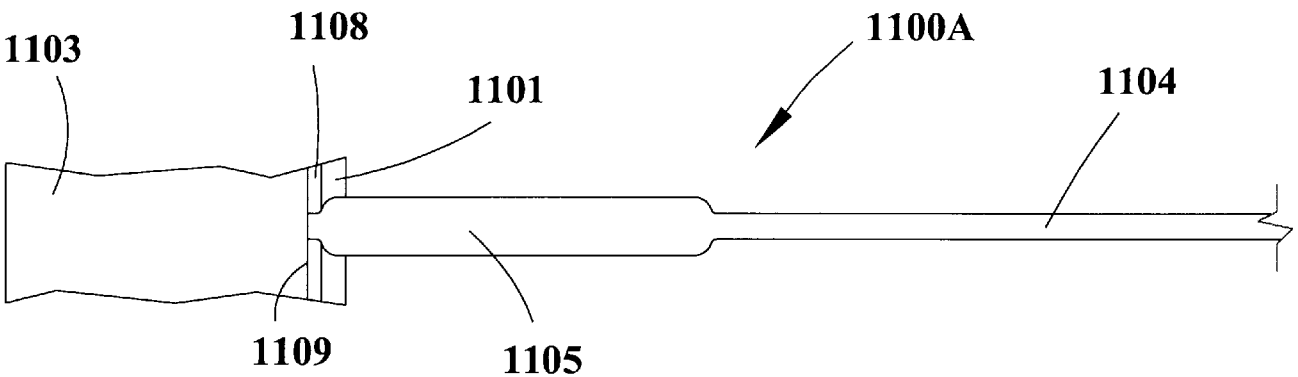
FIG. 11A is a front view of the left side track and the top rod illustrated in FIG. 11.

FIG. 11A is a front view of the leftside track 1103 and the top rod 1104 illustrated in FIG. 11. Reference 1100A generally illustrates this front view. Gap 1108 is the space between the J-shaped portion 1101 and the track support 1109 and is preferably small (0.007 inches).

Figure 11B:
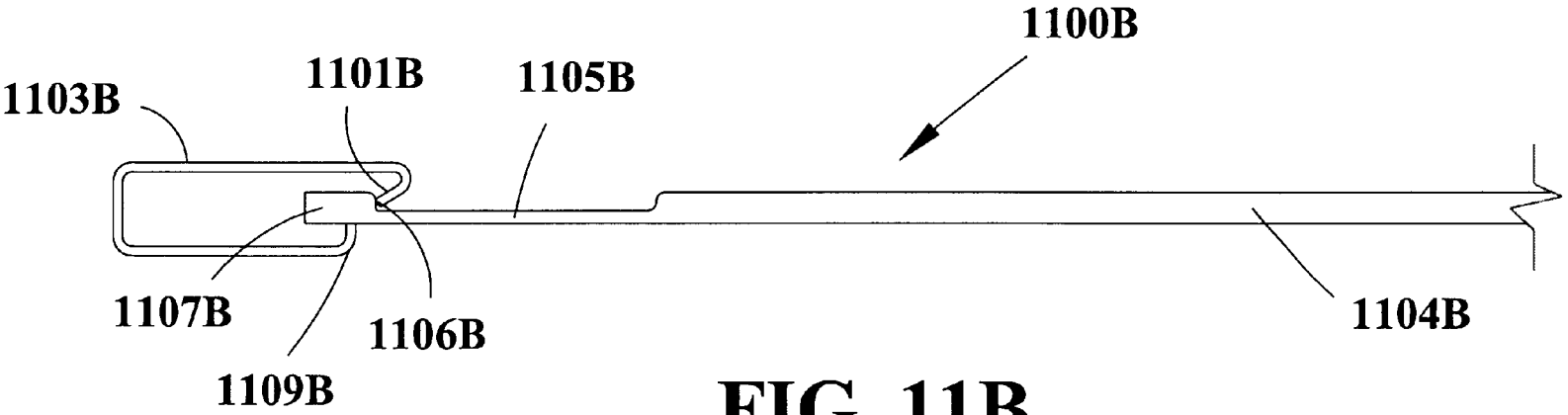
FIG. 11B is a top view of a left side track like that of FIG. 9A illustrating the top rod in its fully down position engaging the track.
Figure 11C:
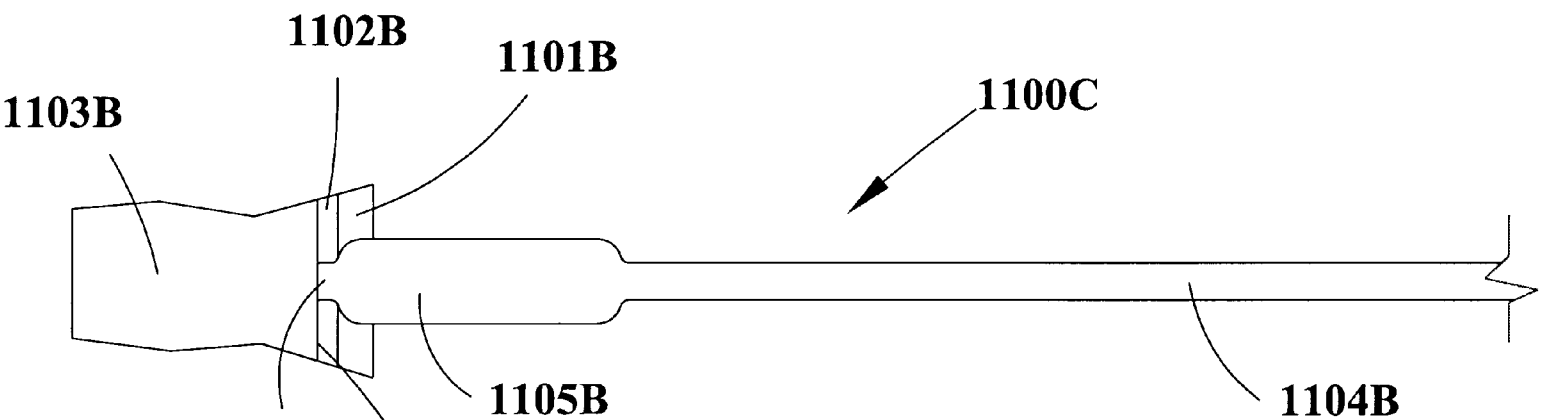
FIG. 11C is a front view of the left side track and the top rod illustrated in FIG. 11B.

FIG. 11B is a top view of a leftside track like that of FIG. 9A illustrating the top rod in its fully down position engaging the track. FIG. 11B illustrates a cross-sectional view of the top of the track which has a ½° runout. The runout, however, is not illustrated in this drawing. Reference numeral 1100B generally denotes the view. It will be noticed that the track 1103B is somewhat smaller when compared to the track necessary for a 72" opening having a 1° runout. Further, it will be noticed that the rod 1104B includes a smaller interrupt 1105B as compared to the 72", 1° runout. "J-shaped" portion 1101B engages the mating surface 1106B of interrupt 1105B. End portion 1107B of the track is supported by support 1109B during tensioning as was discussed previously. Gap 1102B is illustrated between "J-shaped" portion 1101B and track support 1109B. FIG. 11C is a front view of the leftside track and top rod illustrated in FIG. 11B. Reference numeral 1100C generally. denotes this view. Reference numeral 1200 generally denotes this view.

Figure 12:
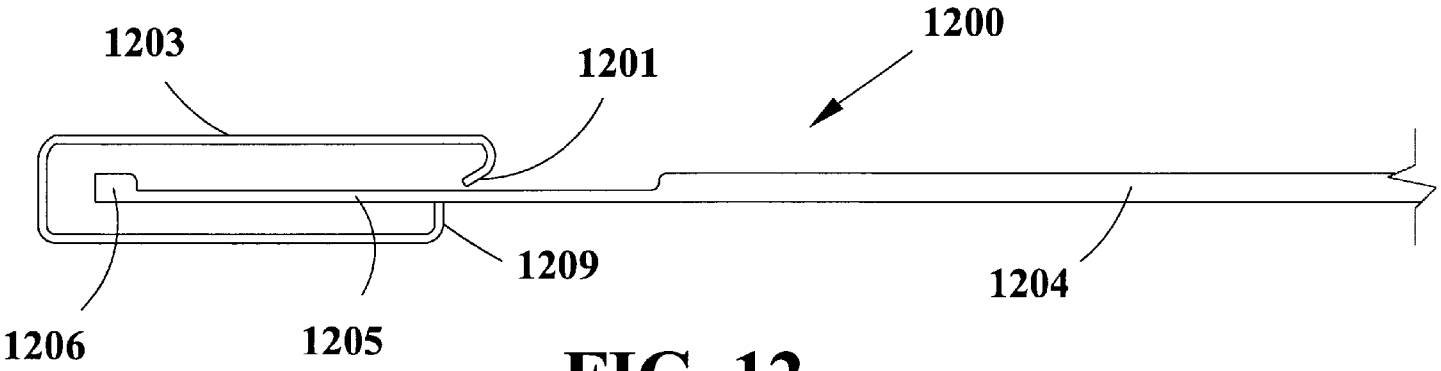
FIG. 12 is a top view of a left side track like that of FIG. 1 illustrating the bottom rod in its fully up position entering the track.
Figure 12A:
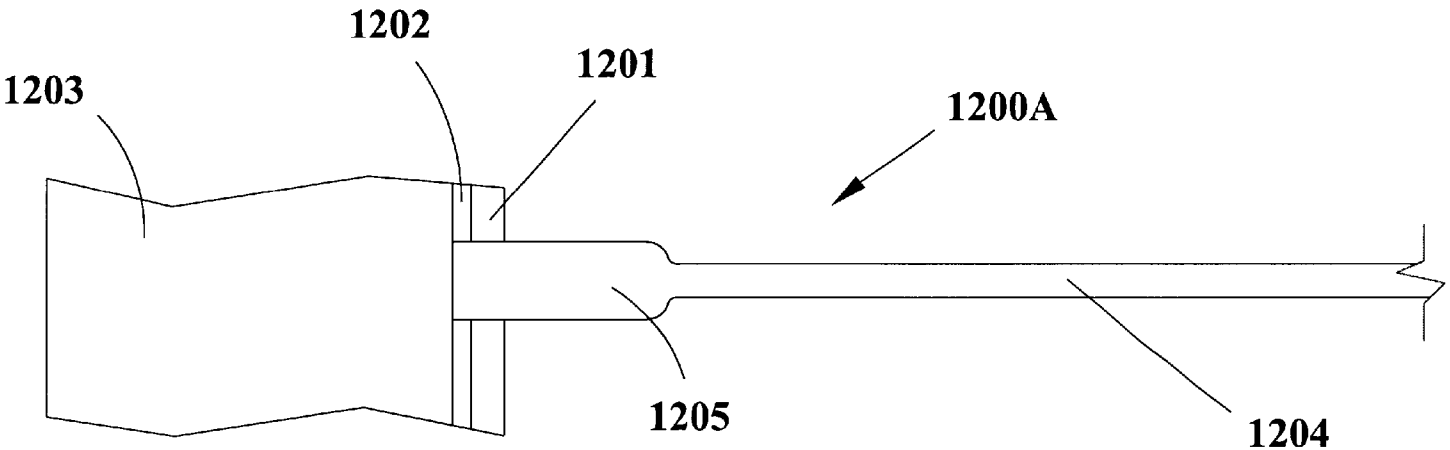
FIG. 12A is a front view of the left side track and the top rod illustrated in FIG. 12.

FIG. 12 is a top view of a leftside track like that of FIG. 1 illustrating the bottom rod in its fully up position entering the track. FIG. 12 illustrates a cross-sectional view of the top of the track which has a 1° runout. The runout, however, is not illustrated in this drawing. It will be noticed that the interrupt 1205 is relatively and necessarily large. Because this interrupt is relatively large a relatively large mouthed track 1203 is necessary to in effect swallow or accept the tension rod 1204. The interrupt must straddle the gap 1202 between the "J-shaped" portion 1201 of the track and the track support 1209. This is caused by a long or large 72" opening having tracks at 1° divergence from vertical. Put another way, the tracks have a 2° divergence from track to track. The end 1206 of rod 1204 must have sufficient clearance inwardly from track 1203 to enter it. FIG. 12A is a front view of the leftside track and the bottom rod illustrated in FIG. 12 and reference numeral 1200A generally denotes this view.

Figure 12B:
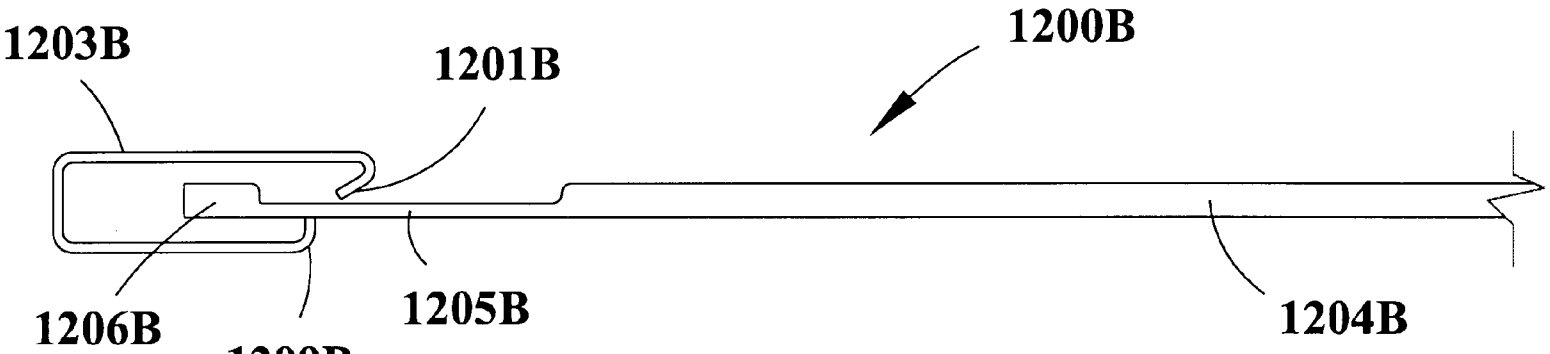
FIG. 12B is a top view of a left side track like that of FIG. 9A illustrating the bottom rod in its fully up position entering the track.

FIG. 12B is a top view of a leftside track like that of FIG. 9A illustrating the bottom rod 1204B in its fully up position entering the track. FIG. 12B illustrates a cross-sectional view of the top of the track which has a ½° runout. The runout, however, is not indicated in this drawing. Reference numeral 1200B generally denotes this view. A smaller track 1203B is acceptable because the runout over a 38" long opening having tracks that diverge ½° from vertical or 1° from each other does not require a lengthy interrupt 1205B. Additionally, it will be noticed too that there is a small clearance between the "J-shaped" portion 1201B of the track 1203B and the interrupt 1205B. This is necessary so that the rods may progress downwardly without much friction. Clearance is indicated in all of FIGS. 11 and 12. Sufficient clearance between end portion 1206B of the rod 1204B and the track 1203B is indicated. Gap 1202B is indicated between J-shaped position 1201B and the support 1209B.

Figure 12C:
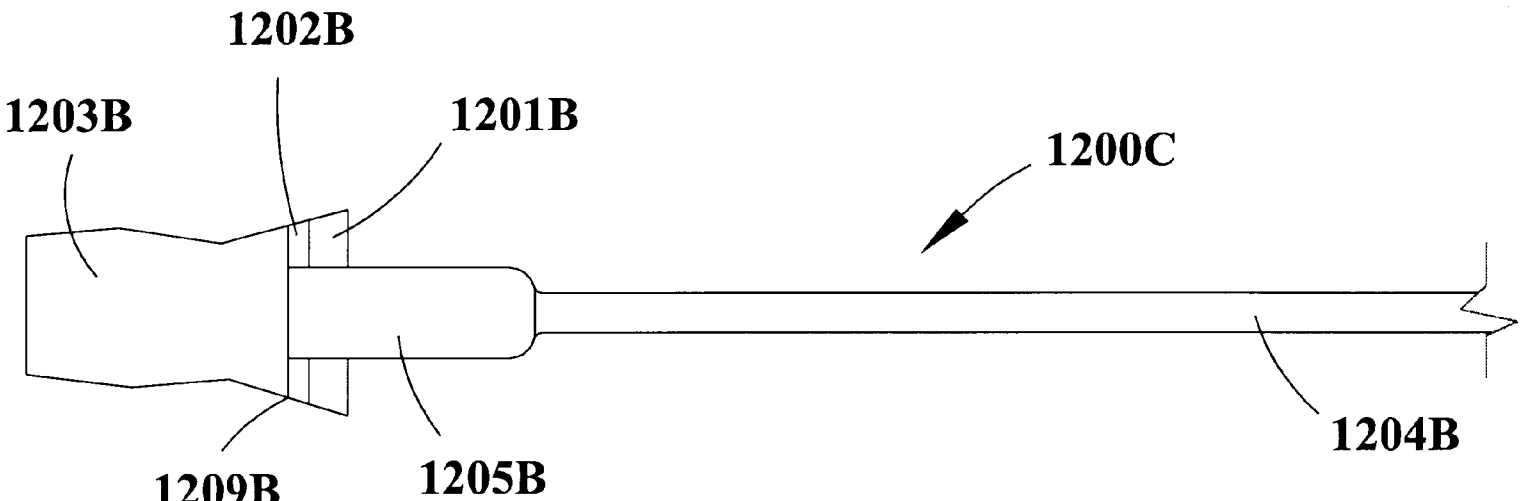
FIG. 12C is a front view of the left side track and the top rod illustrated in FIG. 12B.

FIG. 12C is a front view of the leftside track and the top rod as illustrated in FIG. 12B and reference numeral 1200C generally denotes this view.

In all of FIGS. 11 and 12, the J-shaped portion is at an angle of 30° and the gap between the mating surface of the J-shaped portion and the support is 0.07 inches. This geometry provides good securement of the curtain under load.

Returning to FIG. 5 the problem associated with a long opening such as the 72" opening employing a track at 1° to vertical (2° angle divergent from track to track) is that the width of the interrupt must increase so that it may straddle the "J-shaped" mating surface and still be within (short of)

the outer edge of the track. Therefore, although this invention is useful over any practical angle of divergence from track to track, it is usually more economical to employ a ½° runout and wedge than a 1° runout and wedge for long openings. The wedge principle works over any practical angle, but it may be more economical for some combinations of angle and length than others.

Figure 13A:
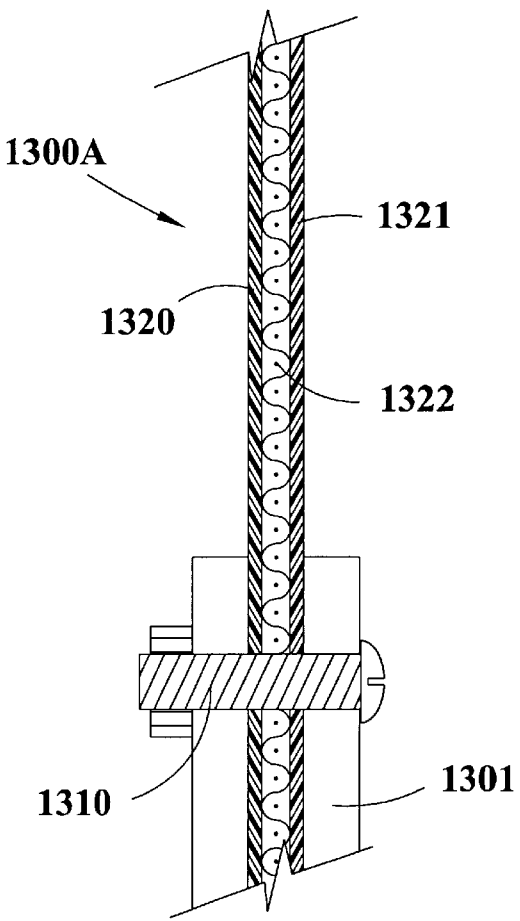
FIG. 13A is a cross-sectional view of a three-ply flexible curtain affixed to a bottom bar.
Figure 13:
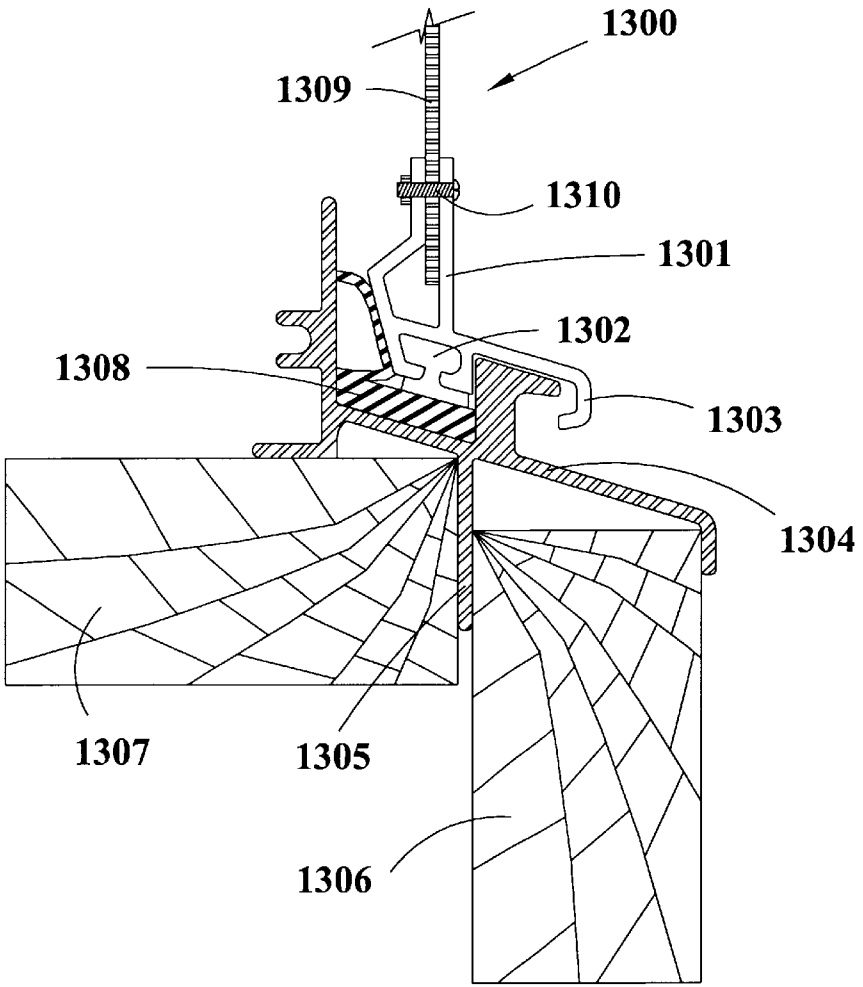
FIG. 13 is a cross-sectional view of the bottom bar sealingly engaging the bottom sill which is affixed to the frame of the structure.

FIG. 13 is a cross-sectional view of the bottom bar 1300 sealingly engaging the bottom sill 1304 which is affixed to the frame 1306, 1307 of the structure. FIG. 13 illustrates a curtain 1309 which is corrugated. Corrugated curtain 1309 is affixed to the bottom bar 1300 by means of a fastener 1310. Magnet 1302 is a part of bottom bar 1301 and is attracted to the sill or other structure. Sill 1304 includes seal 1308 which is restrained in sill 1304 by means of adhesive or epoxy. The wood frame traps sill portion 1305 to assist in holding the sill in place. Catch 1303 engages sill 1304 when curtain 1309 is sufficiently flexed by wind or debris.

FIG. 13A is a cross-sectional view of a three-ply flexible curtain 1300A. Two polymeric sheets or plies 1320, 1321 are pressed and fused into engagement with a woven ply 1322 which is affixed by fastener 1310 to bottom bar 1301.

Figure 13C:
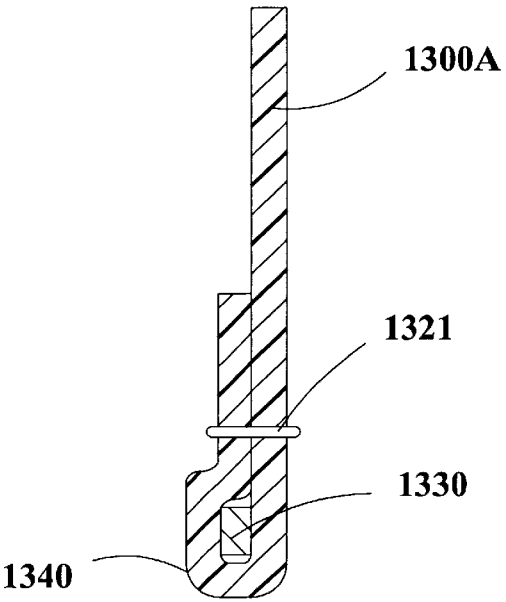
FIG. 13C is the same as FIG. 13B except stitching is used to secure the bottom bar.
Figure 13B:
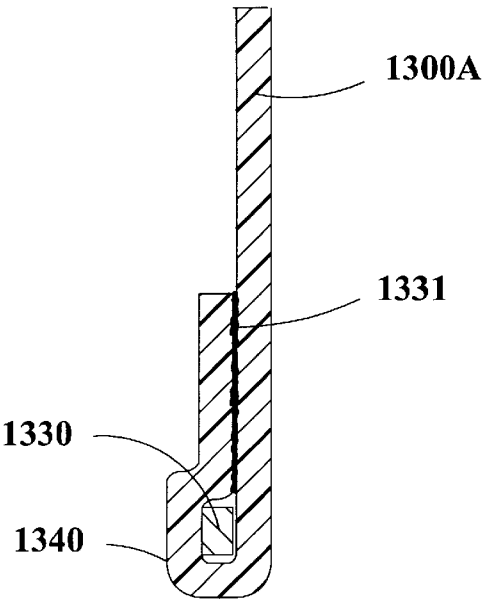
FIG. 13B is a cross-sectional view of a three-ply curtain with a bottom bar secured therein by adhesive or lamination.
Figure 13D:
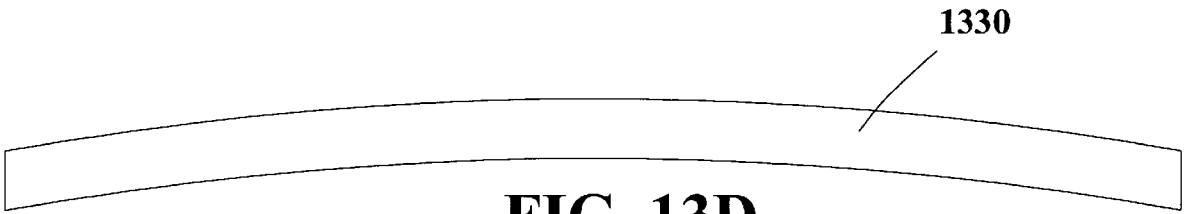
FIG. 13D is a front view of the vertically bowed bottom bar alone.

FIG. 13B is a cross-sectional view of a three-ply flexible curtain 1300A together with a vertically bowed bottom bar 1330 entrapped by adhesive/lamination of the flexible curtain. FIG. 13C illustrates entrapment of bottom bar 1330 by stitching the plies together. The bowed bar 1330 is illustrated in FIG. 13D and functions to guide the curtain into a retaining slot 2820 as illustrated in FIGS. 28C and 28D. When wind pressure or pressure from debris is applied, the middle portion 2841 of the curtain may bow toward the window. The side portions, however, are guided by the tracks (2801, 2204) and the bottom portion 1340 of the curtain is vertically bowed and is guided into retaining slot 2820 first below the tracks and then in the middle. The bottom portion is restrained by the tracks against the pressure of the wind. This gets the curtain started at the sides of the retaining slot and the middle of the curtain follows.

Figure 14:
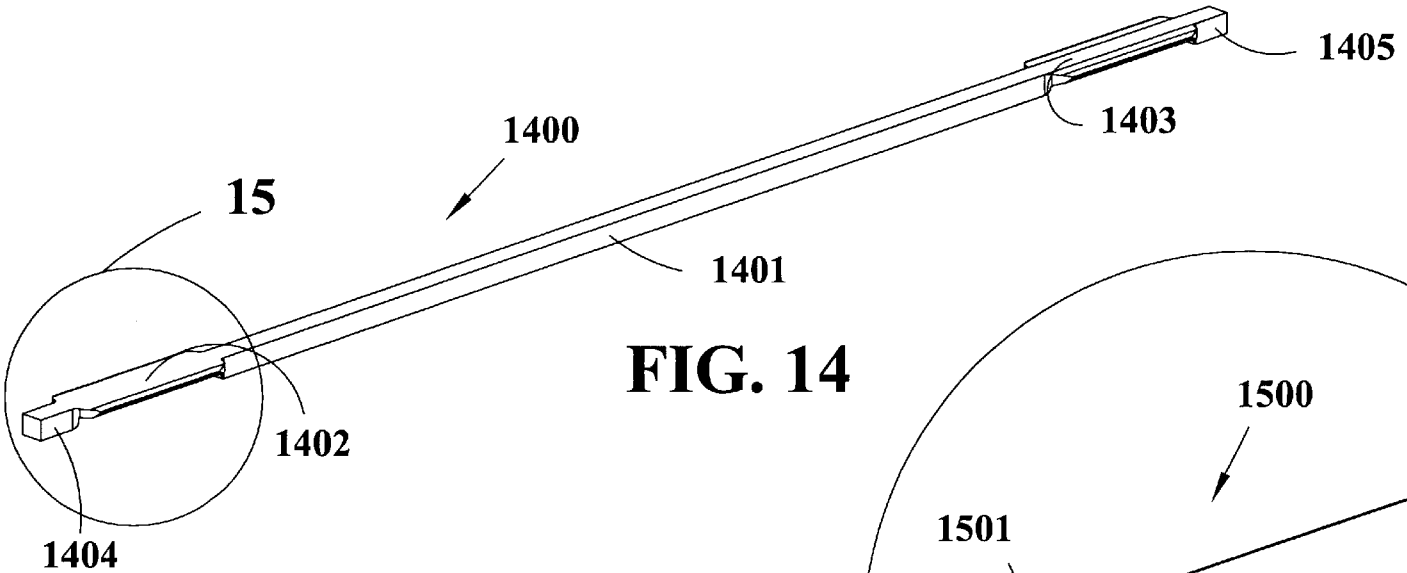
FIG. 14 is a perspective view of a tension rod.

FIG. 14 is a perspective view of a tension rod 1401 having an interrupt 1402 in an end portion 1404 and having an interrupt 1403 in an end portion 1405. The rod is generally represented by the reference numeral 1400. The tension rod is rectangular in cross-section and the cross-sectional shape has been found to be the strongest shape. Other shapes, however, may be used.

Figure 15:
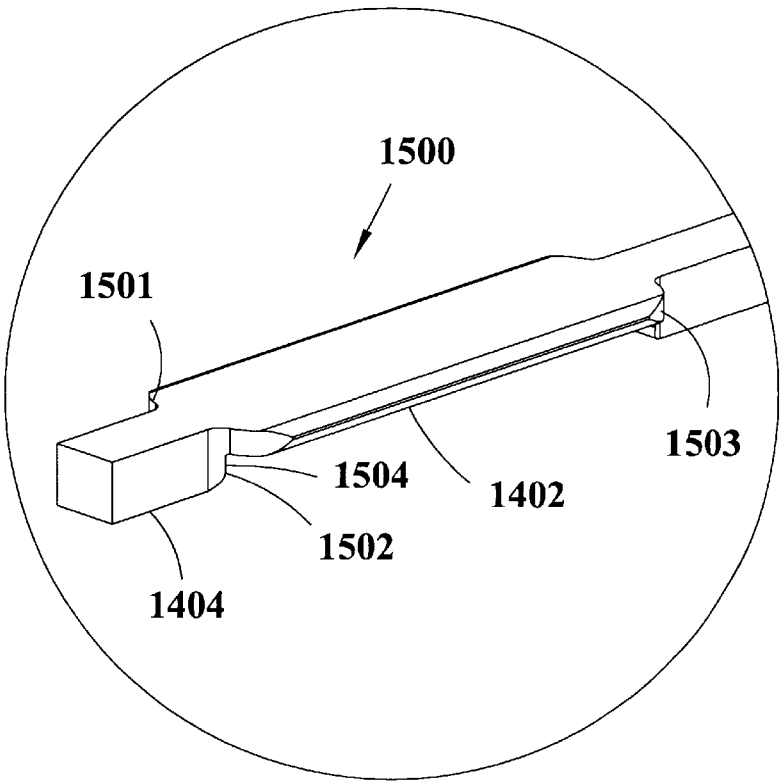
FIG. 15 is an enlarged portion of the tension rod illustrated in FIG. 14.

FIG. 15 is an enlarged portion of the tension rod 1401 illustrated in FIG. 14. Interrupt 1402 is shown having curved radii 1501, 1502 and 1503. Reference numeral 1500 generally denotes the end portion of the rod. Flat portion 1504 shown inwardly from radius 1502 engages the mating surface of the "J-shaped" portion of the track.

Figure 16:
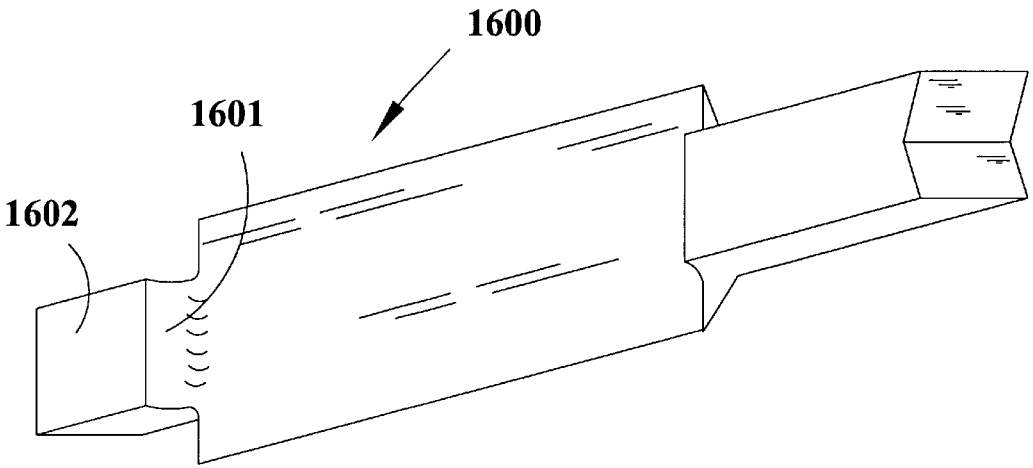
FIG. 16 is another enlarged view of a portion of a tension rod.

FIG. 16 is another enlarged view of a portion of a tension rod. Reference numeral 1600 generally indicates the end portion of the tension rod with end 1602 and radius 1601. Mating surface 1601 is a good representation of an angled surface with respect to the longitudinal axis of the tension rod. It is this mating surface 1601 which engages a similarly angled mating surface on the "J-shaped" portion of the tracks. In other words, surface 1601 is at an angle with respect to the longitudinal axis of the rod.

Figure 17:
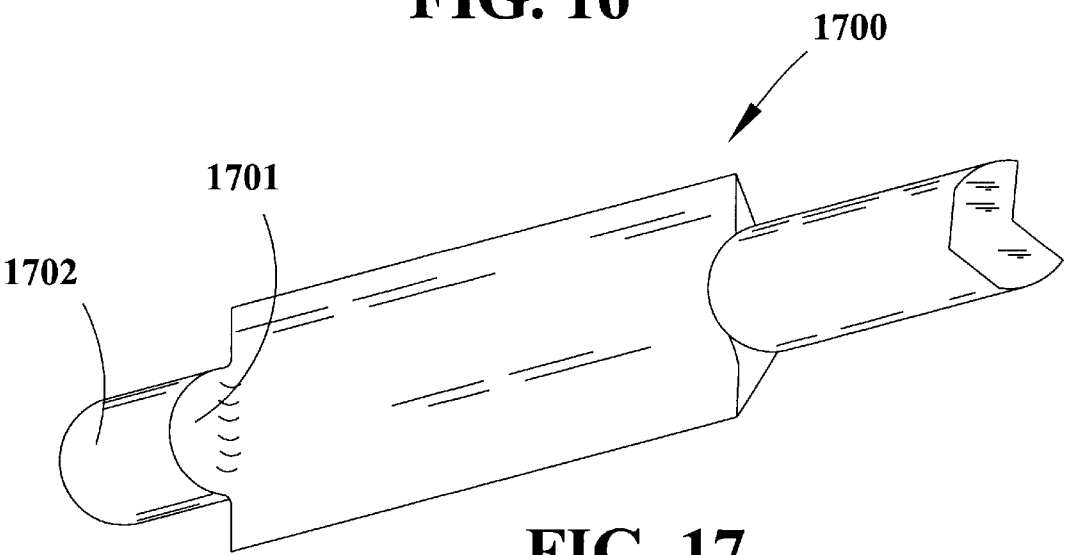
FIG. 17 is a view of the end portion of a tension rod illustrating a circular in cross-section tension rod.

Similarly FIG. 17 is a view of the end portion of a tension rod illustrating a circular in cross-section tension rod. Reference numeral 1700 generally represents this embodiment with end portion 1702 having an interrupt formed therein with mating surface 1701 being angled to match the "J-shaped" portion of the tracks. When the embodiment of FIG. 6, to wit, a parallel arrangement is illustrated, the mating surfaces 1601 and 1701 will necessarily be perpendicular to the longitudinal axes of the tension rods. The tension rods are preferred to be rectangular in cross-section so as to maximize the area filled in the corrugated material which is rectangular in cross-section. The rectangular in cross-section rod has been found to be the strongest because it occupies the largest cross-sectional area.

Figure 18:
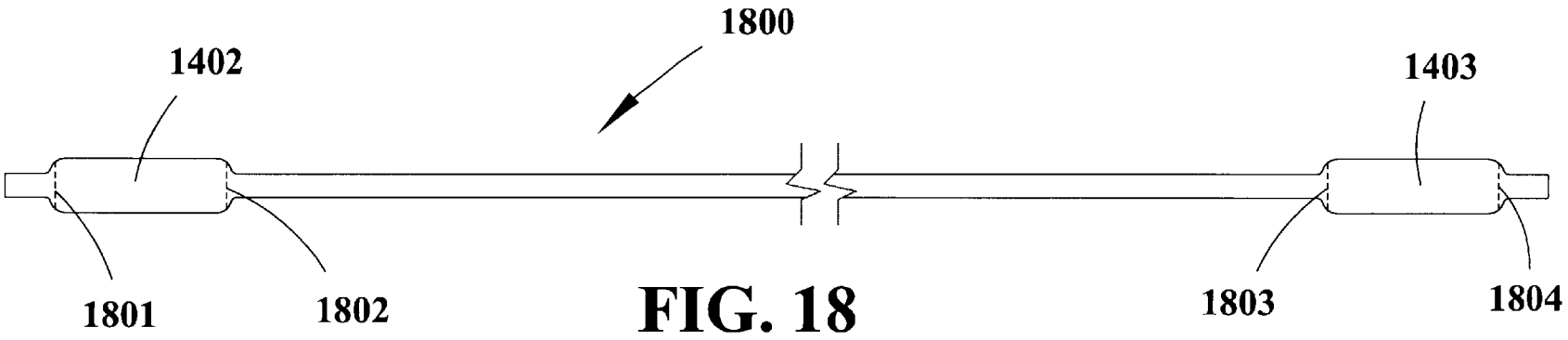
FIG. 18 is a plan view of a tension rod.
Figure 19:
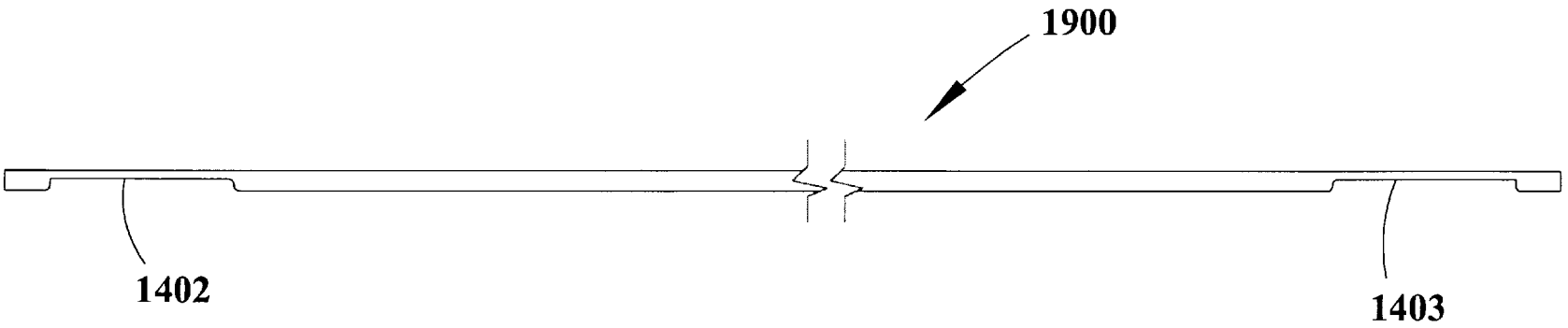
FIG. 19 is a side view of a tension rod illustrating the interrupts therein.

FIG. 18 is a plan view of a tension rod illustrating the interrupts 1402 and 1403. Reference numeral 1800 is a general designation for this rod. Dashed lines 1801, 1802, 1803 and 1804 correspond to angled track. FIG. 19 is a side view of a tension rod of FIG. 18 illustrating the interrupts therein. Reference numeral 1900 is a general designation for this view of the rod.

Figure 20:
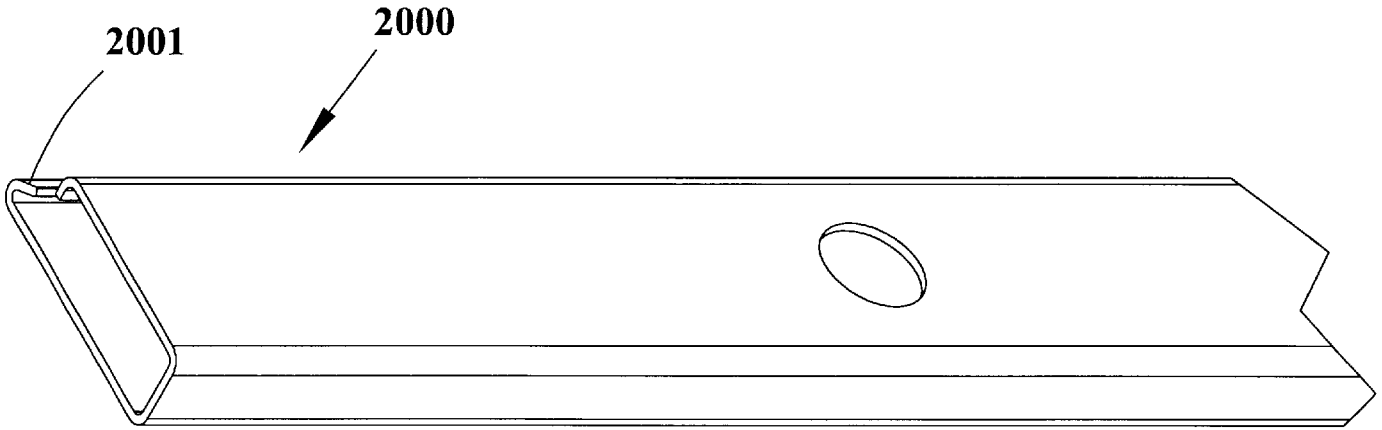
FIG. 20 is a perspective view of the track.
Figure 21:
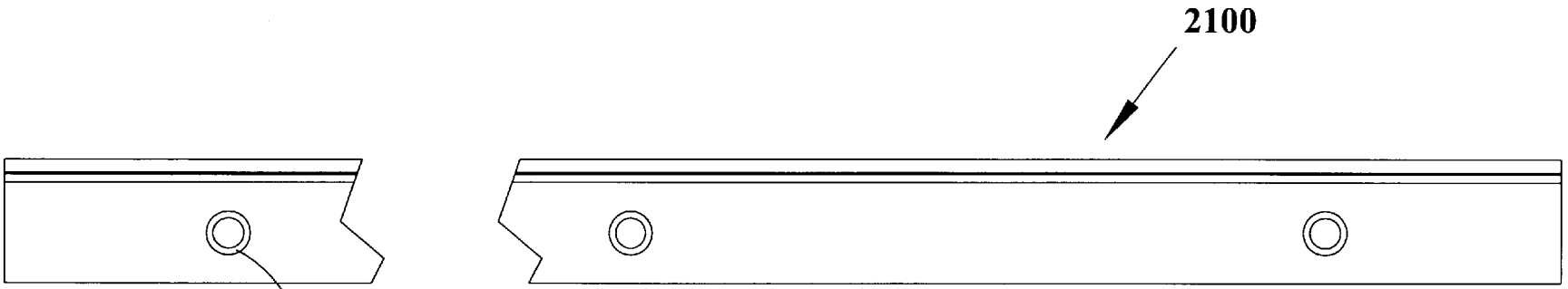
FIG. 21 illustrates a plan view of one of the tracks.

FIG. 20 is a perspective view of the track which has been referred to in this figure by reference numeral 2000. J-shaped portion 2001 is well shown in this illustration. FIG. 21 illustrates a plan view of one of the tracks 2000 with bolt holes or apertures 2101 for fixing to a casing or frame. Reference numeral 2100 generally denotes this drawing figure.

Figure 22:
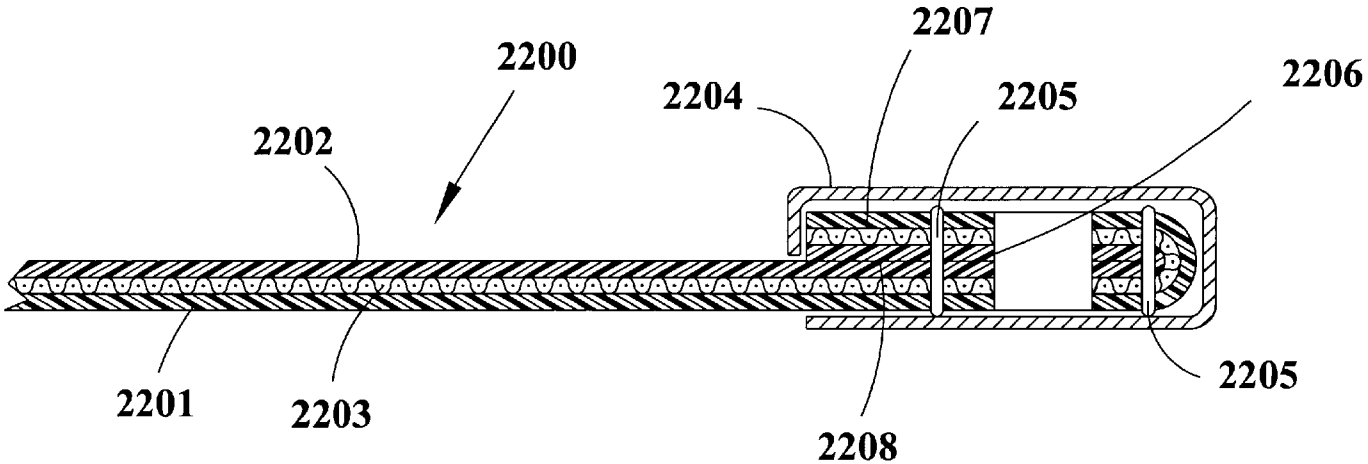
FIG. 22 is a cross-sectional view of a three-ply curtain and track taken along the lines 22—22 of FIG. 28.
Figure 22A:
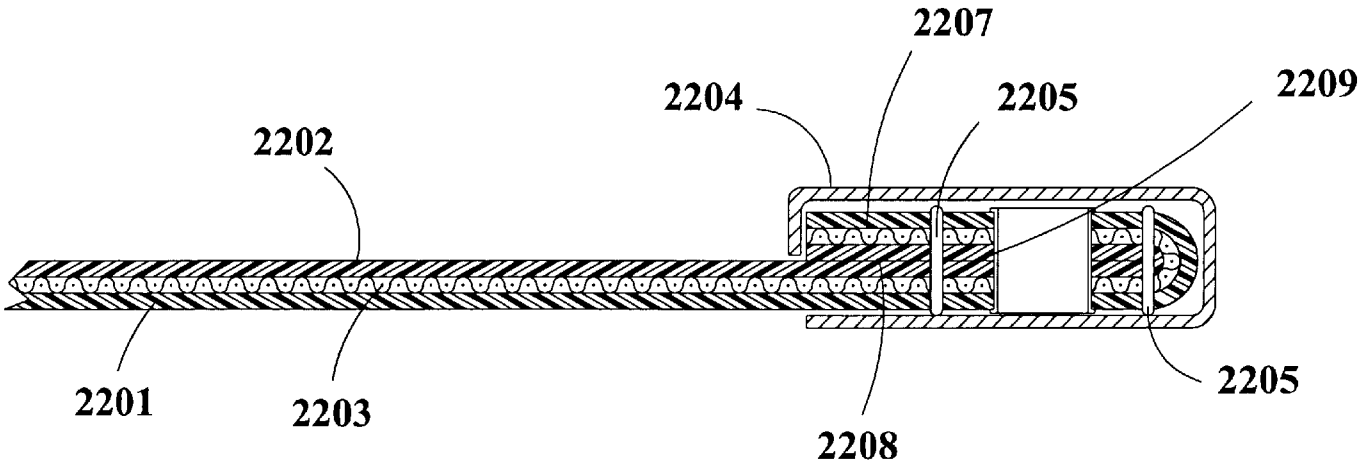
FIG. 22A is a cross-sectional view similar to the view of FIG. 22 further illustrating eyelets in the apertures.
Figure 22B:
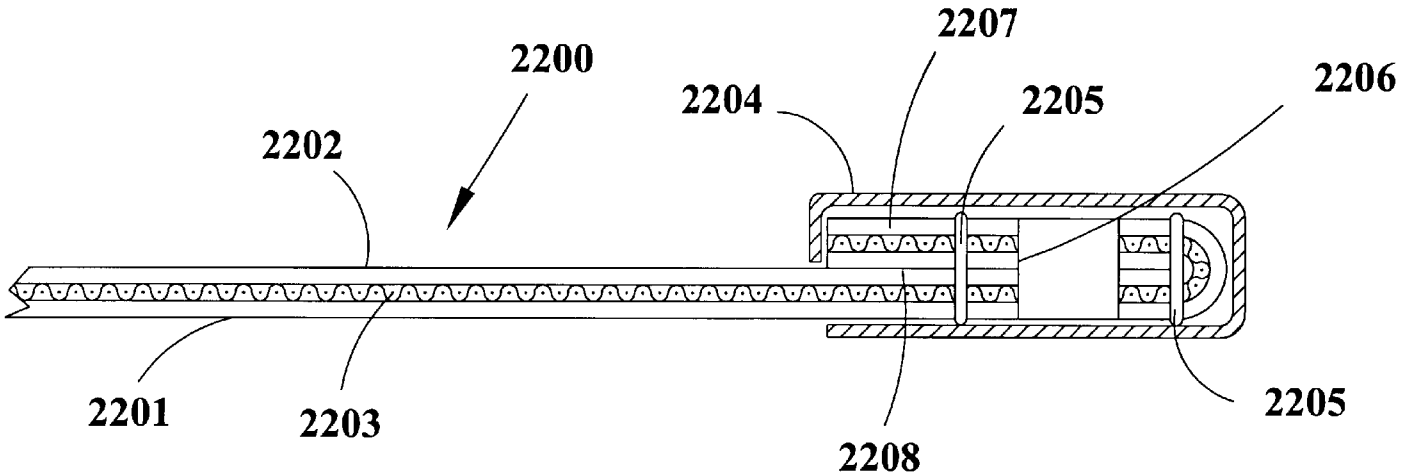
FIG. 22B is a cross-sectional view identical to FIG. 22 except the cross hatching of the polymeric plies is not illustrated so as to better depict the curtain.
Figure 22C:
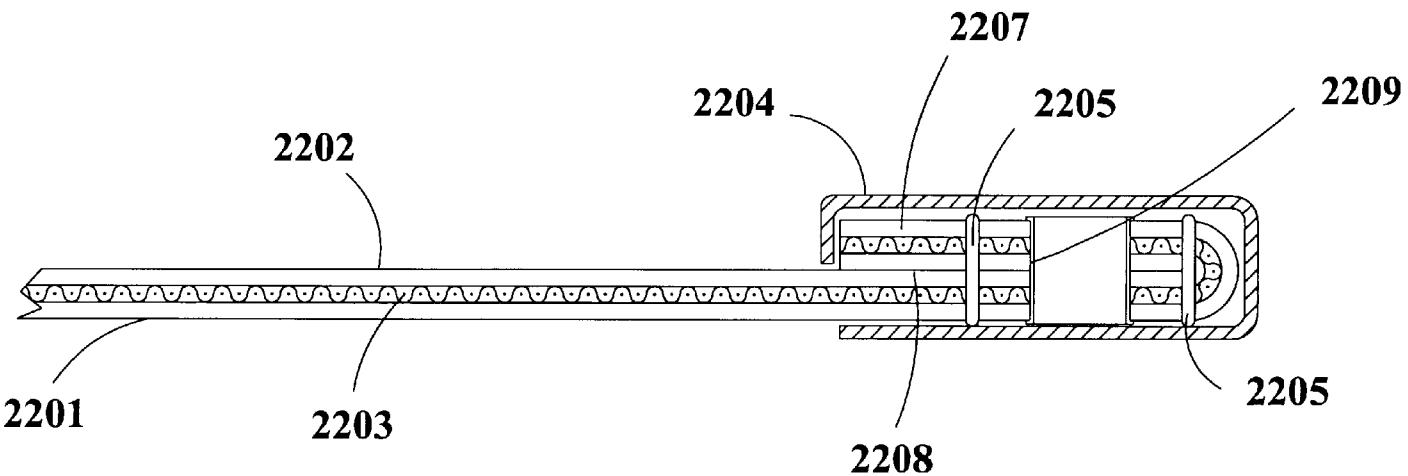
FIG. 22C is a cross-sectional view identical to FIG. 22A except the cross hatching of the polymeric plies is not illustrated so as to better depict the curtain.
Figure 27:
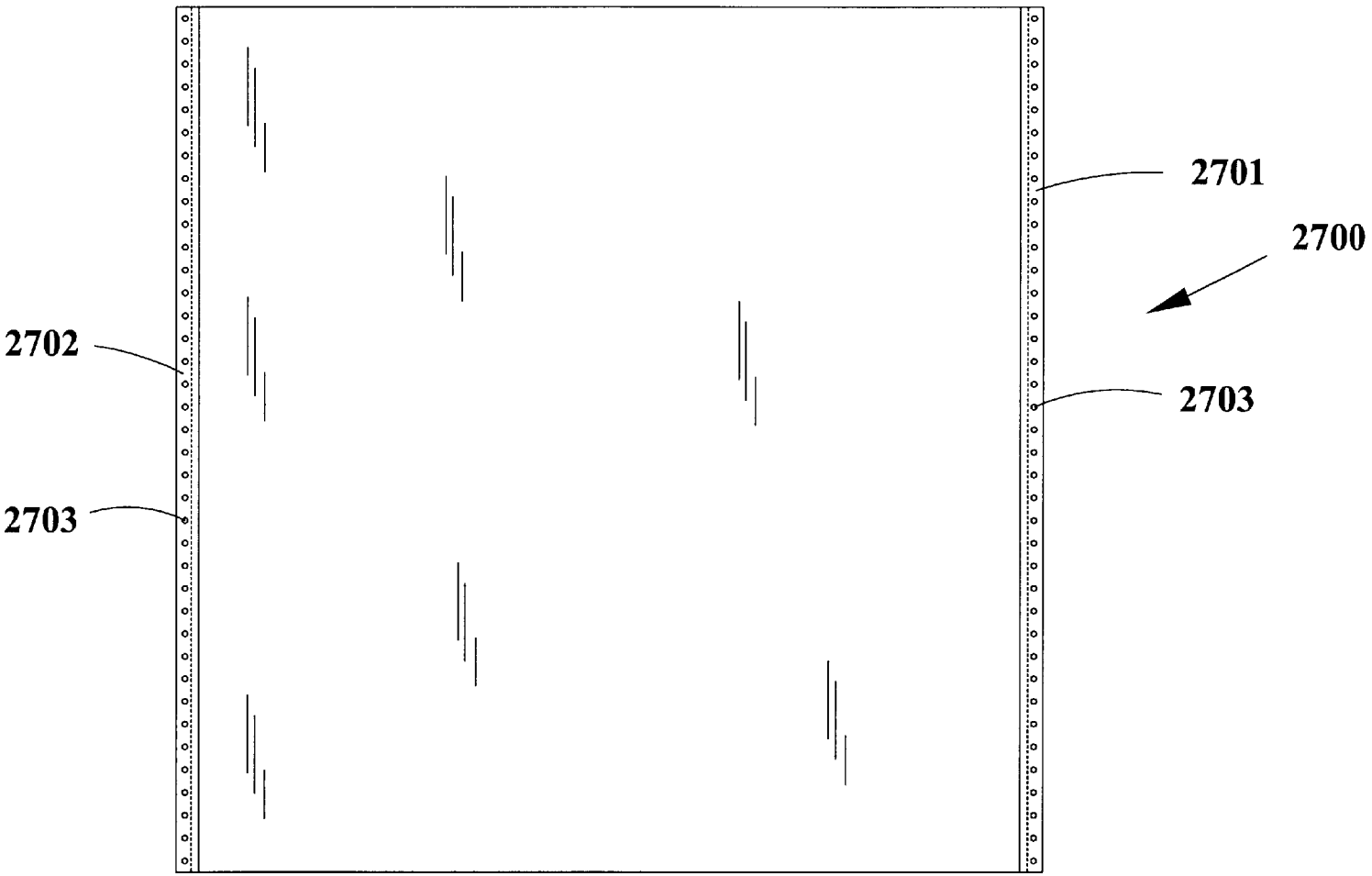
FIG. 27 is a rear view of the three-ply flexible curtain illustrating a semi-rigid strip applied to both edges of the curtain.
Figure 28:
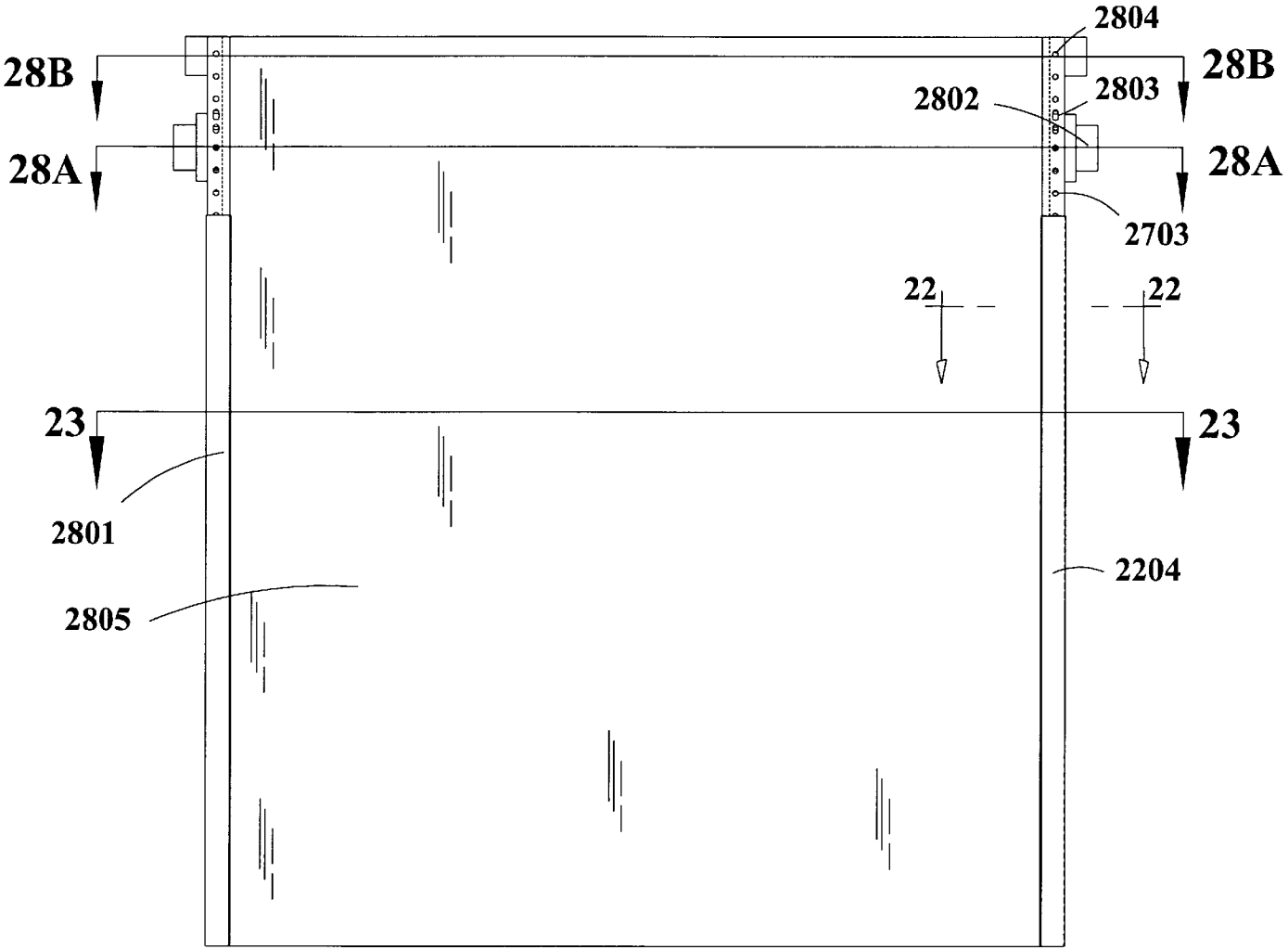
FIG. 28 is a front view of a three-ply curtain being driven by a gear having conical teeth or cogs.

FIG. 22 is a cross-sectional view of a three-ply flexible curtain 2200 taken along the lines 22—22 of FIG. 28. FIGS. 22–29 illustrates the third embodiment of the invention. A first polymeric sheet 2201, a second polymeric sheet 2202, and a third woven sheet 2203 are heated and pressed together forming the construction of a flexible curtain. Track 2204, preferably metal, is illustrated in FIG. 22. The edges of the flexible curtain 2200 are folded upon themselves and are maintained in the folded position by stitching 2205. Alternatively, the folds may be glued to the curtain. The stitching is preferably placed such that ⅓ of the folded flap will be loose and ⅔ of the folded flap will be secured to the curtain. Drive apertures 2206 are shown and reference numeral 2207 indicates the loose flap. Reference numeral 2208 indicates the folded portion of the curtain. FIG. 22A is identical to FIG. 22 only eyelet 2209 in aperture 2206 is illustrated. Eyelets 2209 add strength for driving the curtain between its first, open and second, closed positions. It may be noticed that the cross-hatching used for the plies 2201 and 2202 appear to cause an optical illusion such that the plies do not appear parallel but, in fact, they are parallel. FIGS. 22B and 22C are identical to FIGS. 22 and 22A, respectively, but FIGS. 22B and 22C do not include the cross-hatching. FIGS. 22B and 22C do not portray any optical illusions.

Figure 23:
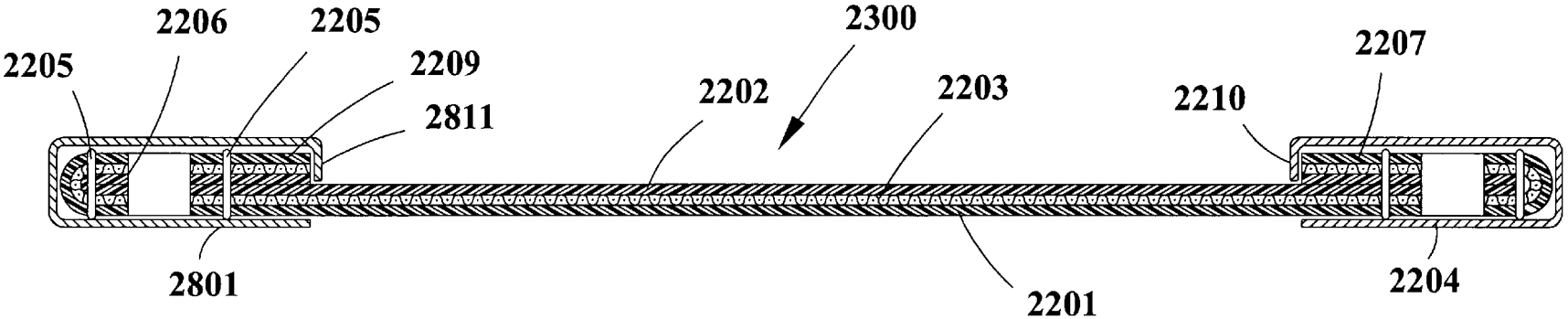
FIG. 23 is a cross-sectional view of a three-ply curtain and track with the curtain taken along the lines 23—23 of FIG. 7.
Figure 23A:
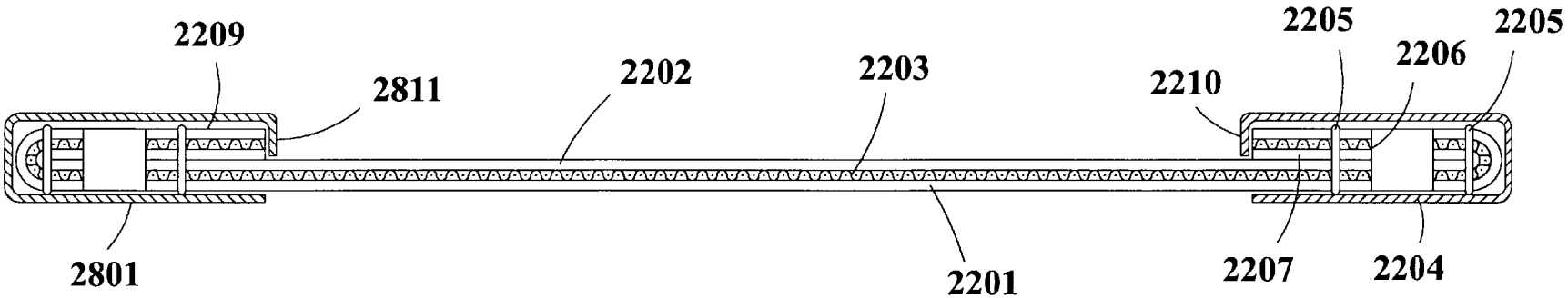
FIG. 23A is a cross-sectional view similar to the view of FIG. 23 except the cross hatching of the polymeric plies is not illustrated so as to better depict the curtain.
Figure 23C:
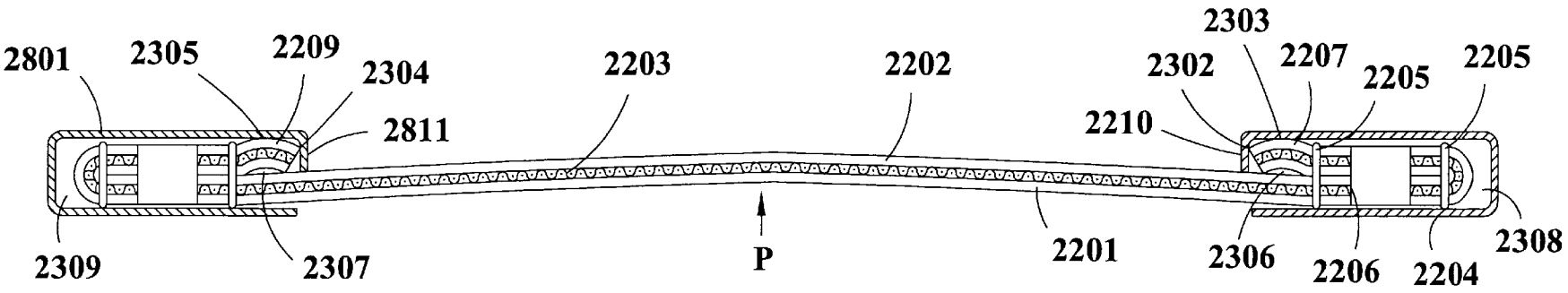
FIG. 23C is similar to the view shown in FIG. 23A except the curtain is shown under the influence of pressure "P."
Figure 23B:
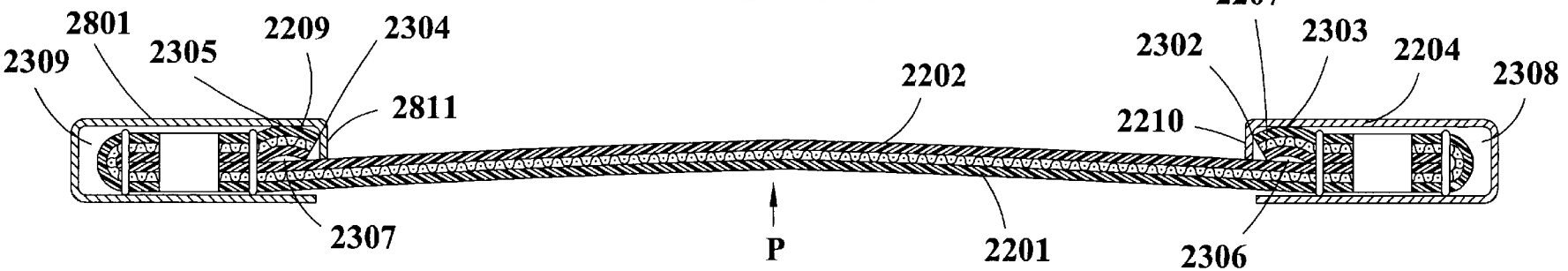
FIG. 23B is similar to the view shown in FIG. 23 except the curtain is shown under the influence of pressure "P."

FIG. 23 is a cross-sectional view taken along the lines 23—23 of FIG. 28. FIG. 23A is identical to FIG. 23 without cross-hatching of the polymeric plies illustrated. FIGS. 23 and 23A illustrate the curtain without any pressure applied. FIGS. 23B and 23C correspond to FIGS. 23 and 23A, respectively, only they are illustrated with pressure applied.

FIGS. 23B and 23C are cross-sectional views of the three-ply curtain and tracks with the curtain under the influence of a force, for example, a high velocity wind indicated by the letter "P." The force of the wind causes the curtain to attempt to extract itself from the tracks 2204 and 2801. The folded edge which have loose flaps are deformed and seal the interior of the tracks 2204 and 2801. There are at least four sealed points 2302, 2303 on the right side and 2304, 2305 on the left side when viewing FIGS. 23B and 23C. Gaps 2306 and 2307 are created between the flaps 2207 and 2209 the three-ply flexible curtain when the curtain is under pressure "P." Gap 2308 between track 2204 and the folded edge is created as the curtain attempts to exit the track. Similarly, gap 2309 between track 2801 and the other folded edge is created as the curtain attempts to exit the track. As force is applied, flaps 2207 and 2209 are no longer loose and act as shock absorbers which take up energy imparted to the curtain by the wind. The elastic properties of the flexible curtain absorb the energy of the wind. Hook portions 2210 and 2811 of tracks 2204 and 2801 are spaced from the curtain at rest such that the aforementioned seals will be made when the curtain is subjected to pressure.

Figure 24:
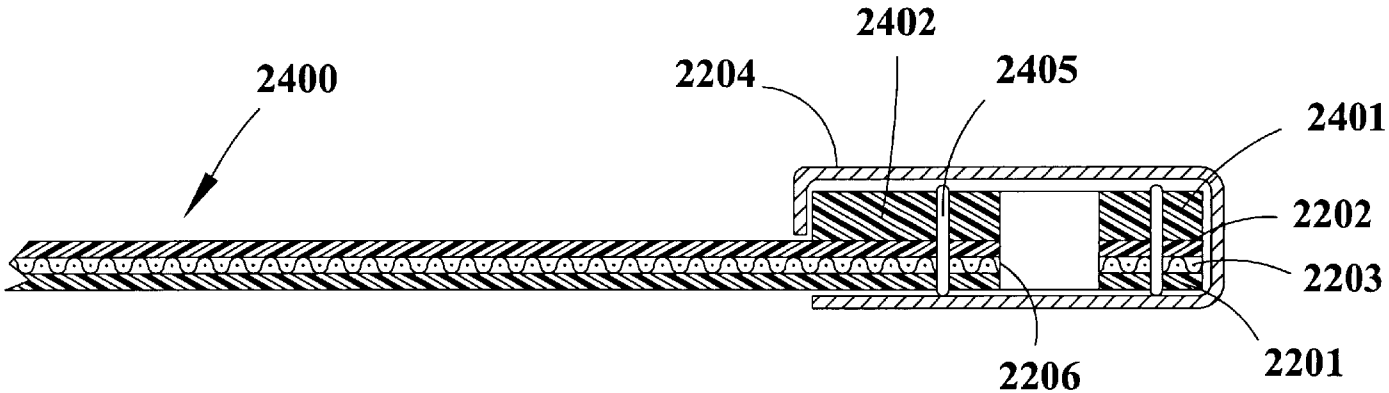
FIG. 24 is a cross-sectional view of a three-ply curtain together with a semi-rigid strip affixed to one edge thereof.

FIG. 24 is a cross-sectional view of a three-ply curtain together with a semi-rigid polymeric strip 2401 affixed to one edge thereof. The polymeric rigid strip 2401 includes a flap 2402 which is not securely fastened to the three-ply curtain 2400. Stitching 2405 or other means may be used to affix the strip to the curtain 2500.

Figure 25:
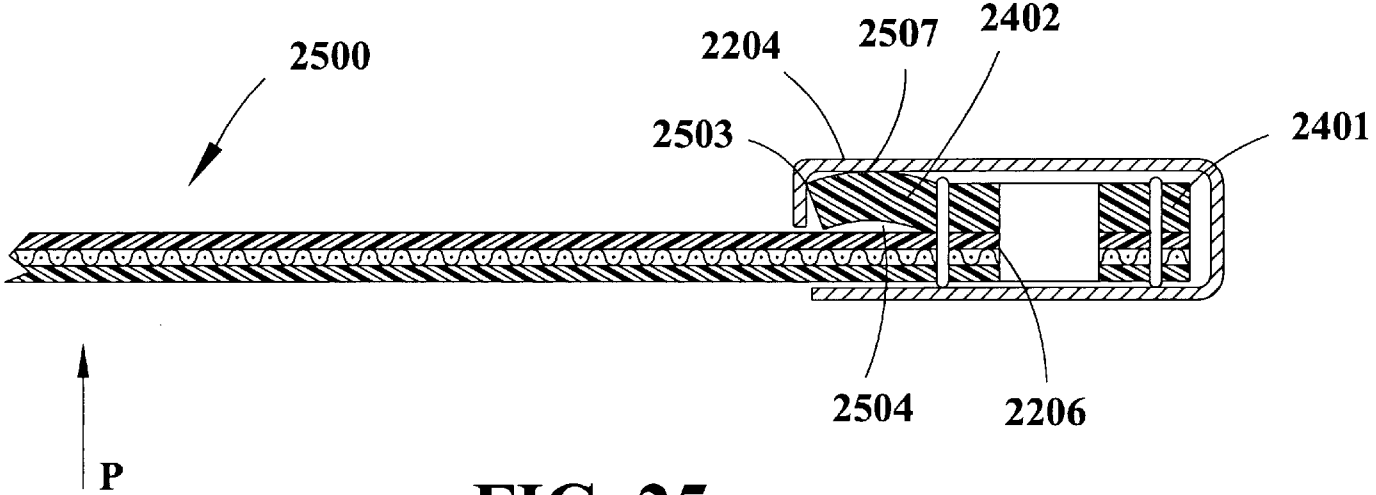
FIG. 25 is a cross-sectional view of a three-ply curtain similar to the view of FIG. 23 with the curtain under the influence of a force, for example, a high velocity wind.

FIG. 25 is a cross-sectional view of a three-ply curtain similar to the view of FIG. 23 with the curtain under the influence of a force, "P," for example a high velocity wind. A seal is made at points referred to by reference numerals 2503 and 2507. Gap 2504 exists between the rigid strip 2402 and the main three-ply curtain.

Figure 26:
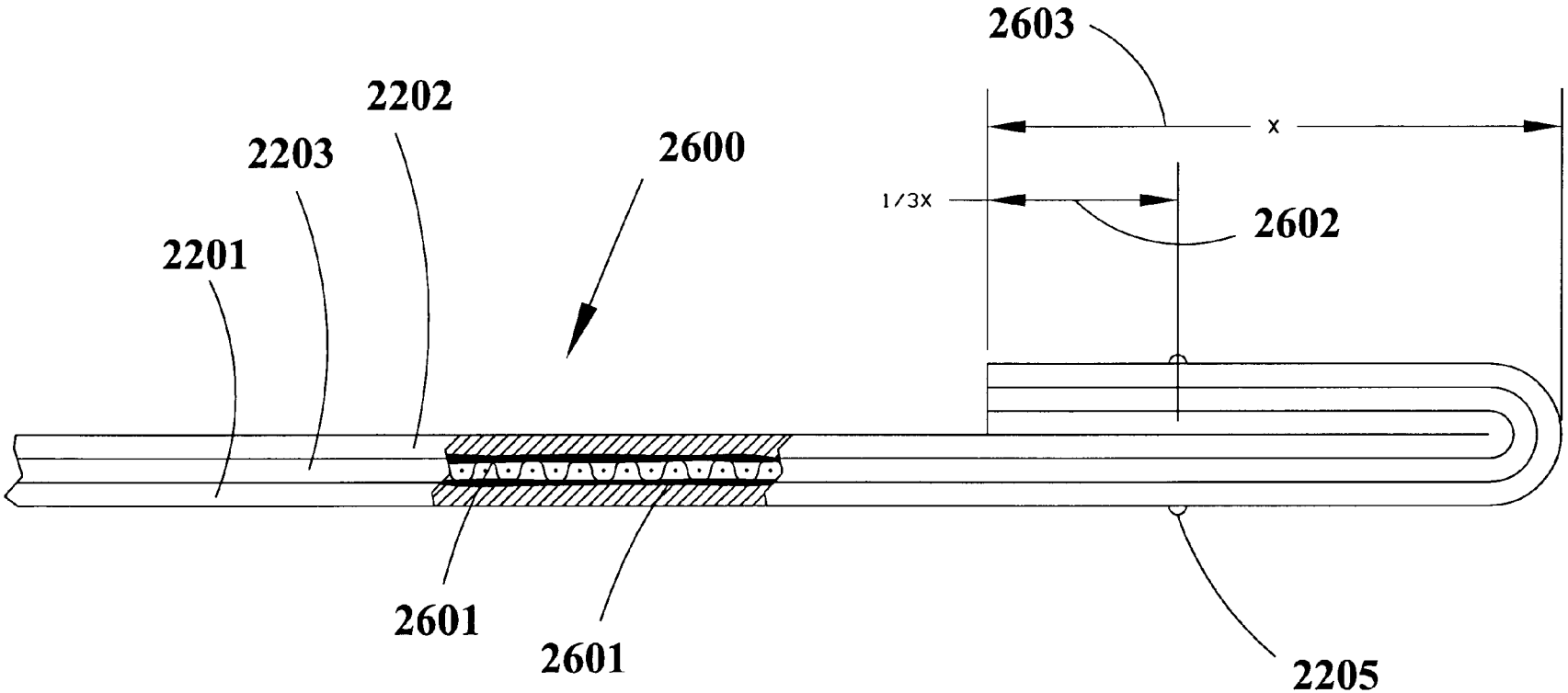
FIG. 26 is a cross-sectional view of a three-ply curtain having a folded edge and illustrating two polymer sheets and a woven sheet secured together with adhesive.

FIG. 26 is a cross-sectional view of a three-ply curtain having a folded edge and illustrating two polymeric plies 2201 and 2202 and a woven sheet 2203 secured together with adhesive 2601. Reference numeral 2602 indicates a ⅓ flap length as the preferred free distance of the flap. Similarly, reference numeral 2603 illustrates that ⅔ of the flap is secured by stitching 2205. Those skilled in the art will readily recognize that different lengths may be chosen for securement with attendant different results. In the preferred embodiment the track has an approximate inner length of one inch meaning that ⅓ of an inch would be the free distance for the flap and ⅔ of an inch would be the secured distance for the flap. These distances represent the preferred embodiment and in no way limit the invention.

Figure 26A:
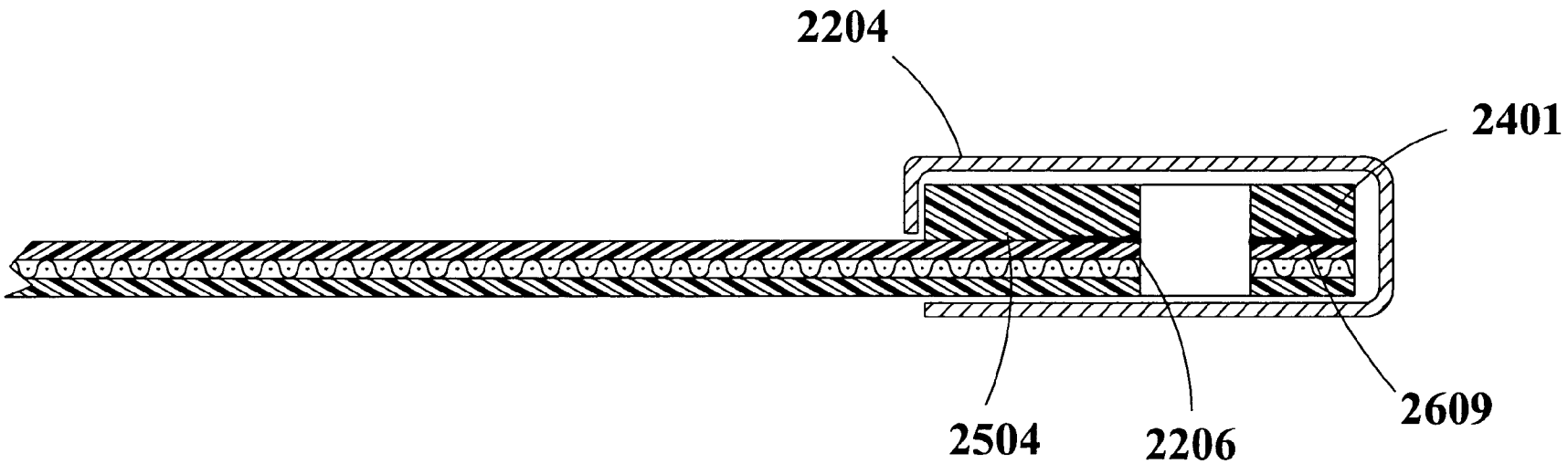
FIG. 26A is a cross-sectional view of a three-ply curtain having a semi-rigid strip affixed to one edge thereof by means of adhesive.

FIG. 26A illustrates adhesive 2609 affixing a portion of the semirigid strips 2401 to the main three-ply curtain. Alternatively, a strip of the three-ply curtain may be used in place of the semirigid strip.

Figure 26B:
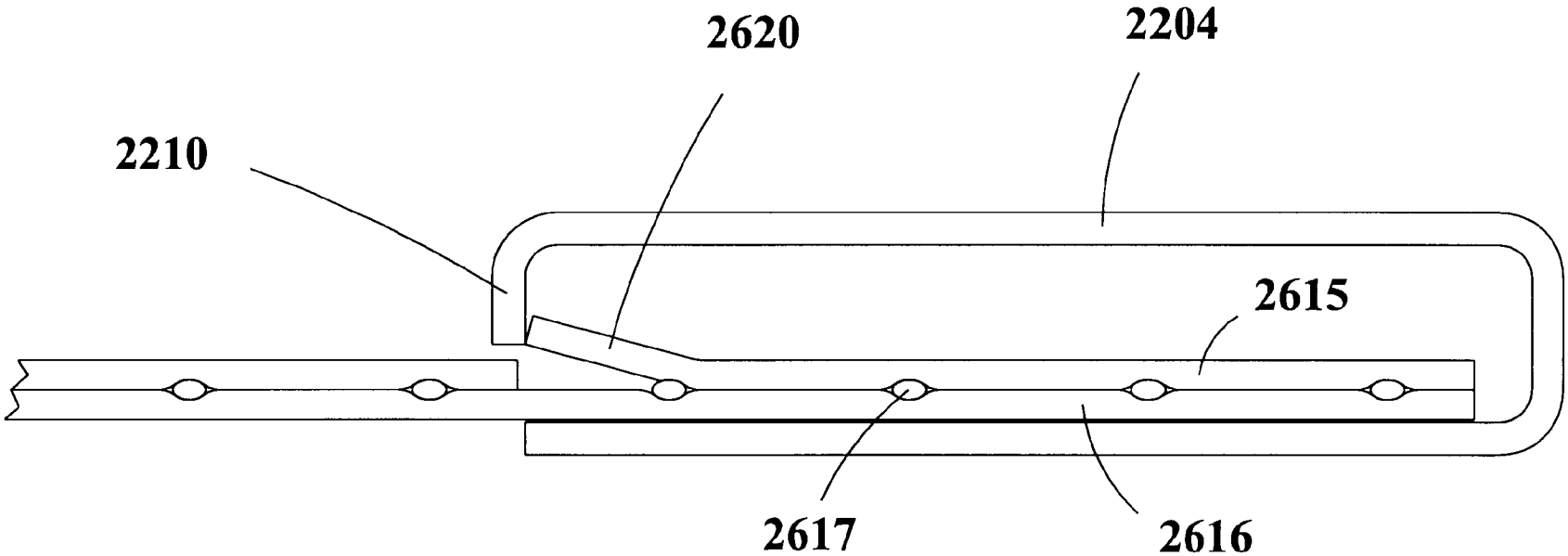
FIG. 26B is a cross-sectional view of an embodiment employing two plies of polymeric material secured together with a fiber reinforcement. One ply of the polymeric material has been slit to engage the track when the curtain is under tension.

FIG. 26B is a cross-sectional view of an embodiment employing two plies of polymeric material 2615, 2616 secured together with a fiber reinforcement 2617. This material is high-tear vinyl polyester and is commercially available from BONDCOAT MANUFACTURING COMPANY. A loose flap 2620 has been slit such that it engages truck 2204 at lip 2210 when the curtain is under the influence of pressure. The slit may be used in either the horizontal or the divergent angle embodiments.

FIG. 27 is a rear view of the three-ply flexible curtain 2700 illustrating a semi-rigid strip applied to both edges of the curtain. Semi-rigid strip 2702 is applied to the left side of the curtain and semi-rigid strip 2701 is applied to the right side of the right edge of the curtain. Apertures 2703 are placed in a repeating fashion along the left and right side edges of the curtain for interengagement with conical cogs to raise and lower the curtain.

FIG. 28 is a front view of a three-ply curtain 2805 driven by a cog/pin drive 2802 (sometimes referred to herein as the drive roller 2802) having cogs/pins 2803. Leftside track 2801 is illustrated in FIG. 28 as is rightside track 2204. These tracks are secured to the building structure as indicated in FIG. 4. Wind-up reel 2804 sometimes referred to herein as a storage reel is illustrated and it is also counterbalanced. See, FIG. 28B. FIG. 28 illustrates the curtain in its second, down position.

Figure 28A:
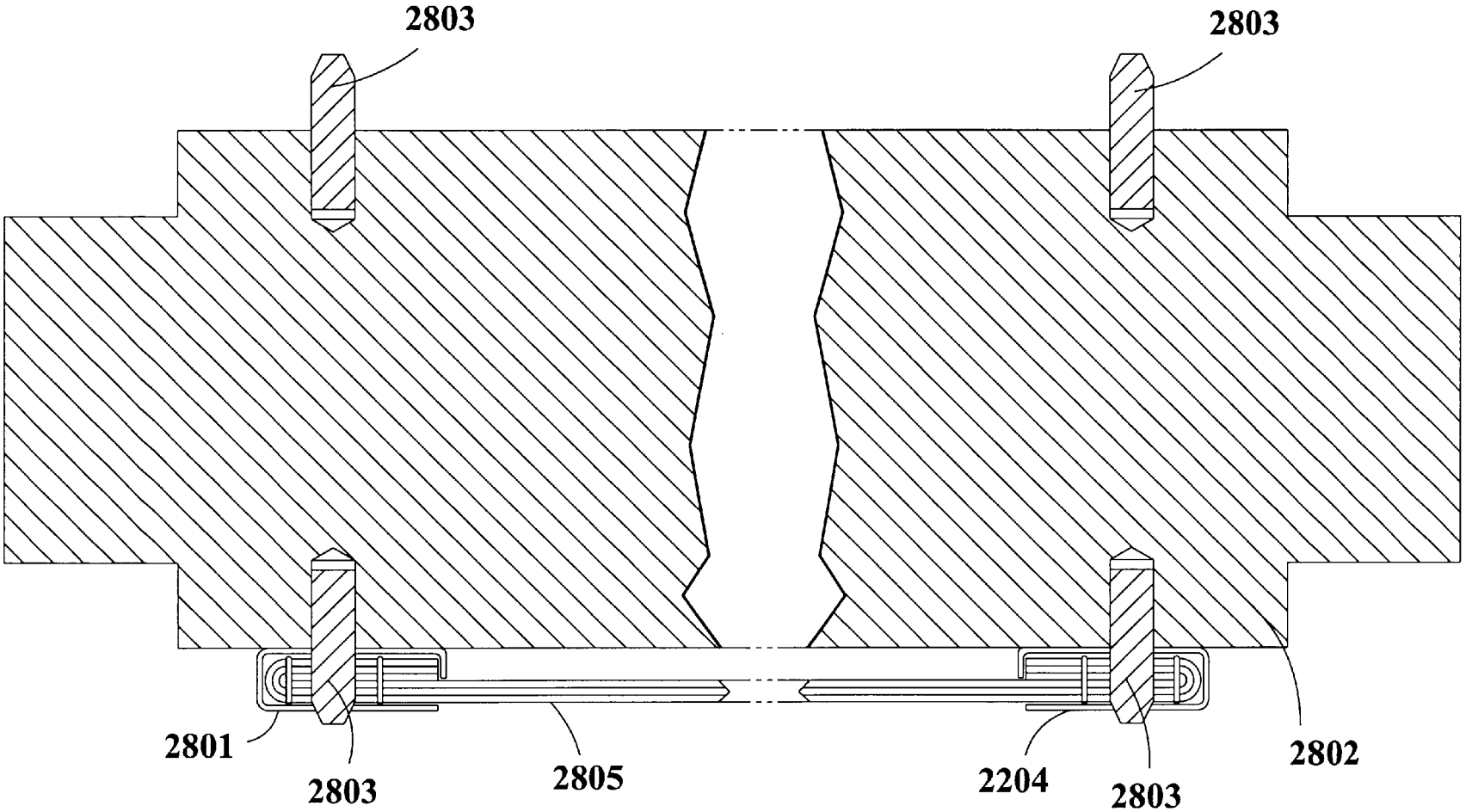
FIG. 28A is a cross-sectional view taken along the lines 28A—28A of FIG. 28 illustrating the drive roller.

FIG. 28A is a cross-sectional view taken along the lines 28A—28A of FIG. 28 illustrating the drive roller 2802. The drive roller 2802 is driven by a motor or by a hand operated pulley. See, FIG. 1 illustrating an arrangement for accomplishing operation of the drive roller 2802. The drive roller 2802 and the storage reel are supported as illustrated in FIG. 1. The drive roller 2802 supports the curtain which is under constant tension between the cogs/pins 2803 and the storage reel 2804. In practice, the three-ply curtain is less than 1/16 of an inch thick and, where folded, less than ⅛ of an inch thick. It is important to keep the flexible curtain taut between the storage reel 2804 and the drive roller 2802 so as to ensure an even accumulation of the curtain on the storage roller. By even, it is meant a smooth continuous winding without folds or creases.

Figure 28B:
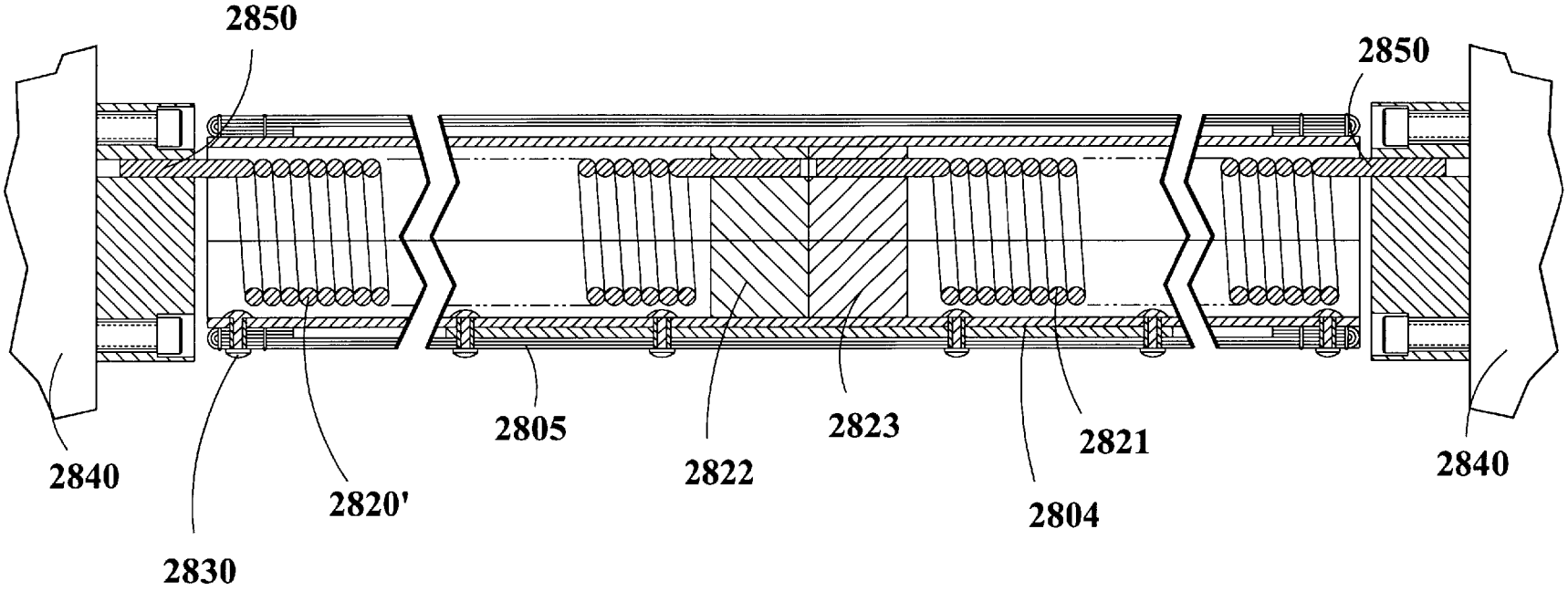
FIG. 28B is a cross-sectional view taken along the lines 28B—28B of FIG. 28 illustrating counterbalanced springs which tension the curtain between the drive cogs and the storage reel. Further, securement of the springs to a fixed structure is shown in this view but is not shown in FIG. 28.
Figure 28C:
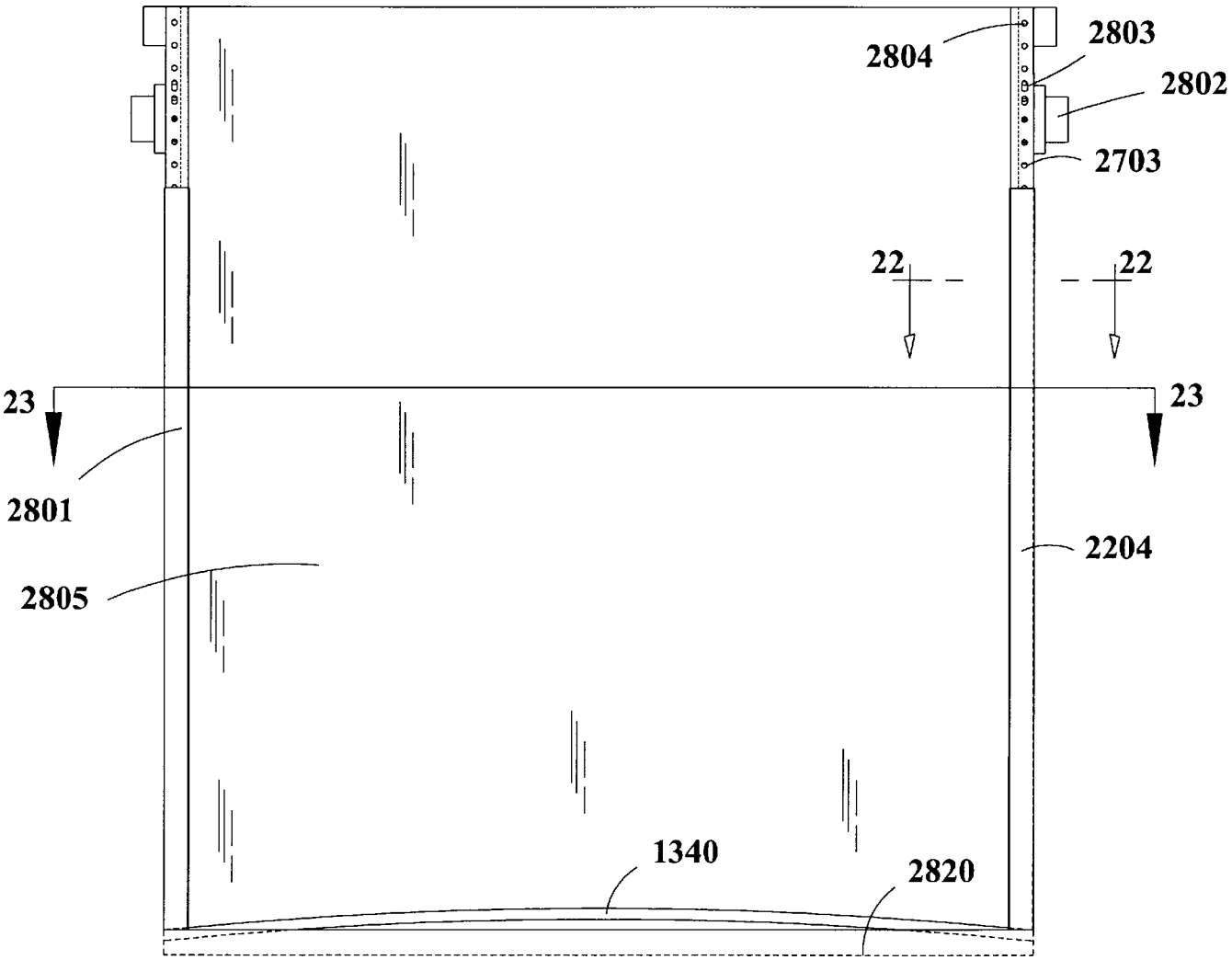
FIG. 28C is a view similar to FIG. 28 further illustrating a bowed bottom bar.
Figure 28D:
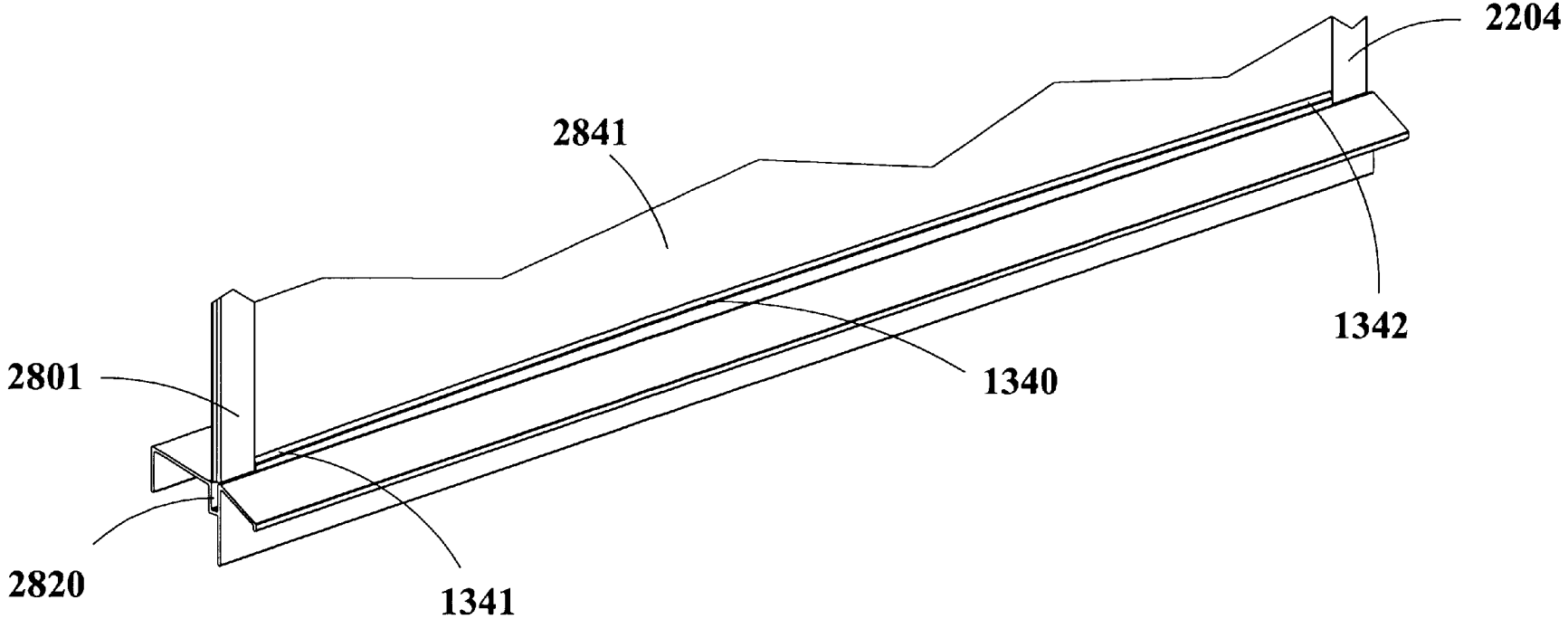
FIG. 28D is a perspective view illustrating the bottom bar being guided by the tracks into the storage slot.

FIG. 28B is a cross-sectional view taken along the lines 28B—28B of FIG. 28 illustrating counterbalanced springs 2820', 2821 which tension the curtain between the drive cogs 2803 and the storage reel 2804. The springs are grounded by pegs 2850 which are coupled to the building 2840. Spring holders 2822, 2833 secure the spring to the storage reel 2804. FIG. 28C is a view similar to FIG. 28 further illustrating a bowed bottom bar 1340 approaching a retaining slot 2820 as illustrated in FIG. 28D as previously described above. Tracks 2801 and 2204 keep the edges of the curtain aligned with the retaining slot. The edges 1341, 1342 of the bottom portion 1340 of the curtain enter the retaining slot 2820 first followed by the middle portion.

Figure 28E:
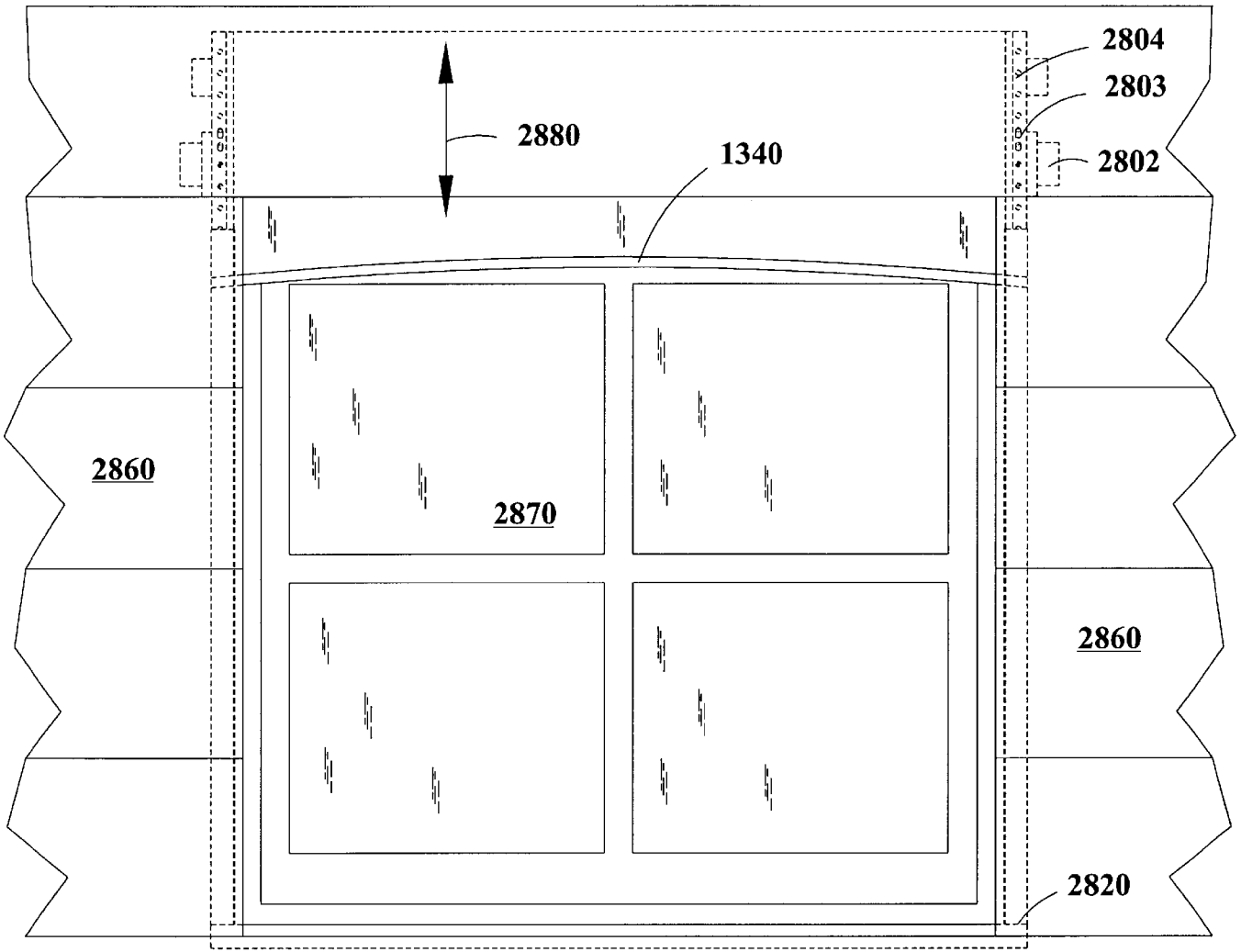
FIG. 28E is a front view of a flexible curtain and window in a building illustrating the curtain in its first, open position.
Figure 28F:
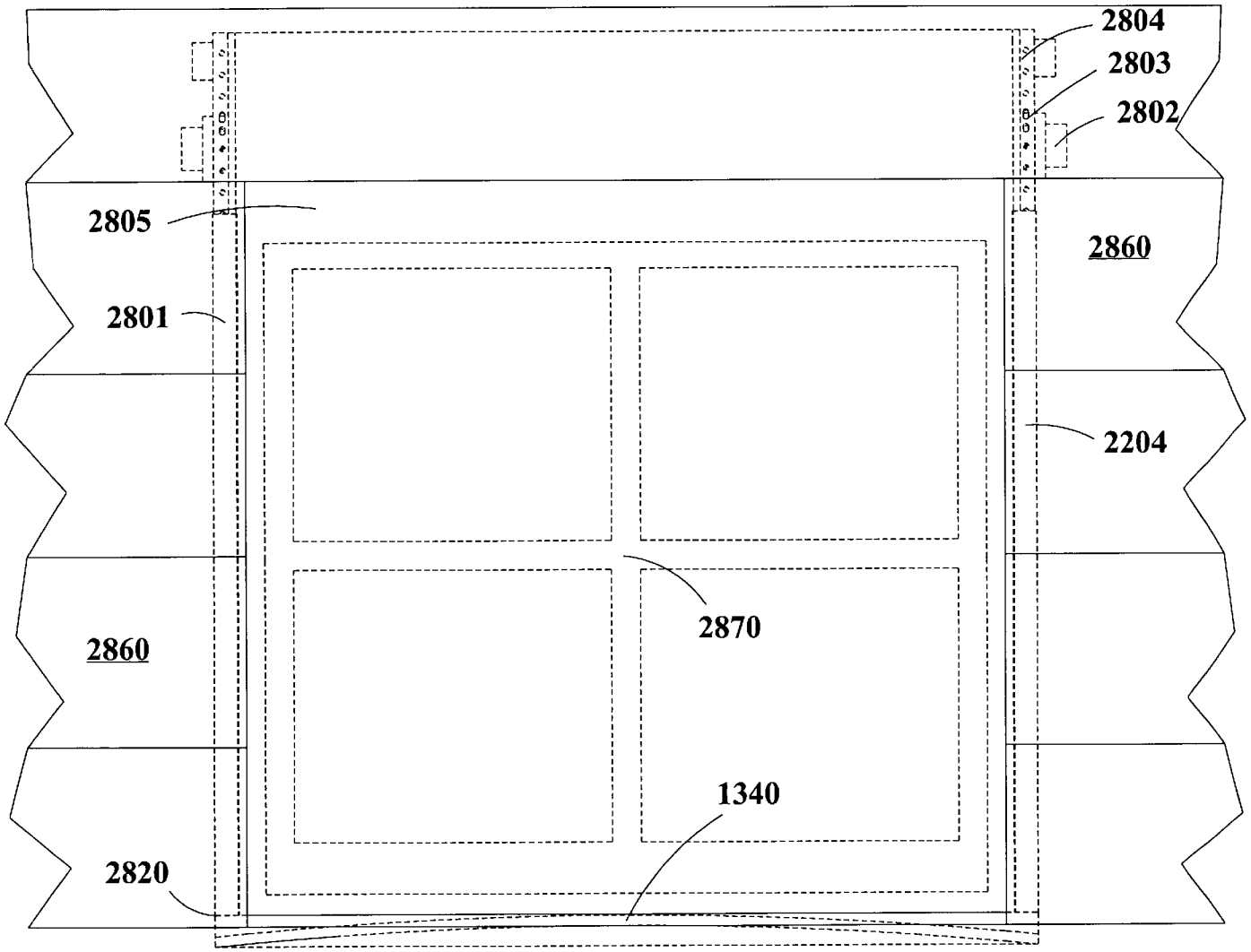
FIG. 28F is a front view of a flexible curtain and window in a building illustrating the curtain in its second, closed position.

FIG. 28E is a front view of flexible curtain 2805 and window 2870 in a building illustrating the curtain in a first, open position. Bottom bar 1340 is shown in phantom behind siding 2860. Reference numeral 2880 indicates travel of the curtain upwardly and downwardly. FIG. 28F is a front view of a flexible curtain 2805 illustrated in the second, closed position. Window 2870, side tracks 2801 and 2204, and retaining slots 2820 are illustrated in FIG. 28F in phantom. The side tracks and retaining slots are affixed to the frame of the building in a manner understood by those skilled in the art. Alternatively, the window 2870 and curtain may be preinstalled as illustrated in FIGS. 4B and 4D, for example. Frame 407 in FIG. 4B represents an embodiment which may be used to preinstall the window and curtain.

Figure 29:
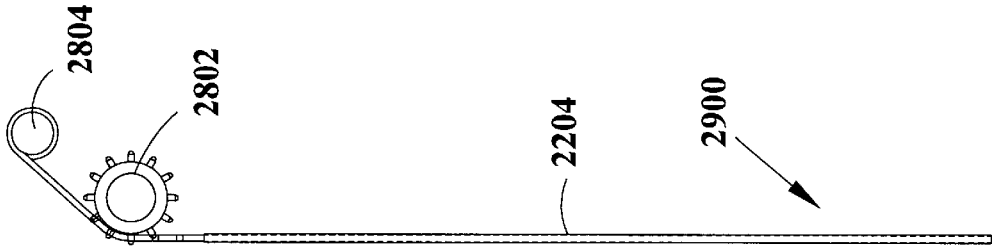
FIG. 29 is a side view of FIG. 28.

FIG. 29 is a side view of FIG. 28 and reference numeral 2900 generally indicates the assembly. Track 2204 is also shown in FIG. 29.

Figure 30:
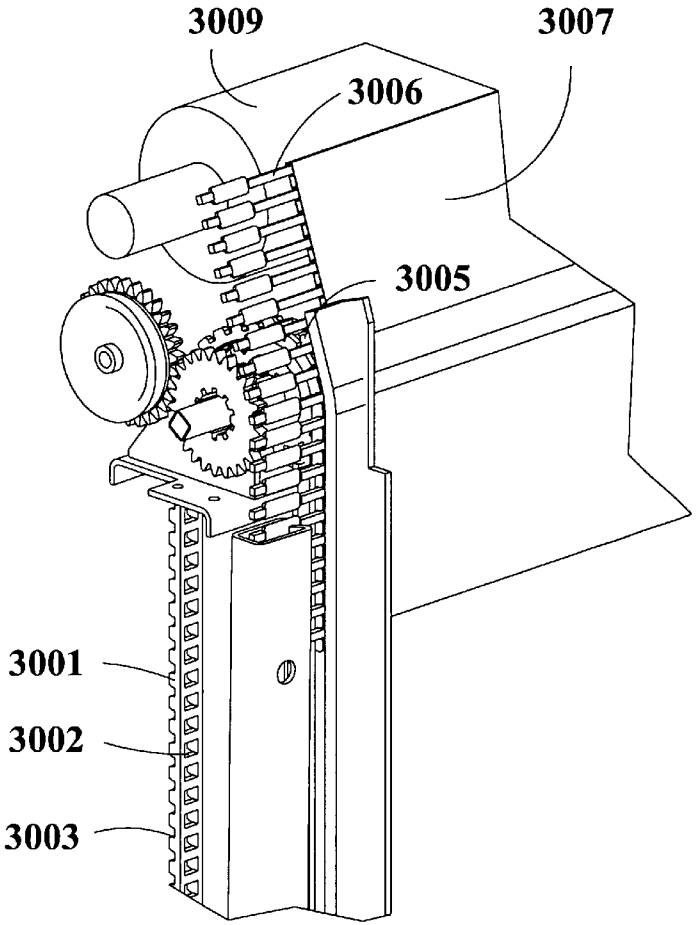
FIG. 30 is a perspective view of the chain (drive adapter rack) and gear drive.

FIG. 30 is a perspective view of the chain drive (drive adaptor rack) and gear drive. In this embodiment the tension rods 3006 pass through the flexible curtain 3007 and are tensioned and rolled up upon counterbalanced wind-up reel 3009. Adaptor rack 3001 includes notched holes 3002 that are vertically spaced between slots 3003 with rods 3006 at a spacing equal to the circular pitch of the drive gear 3005 as the curtain is moved from the opened, first position to the closed, second position. The drive system of FIG. 30 is preferably used with the parallel embodiment but with certain modifications it may be used with the divergent track.

Figure 31:
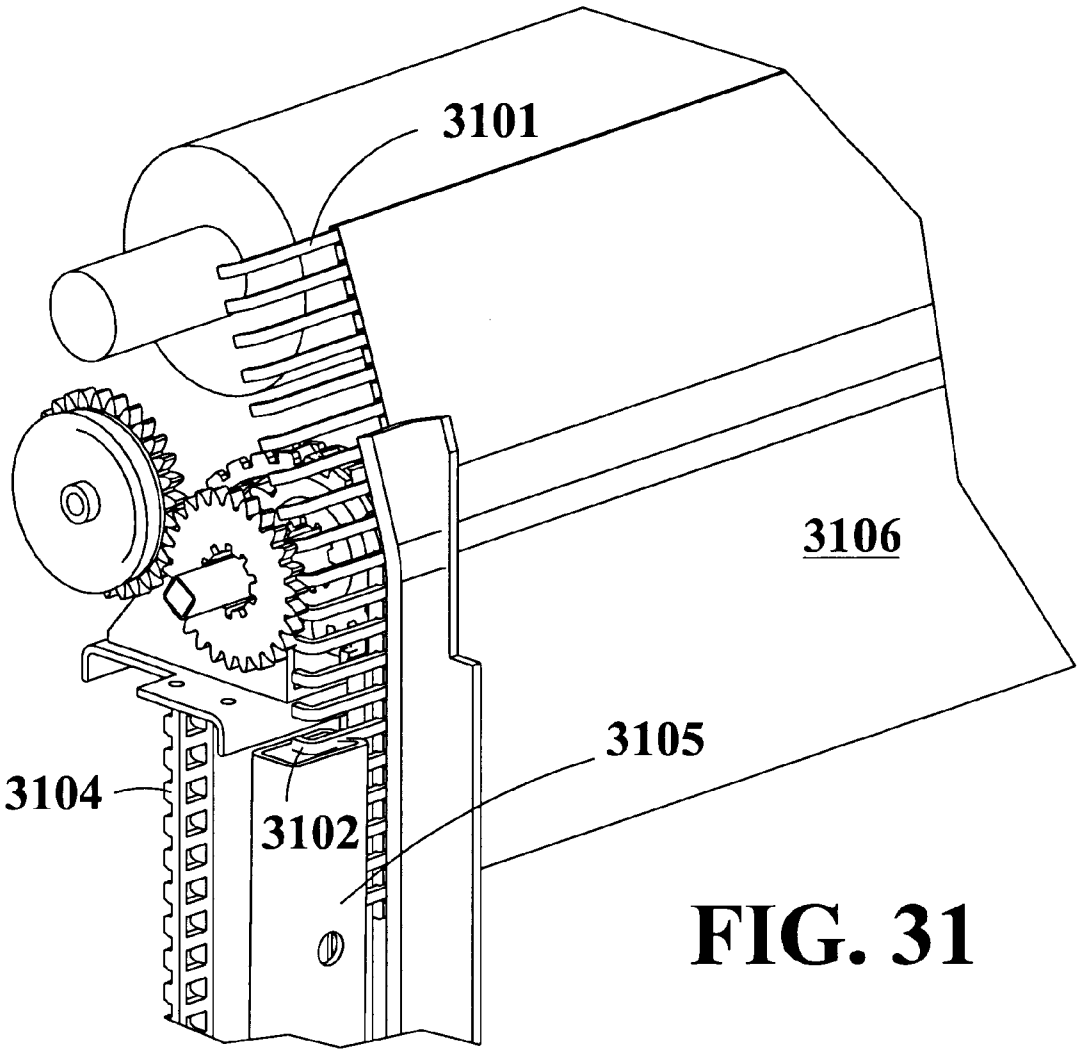
FIG. 31 is a perspective view of an adapter rack illustrating tensioning rods having a ninety degree (90°) bend at the edges thereof

FIG. 31 is a perspective view of an adaptor rack 3104 illustrating tensioning rods 3101 having a 90° bend 3102 at the edges thereof. This embodiment of the drive system may be used with the divergently angled tracks or it may be used with the parallel tracks. Rods 3101 pass through corrugated curtain 3106. Track 3105 is the same track described previously.

Figure 32:
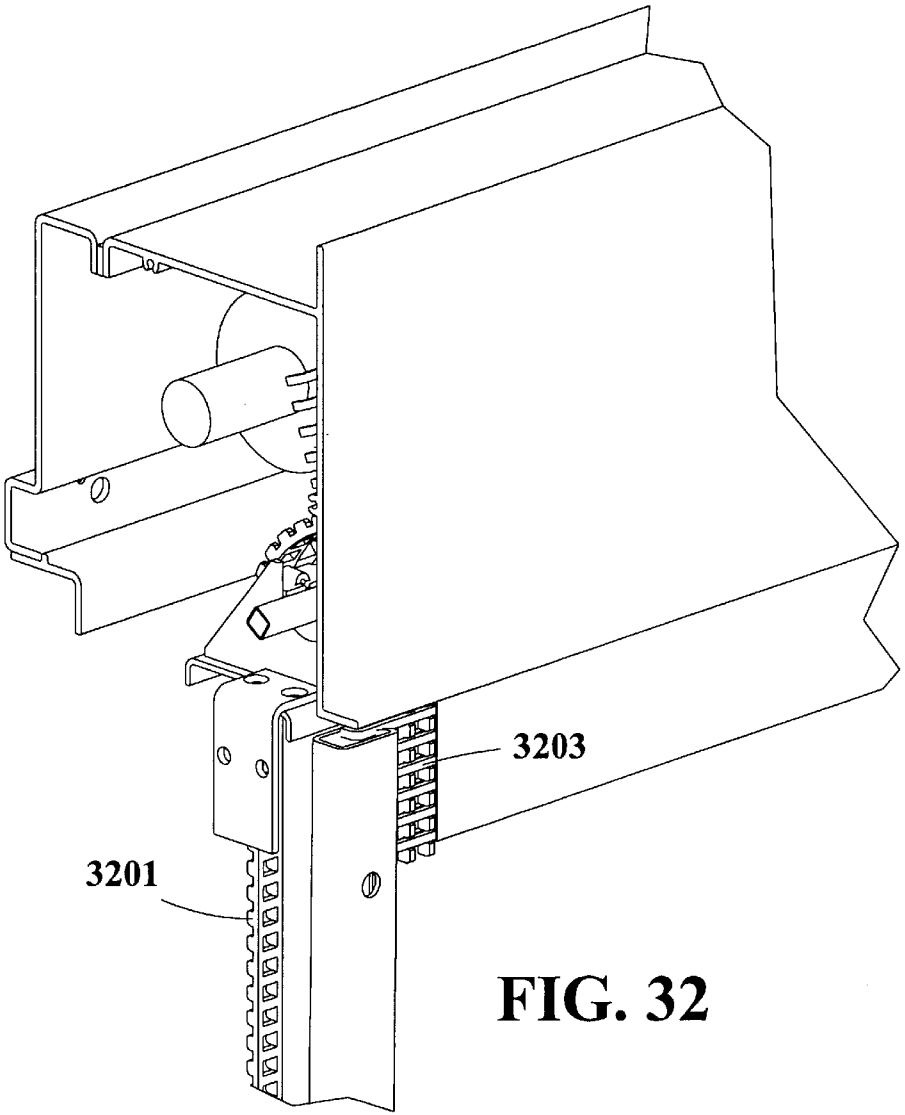
FIG. 32 is a perspective view of an adapter drive.

FIG. 32 is a perspective view of an adaptor drive illustrating engagement of tensioning rods 3203 with the adaptor drive 3201.

Figure 33:
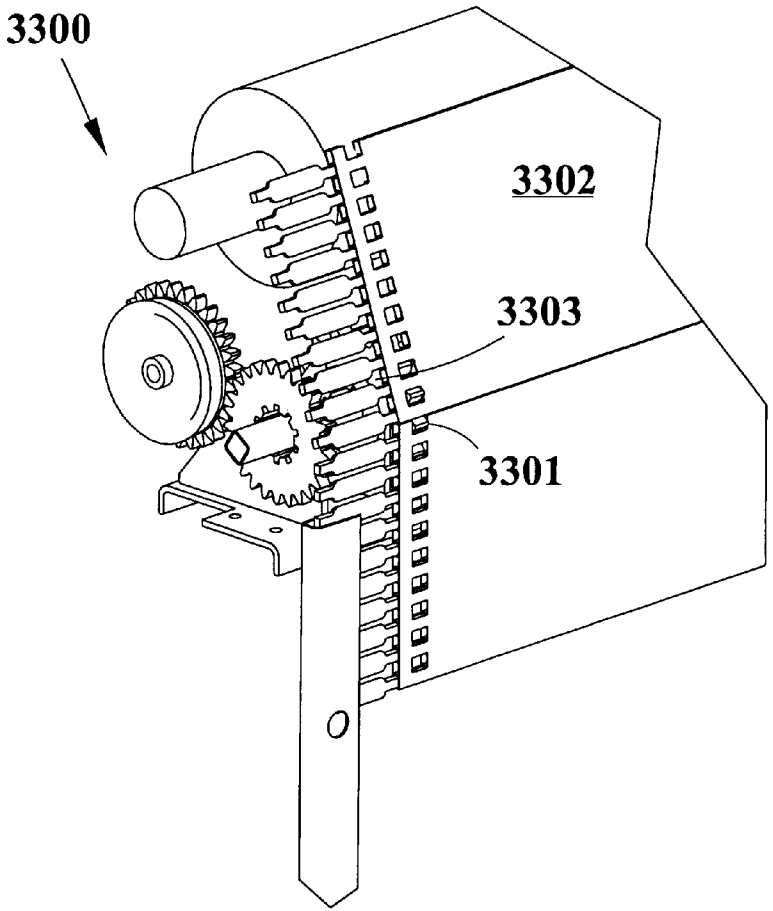
FIG. 33 is a perspective view of the gear drive.

FIG. 33 is a perspective view of a gear drive such as the one illustrated in FIG. 1 and is generally represented by reference numeral 3300. Gear 3303 includes teeth 3301 which drive the flexible curtain 3302. FIG. 33 illustrates the curtain in the down, second position.

It will be understood by those skilled in the art that several changes may be made to the instant invention without departing from the spirit and scope of the claims which follow hereinbelow.

What is claimed is:

1. A curtain system for covering a window, door or other opening in a building, comprising:

a frame affixed to said building;

said frame resides to the exterior of said window, door or other opening in said building;

a sheet-like flexible curtain interengaging said frame and residing exteriorly of said window, door or other opening;

a gear rotatably affixed to said frame for driving said sheet-like flexible curtain;

and, said gear having teeth which interengage said apertures in said sheet-like flexible curtain for driving said sheet-like flexible curtain so as to alternately cover and uncover said opening in said building.

2. A curtain system for covering a window, door or other opening in a building, comprising:

a frame affixed to said building;

said frame resides to the interior of said window, door or other opening in said building;

a sheet-like flexible curtain interengaging said frame and residing interiorly of said window, door or other opening;

a gear rotatably affixed to said frame for driving said sheet-like flexible curtain;

and, said gear having teeth which interengage said apertures in said sheet-like flexible curtain for driving said sheet-like flexible curtain so as to alternately cover and uncover said opening in said building.

3. A windlocking system for covering a window, door or other opening in a building, comprising:

a frame affixed to said building;

said frame resides to the exterior of said window, door or other opening in said building;

a sheet-like flexible curtain interengaging said frame and residing exteriorly of said window, door or other opening;

a gear rotatably affixed to said frame for driving said sheet-like flexible curtain;

and, said gear having teeth which interengage said apertures in said sheet-like flexible curtain for driving said sheet-like flexible curtain so as to alternately cover and uncover said opening in said building.

4. A windlocking system for covering a window, door or other opening in a building, comprising:

a frame affixed to said building;

said frame resides to the interior of said window, door or other opening in said building;

a sheet-like flexible curtain having apertures;

said sheet-like flexible curtain interengaging said frame and residing interiorly of said window, door or other opening;

a gear rotatably affixed to said frame for driving said sheet-like flexible curtain;

and, said gear having teeth which interengage said apertures in said sheet-like flexible curtain for driving said sheet-like flexible curtain so as to alternately cover and uncover said opening in said building.

5. A shutter system for covering a window, door or other opening in a building, comprising:

a frame affixed to said building;

said frame resides to the exterior of said window, door or other opening in said building;

a sheet-like flexible curtain having apertures;

said sheet-like flexible curtain interengaging said frame and residing exteriorly of said window, door or other opening;

a gear rotatably affixed to said frame for driving said sheet-like flexible curtain;

and, said gear having teeth which interengage said apertures in said sheet-like flexible curtain for driving said sheet-like flexible curtain so as to alternately cover and uncover said opening in said building.

6. A shutter system for covering a window, door or other opening in a building, comprising:

a frame affixed to said building;

said frame resides to the interior of said window, door or other opening in said building;

a sheet-like flexible curtain having apertures;

said sheet-like flexible curtain interengaging said frame and residing interiorly of said window, door or other opening;

a gear rotatably affixed to said frame for driving said flexible curtain;

and, said gear having teeth which interengage said apertures in said sheet-like flexible curtain for driving said sheet-like flexible curtain so as to alternately cover and uncover said opening in said building.

* * * * *

UNITED STATES PATENT AND TRADEMARK OFFICE

CERTIFICATE OF CORRECTION

PATENT NO. : 6,341,639 B1
DATED : January 29, 2002
INVENTOR(S) : Mullet et al.

It is certified that error appears in the above-identified patent and that said Letters Patent is hereby corrected as shown below:

Column 1,
Line 4, insert -- co-pending - after “of” and before “application”

Column 2,
Line 54, delete “potions” and insert -- portions --

Column 5,
Line 17, insert -- . -- after proof

Column 7,
Line 35, insert -- in -- after “opening” and before “a”
Line 53, insert -- a -- after “is” and before “further”

Column 8,
Line 47, The word “Another” should begin a new paragraph

Column 18,
Line 17, delete “.” after generally” and before denotes”

Column 23,
Line 13, insert -- a sheet-like flexible curtain having apertures; -- after “building” and before “a” as a separate paragraph
Line 14, delete “a” and insert -- said --
Line 27, insert -- a sheet-like flexible curtain having apertures; -- after “building” and before “a” as a separate paragraph
Line 28, delete “a” and insert -- said --

UNITED STATES PATENT AND TRADEMARK OFFICE

CERTIFICATE OF CORRECTION

PATENT NO. : 6,341,639 B1
DATED : January 29, 2002
INVENTOR(S) : Mullet et al.

It is certified that error appears in the above-identified patent and that said Letters Patent is hereby corrected as shown below:

Column 23 cont'd,
Line 41, insert -- a sheet-like flexible curtain having apertures; -- after "building" and before "a" as a separate paragraph
Line 42, delete "a" and insert -- said --

Signed and Sealed this

Second Day of July, 2002

*Attest:*

*Attesting Officer*

JAMES E. ROGAN
*Director of the United States Patent and Trademark Office*